364-422 SR
-71 X3 4,454,756

United States Patent [19]

Sharp et al.

[11] 4,454,756

[45] Jun. 19, 1984

[54] INERTIAL BOREHOLE SURVEY SYSTEM

[75] Inventors: Harper E. Sharp, Houston, Tex.; Leo Spiegel, Sharon, Mass.; Richard M. Masters, Elmer J. Frey, both of Lexington, Mass.; John R. Howatt, Bedford, Mass.; Gary E. Walker, Dover, Mass.

[73] Assignee: Wilson Industries, Inc., Houston, Tex.

[21] Appl. No.: 442,849

[22] Filed: Nov. 18, 1982

[51] Int. Cl.[3] ..... E21B 47/00

[52] U.S. Cl. ..... 73/151; 33/313; 364/422

[58] Field of Search ..... 73/151, 1 E; 33/304, 33/312, 313; 364/422

[56] References Cited

U.S. PATENT DOCUMENTS

| | | | |
|---|---|---|---|
| 3,229,533 | 1/1966 | Draper et al. | 33/323 |
| 3,242,744 | 3/1966 | Fischel | 33/323 |
| 3,587,175 | 6/1971 | Armistead | 33/313 |
| 3,753,296 | 8/1973 | Van Steenwyk | 33/304 |
| 3,808,697 | 5/1974 | Hall | 33/312 |
| 3,845,569 | 11/1974 | Otte et al. | 33/312 |
| 3,862,499 | 1/1975 | Isham et al. | 33/312 |
| 4,071,959 | 2/1978 | Russell et al. | 33/312 |
| 4,174,577 | 11/1979 | Lewis | 33/302 |
| 4,192,077 | 3/1980 | Van Steenwyk et al. | 33/313 |
| 4,197,654 | 4/1980 | Van Steenwyk et al. | 33/304 |
| 4,199,869 | 4/1980 | Van Steenwyk | 33/302 |
| 4,227,404 | 10/1980 | West | 364/422 X |
| 4,238,889 | 12/1980 | Barriac | 33/304 |
| 4,244,116 | 1/1981 | Barriac | 33/304 |
| 4,245,498 | 1/1981 | Poquette, Jr. | 73/151 |
| 4,297,790 | 11/1981 | Van Steenwyk et al. | 33/313 |
| 4,302,886 | 12/1981 | Starr | 33/312 |

OTHER PUBLICATIONS

Camden, David John, et al., "A New Continuous Guidance Tool Used for High Accuracy Directional Surveys", Society of Petroleum Engineers, Oct. 1981.

Watts, Alfred C., "The Application of Inertial Navigation to Wellbore Positional Surveying", Sandia National Laboratories, SANDIA REPORT SAND-80-0913, Jun. 1982.

Wardlaw, Ralph Jr., "The Wellbore Inertial Navigation System (WINS) Software Development and Test Results", Sandia National Laboratories, SANDIA REPORT SAND82-1954, Sep. 1982.

Kohler, Steward M., "Inertial Navigation System for Directional Surveying", Sandia National Laboratories, SANDIA REPORT SAND82-1668, Sep. 1982.

*Primary Examiner*—Jerry W. Myracle

*Attorney, Agent, or Firm*—Hubbard, Thurman, Turner & Tucker

[57] ABSTRACT

A system and method for surveying, with accuracies better than one foot per thousand feet of depth, very deep boreholes having the attendant small diameters, high temperatures and high pressures with very high accuracy. A downhole probe is used having a small diameter, less than about four inches. Three linear type accelerometers and at least two gyros to provide three sensitive axes are fixedly mounted at points spaced along the axis of an elongated, rigid, thermally conductive support member to form an instrument cluster. Signals from these instruments are then processed and transmitted serially over a conductor of a conventional wireline to the surface unit where a surface computer continuously computes and records the current position of the instrument.

51 Claims, 25 Drawing Figures

32
34
36
30
22
20
38
28
122
24
26
136
38

29
PRINTER
27
REAL TIME DISPLAY
31
COMPUTED DATA RECORDER
39
39A
FIXED CALIBRATION DATA-PROBE 24
FIXED CALIBRATION DATA-PROBE 24A
25
COMPUTER
RAW DATA RECORDER
33
BATTERY CHARGER
35
37
41
MULTIPLEX SWITCH
41A
34
28
24
130
24
142
32
36A
24A 130
42
44
4A
46
40
4B
159
48
4C
50
52
4D
54
4E
56
58
4F

INERTIAL BOREHOLE SURVEY SYSTEM

The present invention relates generally to the art of surveying boreholes, and more particularly relates to a system for determining the precise location of deep, small diameter wellbores.

There are many instances when it is very important to determine and/or control the location of a wellbore relative to a vertical line projected through the wellsite. This is particularly true in the petroleum industry where deep boreholes often diverge dramatically from a vertical projection through the point of entry into the earth, either accidentally or to reach deep strata displaced horizontally from the wellsite. A prime example of this need is in offshore production where fluids are produced from a large area by a large number of highly divergent wells drilled and produced from a single platform. Directional drilling capabilities have been increased to the point where even very deep wellbores can be drilled along a desired path, if the position of the wellbore can be ascertained during the drilling process. In the event of a deep, high pressure blowout, it is very important to know the precise location of the wellbore so that a relief well can be drilled to intercept the blowout well at the deep, high pressure formation. It is also common practice to produce previously completed wells while new wells are being drilled from the same relatively small platform. As a result, knowledge of the precise location of each producing wellbore is very important to prevent accidentally drilling into a live well.

High pressure oil and gas wells are commonly being drilled to depths of 20,000, and sometimes 30,000 feet or deeper. In general, the greater the depth, the smaller the borehole and the higher the temperatures and pressures. For example, in boreholes over 10,000 feet in depth, the interior diameter of the cased borehole is often less than five inches, the temperatures may exceed 400° F., and the pressures may exceed 10,000 psi. Further, it is sometimes desirable to be able to survey a wellbore utilizing an instrument lowered through the drill string, in which case the external diameter of the survey tool must, in some cases, be less than about one and one-eighth inches. It has been ascertained that a survey of a deep wellbore should be accurate at least to within one foot per one thousand foot of depth. No survey instrument has heretofore been capable of measuring the location of a relatively small diameter or deep borehole with such accuracy.

The most inexpensive and expedient instrument heretofore used to survey wellbores have used photographic recording systems. This type system photographically records the inclination, utilizing gravity as a reference, and azimuth, using magnetic north as a reference, of the tool housing relative to a pendulum mounted compass member while the tool is positioned at each of a series of known depth stations. The photographs are then manually interpreted and the position of the borehole calculated utilizing geometric or "dead reckoning" methods. Some improvement in accuracy is obtained utilizing either flux gates or gyroscopic devices to replace the magnetic compass means for determining azimuth, and in some instances also the gravity sensing means for determining inclination. However, these gyro instruments still basically measure the azimuth and inclination of the instrument housing at spaced vertical intervals in the wellbore and assume that the borehole is at the same angle as the instrument, which assumption can give rise to significant error in the measured inclination. Further, these instruments continue to rely upon relatively infrequent measurements and dead reckoning type computation to determine the location of the wellbore, which is a relatively imprecise process. A survey tool such as described in U.S. Pat. No. 4,245,498, issued Jan. 20, 1981, utilizes a pair of gyros to provide for relatively continuous measurements while the tool is in motion, but still measures only angle of inclination and azimuth of the tool housing to make dead reckoning calculations, and thus has inherent limitations in accuracy.

Inertial navigation systems have been utilized for a number of years to navigate rockets, aircraft, surface and subsurface naval vessels, and certain land vehicles. These systems typically employ three accelerometers whose outputs are used to compute acceleration along three orthogonal axes, typically referred to as the X, Y and Z axes, which correspond generally to north, east and vertical. These accelerometers are usually mounted on a fully gimballed platform which is maintained in a predetermined rotational orientation, i.e., on the X, Y, Z axes, by gyro-controlled servo systems. The computed acceleration along each axis is then integrated twice to obtain distance travelled along the respective coordinate axis. In lieu of the fully gimballed systems, the accelerometers and rate gyros are sometimes mounted directly on and assume the position of the aircraft, and are said to be "strapped down" to the aircraft. In this type system, the rotational position of the sensitive X, Y, and Z axes of the accelerometers is calculated by measuring the angular rates of rotation and then performing integration to calculate current orientation of the sensitive axes of the accelerometers. The coordinates of the measured accelerations can then be mathematically transformed from the measured to the desired reference coordinates. Some so-called "strap down" systems used for navigation primarily in the horizontal plane have also been gimbal mounted and gyro stabilized to eliminate rotaion about the vertical axis.

Generally speaking, the accuracy of gyroscopic instruments and accelerometers is directly related to cost and size, with more expensive larger sized gyros being more accurate than the cheaper and smaller sized. Cost is particularly a factor in gyros which have reasonably long term, i.e., day-to-day, stability. The accuracy with which gyroscopes, accelerometers and the associated electronic circuits can make the desired measurements of angular rates and linear accelerations is also dramatically affected by temperature variations. One practice is to measure the temperature variations of the instruments in the laboratory or factory assembly procedures and apply a temperature correction factor to the measured rate values. Where practical, temperature control has also been used. In nearly all navigational systems, the inertial packages are relatively large and tend to be spherical or box-like in configuration. Reduction in size and/or cost usually results in a reduction in accuracy.

A fully gimballed aircraft type inertial system has been placed in a test package having a diameter in excess of ten inches and a length in excess of about fifteen feet and a weight in excess of about 1,500 pounds. This system has been used to survey the first several thousand feet of wellbores in the North Sea where very large diameter surface casing exist. However, the tool is so large that it was run on drill string and cannot be used in smaller diameter or deeper wellbores. As a consequence, the gimballed system has a very limited commercial application.

The present invention is concerned with a system and methods of operating the system for surveying, with accuracies better than one foot per thousand feet of depth, very deep boreholes having the attendant small diameters, high temperatures and high pressures with very high accuracy on a commercial basis. The system in accordance with the present invention contemplates commercial applications where a number of survey crews would provide day-to-day services at a large number of wellsites. As a result, a number of surface units and a greater number of downhole probes which are all compatible are contemplated. The system is designed to be operable by technician grade personnel in the typical adverse oil field environment, both on and offshore with a high degree of reliability and accuracy. The system is highly automated to perform current calibration procedures, prior to, during and after a survey run to achieve great accuracy with minimum cost components. For any particular survey job, one generally randomly selected surface unit and normally two randomly selected downhole probes are present on the wellsite, one as a standby. Each surface unit includes a computer with keyboard input, recorders, and a display. Each downhole probe includes an inertial measurement cluster with unique factory calibration and compensation values. The surface unit and a probe are used in conjunction with any suitable available standard electric wireline unit.

The system in accordance with the present invention utilizes a downhole probe comprising an elongated pressure housing having a small diameter, less than about four inches, so that it can be lowered on a wireline into the small diameter casing used in deep wells. Within the pressure vessel is a very thin vacuum sleeve to substantially thermally isolate the interior of the sleeve from high temperature around the pressure housing. Three linear type accelerometers and at least two gyros to provide three sensitive axes are fixedly mounted at points spaced along the axis of an elongated, rigid, thermally conductive support member to form an instrument cluster. The accelerometers are disposed to measure specific force of the cluster along each of three orthogonal axes, and the gyros are normally oriented to measure rate of rotation about the same three orthogonal axes. The axes are disposed so that one is aligned with the longitudinal axis of the housing, herein referred to as the Z axis, and the other two, herein referred to as the X and Y axes, are disposed at ninety degrees within a plane normal to the longitudinal axis of the housing. The instrument cluster is mounted for rotation about its longitudinal axis within the vacuum sleeve and is decoupled by a gyro controlled servo loop from the severe rotation of the housing caused by the unwinding of a wireline from a drum. This decoupling eliminates the very large gyro scale factor error which would otherwise be present. The ability to rotate the instrument cluster also permits very important test and calibration procedures prior to, during, and after a survey run as will presently be described.

The temperature within the sleeve is controlled within closely prescribed limits so that the gyros, accelerometers and electronics associated with measurements are operated over a very narrow temperature range, preferably less than one degree Fahrenheit, and, in addition, the temperature of each unit is measured and conventional temperature compensation calculations made in order to obtain the desired accuracy. In accordance with an important aspect of the invention, the substantial thermal energy dissipated within the vacuum sleeve during a survey run is absorbed by an isothermal phase change material which is thermally coupled to these components in such a manner that the temperature and temperature gradients of the components remain substantially constant during the entire survey run, which may last five or six hours for deep wells.

More specifically, the instrument cluster is preferably mounted on a member formed of a single billet of metal to form a thermally conductive, small diameter, yet very stiff structure which permits the measurement instruments to be spaced longitudinally in the cluster in order to minimize the diameter to approximately the largest diameter of any single instrument. Certain of the electronic circuits may be mounted in close proximity to the respective measurement instruments. The ends of the cluster mounting member are thermally coupled to canisters of isothermal phase change material by thermal energy flow paths designed to maintain temperatures within a very narrow range as the phase change material changes from solid to liquid in the absorption of the heat. Means are provided for circulating fluid to cool the isothermal phase change material to a point below the solidification temperature prior to a survey run.

In accordance with another important aspect of the invention, the isothermal phase change material may have a solidification temperature, in one preferred embodiment 116° F., which is above the normal ambient temperature in which the system would be utilized. This permits the use of ambient air, sometimes heated, and eliminates the need for a portable cooling system to pre-cool the material. Also, the probes are designed so that a clean fluid, such as air, is circulated through the confines of both the pressure vessel and the vacuum sleeve in such a manner as not to require disassembly of the probe, but merely the removal of end caps.

In accordance with yet another aspect of the invention, the analog signals which are produced by the instruments as representations of the inertial angular rates and linear accelerations are converted to digital data by means of special zero offset analog-to-digital converters so that very small readings in each direction from zero can be accurately measured. These digital signals are then processed and transmitted serially over a conductor of a conventional wireline to the surface unit where a surface computer continuously computes and records the current position of the instrument. Command input capability may also be provided from the surface to the probe over the same line using a multiplexing capability. Provision is also made to display the position of the probe in real time and to record both the raw data and the computed data as it received.

The present invention also contemplates novel equipment and procedures which help achieve the required accuracy while using smaller and/or less expensive gyros and accelerometers on a long term, day-to-day basis. The system is highly automated to minimize possible operator error during the rig up, calibration, down hole round trip, and recalibration periods. Each probe is accompanied by original or factory calibration data including the relative orientations of the axes of the accelerometers and gyros, the temperature compensation matrices for each specific inertial instruments, and acceptable diagnostic limits for each instrument, etc., on some machine readable storage media such as a programmable read only memory (PROM) within the probe or magnetic tape cassette which physically accompanies each probe. The calibration and error factors critical to the survey may vary over relatively wide ranges from day-to-day and are then calibrated before and during the survey run by certain procedures and calibrations in accordance with the present invention. More specifically, the probe is positioned on a very quiet support with the longitudinal axis disposed approximately horizontally and aligned with true north. The inertial instrument cluster is then successively rotated to four positions spaced ninety degrees apart, with a two to five minute sampling period at each position. Although the entire probe may be rotated, it is preferred that the instrument cluster be rotated within the housing and the four positions automatically determined by using the accelerometer readings to null the X and Y axes either vertically or horizontally at each position. The outputs from all instruments are stored for some predetermined statistical sampling period. Then the computer calculates mass unbalance and restraint of the X axis and Y axis gyro, the bias and scale factors of the X axis and Y axis accelerometers, and the scale factor and bias of the Z axis gyro.

In accordance with another aspect of the invention, the probe may be positioned with the positive Z axis, i.e., the top of the probe, first vertically upwardly and then vertically downwardly while reading outputs from the Z axis accelerometer. The vertical positions may be determined by nulling both the X axis and Y axis accelerometers. From these readings, both the bias and scale factors may be calculated for the Z axis accelerometer. These calibrations are compared to normal range of readings to detect any malfunctions or unacceptable performance tolerances which would require that the backup probe be substituted, and then are used in the calibration for the current survey run.

In accordance with another aspect of the invention, the probe is held stationary, preferably in the horizontal position, while data is read as if a survey were being made for several minutes. Survey calculations, including velocity reset calculations, as hereafter described in greater detail, are then made to detect any zero offset errors in the system and to thereby predict the accuracy of a subsequent survey. Based upon this prediction, a decision can then be made whether this particular probe is satisfactory for the survey or not.

The probe is then positioned vertically at a measured reference point in the top of the wellbore, preferably in the drilling fluid, where a high state of stillness can be achieved, and the cluster successively rotated to two positions one hundred eighty degrees apart, and all measured values sampled for some predetermined period at each position. From this, an accurate location of true north and the horizontal plane, and thus the X, Y and Z measurement axes, can be obtained, as well as the restraint for the X axis and Y axis gyro, and the restraint and mass unbalance for the Z axis gyro.

An additional important procedure is to stop the motion of the probe at predetermined intervals of time during the survey run, typically after 100 seconds of travel (descent or ascent), for a short period of time, typically 20 seconds, and to continue to receive all measured values from the instrument cluster. Any indicated velocity is then a known error and appropriate adjustments in the various calibration factors are made. The same procedures that are used as the probe is lowered to the bottom of the wellbore are repeated as the probe is withdrawn from the wellbore until the reference starting position is reached, where the instrument unbalance, bias and scale factors are again recalculated, and north and horizontal again reestablished. The computer then performs a closure computation. All measurements are subjected to Kalman filtering to achieve optimal least squares calculations.

At some of the stops where the probe is held motionless, the cluster may also be commanded to sequentially rotate to the two positions one hundred eighty degrees apart for about two minutes at each position to accurately reestablish north and horizontal. At high angles of inclination, additional recalibration data is achieved, provided that the angular orientation of the probe is sufficiently stable during the period the probe is nominally motionless.

Additional and more specific novel aspects and features believed characteristic of this invention are set forth in the appended claims. The invention itself, however, as well as other objects and advantages thereof, may best be understood by reference to the following detailed description of illustrative embodiments, when read in conjunction with the accompanying drawings, wherein:

DESCRIPTION OF THE PREFERRED EMBODIMENT

Figures 1A, 1B, 2:
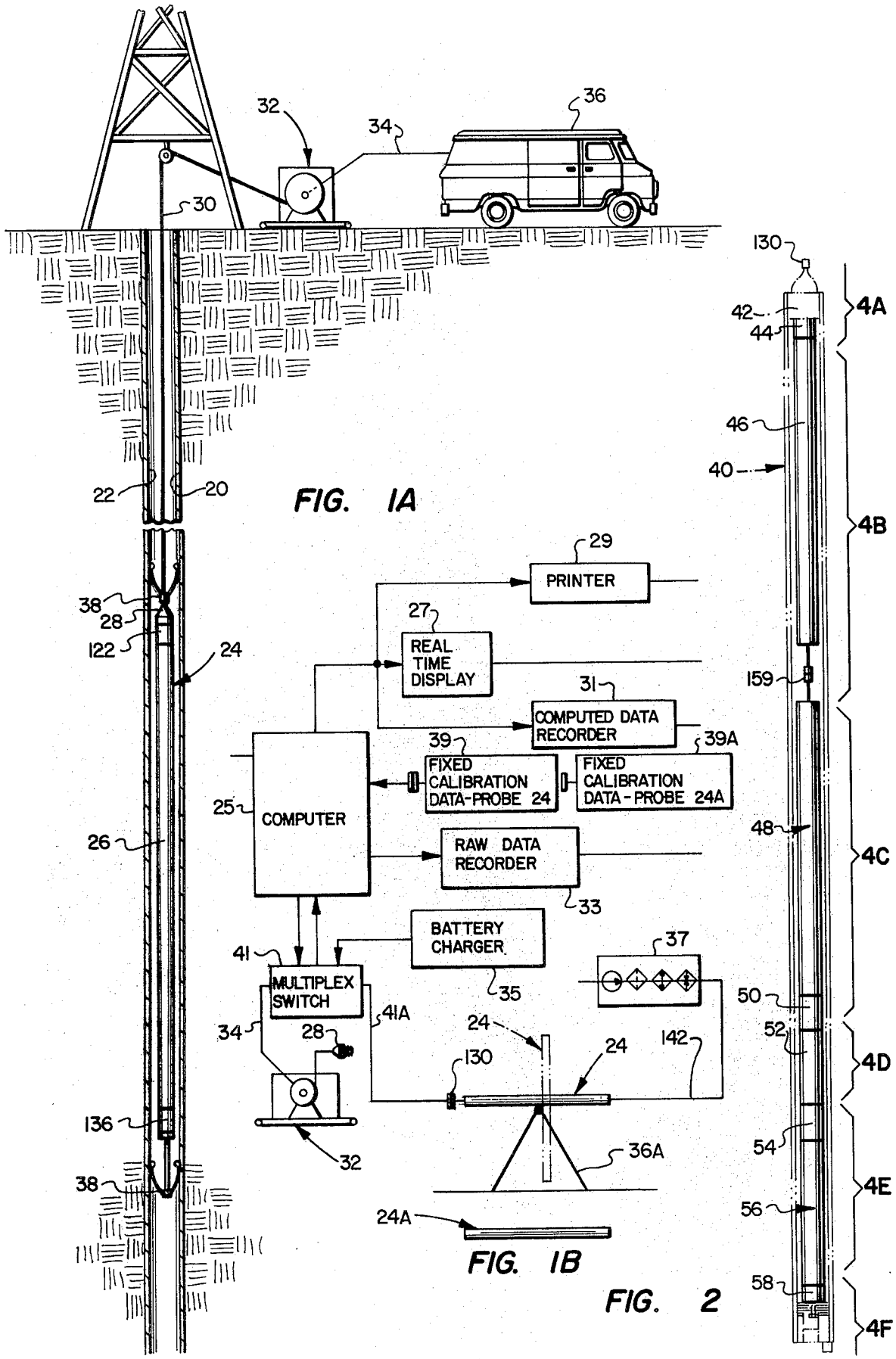
FIG. 1A is a schematic diagram of the portion of the survey system of the present invention which would typically be utilized to perform a well survey.
FIG. 1B is a schematic diagram of the inertial well survey system of the present invention.
FIG. 2 is a schematic diagram showing the general arrangement of the components of the downhole probe of the present invention.

In the description which follows like parts are marked throughout the specification and drawings with the same reference numerals, respectively. The drawings are not necessarily to scale and certain features of the invention may be shown exaggerated in scale or in schematic form in the interest of clarity and conciseness.

Referring to FIG. 1A there is illustrated a somewhat schematic diagram of a wellbore 20 which is provided with a casing 22. The probe of the survey instrument of the present invention is generally designated by the numeral 24. The probe 24 includes an elongated cylindrical outer housing 26 which is characterized as a tubular pressure vessel closed at both ends and provided at its upper end with a plug member 28 similar to a conventional wireline cable socket and adapted for connecting the probe to a wireline cable 30. The wireline cable 30 may be of generally conventional construction such as a multistrand flexible steel cable having a core of plural flexible electrical conductors or a single conductor. The wireline cable 30 is connected to a wireline hoisting unit 32 having a rotatable drum for reeling in and paying out the wireline cable. The unit 32 may be a conventional hoisting unit of the type used in wireline logging and well survey applications. Signals conducted from the probe 24 through the aforementioned conductors in the wireline cable 30 are transferred through a slip ring assembly or the like on the hoisting unit 32 to conductor means 34 leading to components comprising part of the survey system and which may be disposed in a motorized van 36. As shown in FIG. 1 the housing 26 is provided with means for stabilizing the probe within the interior of the wellbore and comprising, for example, two spaced apart motion dampening and stabilizer mechanisms 38 including a plurality of spring loaded arms which are biased radially outwardly into engagement with the casing wall. The arrangement of the mechanisms 38 may be similar in some respects to centralizers used in various types of logging and casing inspection tools. However, the particular mechanisms 38 also include means for minimizing instrument accelerations and angular rotational rates and reducing the noise environment during velocity resets and gyro compass resets of the probe as will be described further herein.

The survey probe 24 is part of a unique survey system in accordance with the present invention and shown in the schematic diagram of FIG. 1B. Referring to FIG. 1B, the probe 24 is adapted to be operated in conjunction with a plurality of discrete components including a computer 25, a real time display module 27, a printer 29, a computed data recorder 31, a raw data recorder 33, a battery charger 35 and a source of fluid for cooling and conditioning the probe. The source of cooling fluid may be a unit 37 adapted to include a suitable blower, filter means, and heat exchanger means for supplying air to the probe 24 at selected cooling conditioning temperatures.

As will be appreciated upon reading the detailed description which follows the survey system of the invention will normally also require means for storing and utilizing fixed calibration data for each probe 24 in accordance with manufacturing tolerances for that particular unit. In conducting a well survey the system of the present invention would normally include a primary unit such as the probe 24 and a substantially identical back up or spare probe designated by the numeral 24A in FIG. 1B. The fixed calibration data means for the probe 24 could, for example, comprise data recorded on a tape cassette unit, generally designated by the numeral 39 in FIG. 13. Accordingly, the probe 24A would have its own fixed calibration data unit 39A which would be plugged into the computer 25 in place of the fixed calibration data unit 39 when utilizing the probe 24A. The probes 24 and 24A require certain test, calibration, and conditioning procedures prior to conducting a survey. In this respect, it is contemplated that the probes 24 and 24A would be transported to the wellsite and provided with a suitable manipulating fixture 36A which might, for example, be transported by a van 36 together with all of the components illustrated in FIG. 1B excpet the wireline cable unit 32. The manipulating fixture 36A is preferably designed to position the probe with its longitudinal axis horizontal and north-south, and vertically up and vertically down in order to calibrate the inertial system as will presently be described. In this regard, during the calibration and test procedures as well as during battery charging, the probe 24 would be connected to the aforedescribed system through a multiplex switching unit 41 by a calibration cable or the like 41A. The utilization of the system components described and shown schematically in FIG. 1B will be further understood upon reading the detailed description of the probe 24.

The survey probe 24 is exposed to a particularly harsh environment in regard to the temperature of the surroundings and the presence of corrosive and abrasive fluids usually present in a deep well at high pressures. Accordingly, the outer housing 26 is characterized as an elongated cylindrical steel tube closed at both ends. In order to place certain ones of the instrument components in the confines of the housing 26, which may be required to be less than 4.0 inches in diameter, some of the major components of the probe are arranged in a unique manner illustrated generally by the schematic diagram of FIG. 2. Certain ones of the components are also placed within an elongated tubular thermal insulating sleeve in accordance with the present invention, shown schematically in FIG. 2 and generally designated by the numeral 40. The sleeve 40, together with certain components of the probe, is placed within the housing 26 as will be evident from further description which follows herein in conjunction with FIGS. 4A through 4F. The components placed within the sleeve 40 include an insulating plug 42 disposed at the upper end of the sleeve, an isothermal heat absorbing unit 44 disposed below the plug 42 and a battery pack 46 disposed below the heat absorbing unit 44. In accordance with one preferred embodiment of the sleeve 40 there is a gap formed within the sleeve between the battery pack 46 and an upper electronics module 48. Disposed below the electronics module 48 is an upper bearing assembly 50 adapted to rotatably support a rotating cluster assembly, generally designated by the numeral 52. The cluster assembly 52 is also rotatably supported and driven by a lower bearing and drive assembly, generally designated by the numeral 54. The aforementioned components are all disposed above a lower electronics module 56 which itself is disposed above an isothermal heat absorbing unit 58 at the bottom of the sleeve 40. Further details regarding the components shown schematically in FIG. 2 will be described hereinbelow.

The electronic and sensing components of the probe 24 are substantially thermally insulated from the working environment of the probe to maintain the probe at a substantially constant operating temperature. In this regard, the sleeve 40 provides a unique structure for supporting the instrument components in a preferred arrangement and for thermally insulating the components from the operating environment.

Figure 3:
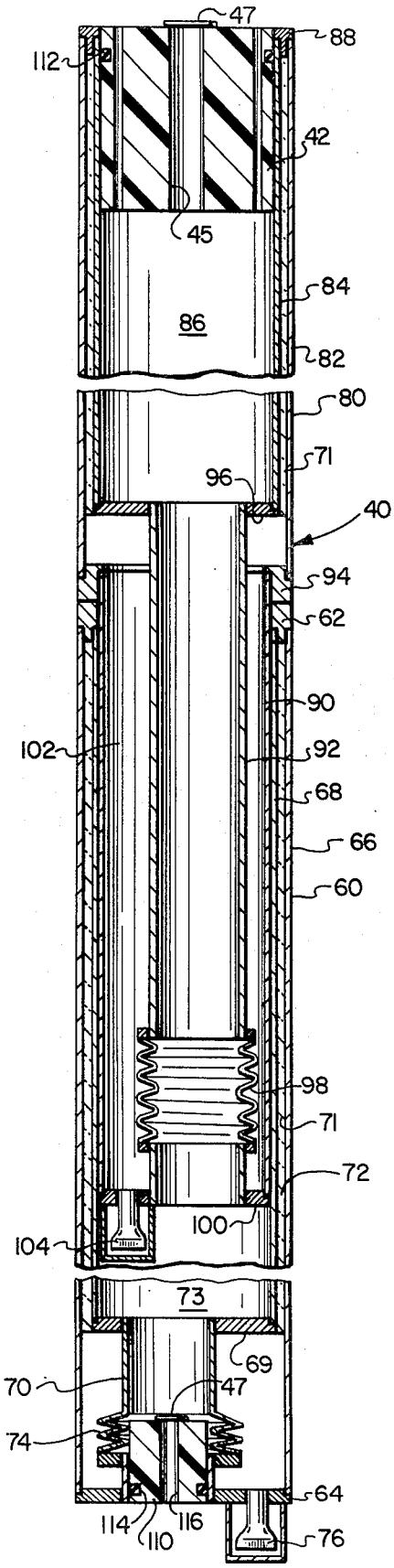
FIG. 3 is a longitudinal elevation, partially sectioned, of the thermal insulating vacuum sleeve for the probe of the present invention.

Referring to FIG. 3, the sleeve 40 comprises an elongated tubular structure having a first section 60 comprising a tubular shell made up of opposed head members 62 and 64, an outer cylindrical wall 66, an inner cylindrical wall 68, an intermediate head member 69, and a tubular conduit 70 and expansion member 74 which define a vacuum chamber generally designated by the numeral 72. The chamber is evacuated to a pressure below 0.001 mm of mercury to reduce conductive and convective heat flow across the chamber. Additionally the portion of chamber 72 between walls 66 and 68 may contain multiple layers of a blanket of a reflective material which is adapted to minimize radiative heat transfer between walls 66 and 68. Said layers of reflective material may be separated from each other and from the walls 66 and 68 by isolators, such as glass cloth, having low thermal conductivity. The materials within vacuum chamber 72 are selected for non-outgassing properties to preserve the vacuum and are generally designated by the numeral 71. The reflective layers and glass cloth isolators within the chamber 72 also provide support to the relatively thin cylindrical walls 66 and 68 and prevent any tendency for these elements to contact each other to provide a thermal path, for example as a result of bucklings or of expansion which might follow the evacuation of chamber 72. Conductive heat flow through the metal periphery of chamber 72 is minimized by making the inner wall 68 as thin as possible and by having the walls extend at least six inches beyond the inner members within interior chamber 73 whose temperature is to be regulated. As the inner wall 68 supports the weight of the components within chamber 73, it may be further supported by the outer member 66 through one or more rings of beads, pins, or dimples, so located that heat transmitted through these elements is minimized and is kept remote from sensitive areas within chamber 73. The conduit portion 70 preferably includes an expansion element 74 such as a flexible metal bellows member or the like. The chamber 72 is evacuated through a suitable short conduit section 76 which is sealed after completion of the evacuation process.

The sleeve 40 includes a second thermal insulating section, generally designated by the numeral 80, including elongated cylindrical outer and inner wall portions 82 and 84, a transverse head member 88 and a portion which is adapted to be telescoped within the first sleeve section 60 and defined by a cylindrical outer wall 90 and an inner wall 92. The walls 82 and 90 are welded or otherwise suitably secured to a collar 94 at their adjacent ends, walls 82 and 84 are welded to the head member 88 and the tubular wall members 84 and 92 are welded to an intermediate head member 96. The opposite end of the wall member 92 is secured to an expansion bellows 98 which interconnects the wall member 92 with an end head member 100. The aforedescribed structure comprising the second section of the sleeve 40 defines a vacuum chamber 102 which may be evacuated through a short conduit section 104 which is then crimped or otherwise hermetically sealed. The portion of chamber 102 between walls 82 and 84 is also filled with the insulating material 71 to enhance the thermal insulating capability and the structural integrity of the sleeve 40. The wall 90 is dimensioned to provide a close sliding fit within the interior of the sleeve section 60 so that substantially all portions of the interior chambers of the sleeve sections may be thermally isolated from the exterior of the sleeve. Thanks to the portion of the second sleeve section 80 which telescopes into the sleeve section 60, a vacuum barrier exists between the interior chambers of the sleeve which house the components of the probe and the exterior of the sleeve along substantially the entire length of the sleeve. An interior chamber 86 of the sleeve section 80 is adapted to contain the upper plug 42, the isothermal heat absorbing unit 44 and batteries 46. As will be described further herein, an electrical cable or harness extends through a passage formed by the tubular wall 92 and is provided with a connector assembly for electrically interconnecting the components of the probe housed within the sleeve sections 60 and 80.

Figure 4A:
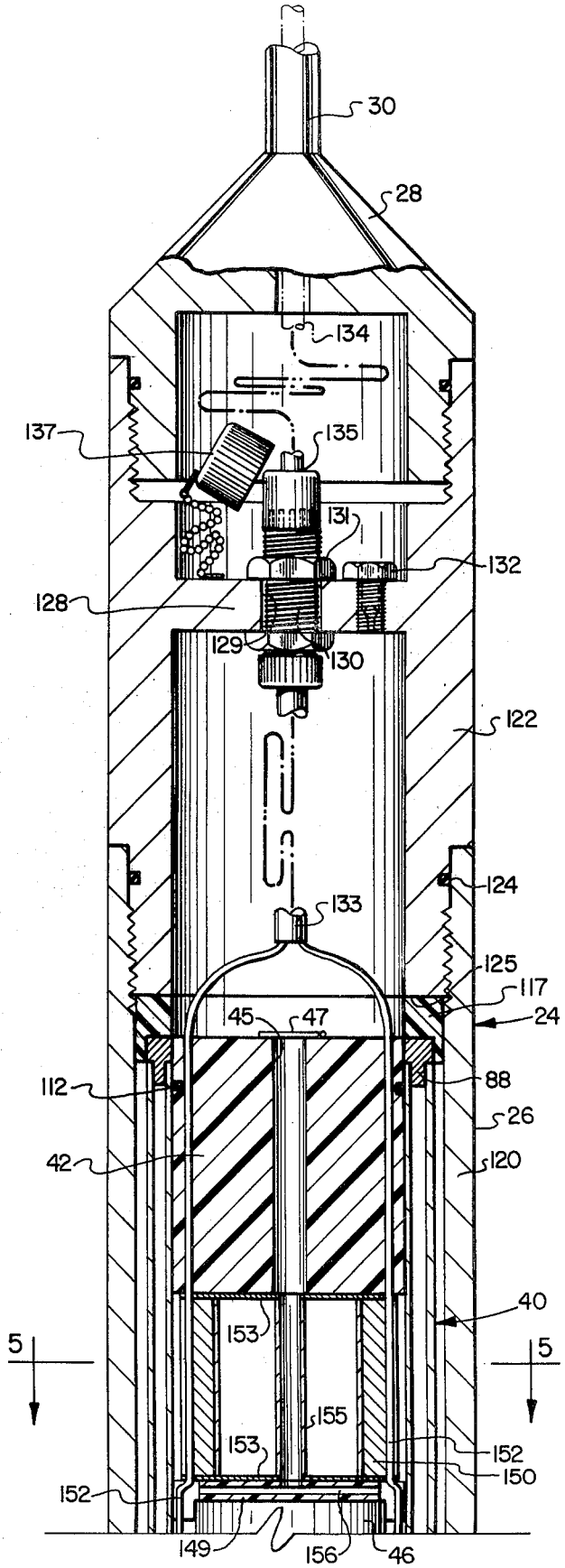
FIGS. 4A through 4F are longitudinal central section views of portions of the probe incorporated within the corresponding numbered brackets indicated in FIG. 2 and including corresponding portions of the probe outer housing.

The conduit portion 70 disposed at the lower end of the sleeve section 60 is also provided with an insulating plug, generally designated by the numeral 110. The plugs 42 and 110 are preferably formed of a thermal insulating material such as silicone sponge, are closely fitted within the respective conduit sections formed by the walls of the upper and lower sleeve portions and are frictionally retained therein by o-rings 112 and 114 associated with the respective plugs. The plug 42 includes a central passage 45 formed therein, the upper end of which is closed by a suitable one-way flapper type valve 47, and the plug 110 is also provided with a central passage 116 and a one-way flapper type valve 47 whereby the interior chambers 73 and 86 are substantially sealed from external contamination. However, the sleeve chambers 73 and 86 are also operable to permit cooling air to be conducted therethrough from the lower end of the sleeve in a manner to be described in further detail herein. With all of the probe components described in conjunction with FIG. 2 assembled within the sleeve 40 the sleeve itself is supported within the outer housing 26 by spaced apart support pads 117 and 119 as shown in FIGS. 4A and 4F, respectively, which may be resilient to absorb expansion or shock. As shown in FIGS. 4B through 4F, circular metal band type retainers 121 are suitably spaced apart and welded to the outer surfaces of the sleeve walls 66 and 82, and are engageable with the inner wall surfaces of the housing 26.

In the description which follows in conjunction with FIGS. 4A through 4F the major components of the probe 24 as illustrated in FIG. 2, including the sleeve 40, are illustrated in their assembled condition within the housing 26. The probe 24 will be described by progressing generally from the upper end portion shown in FIG. 4A to the lower end portion shown in FIG. 4F.

Referring to FIG. 4A, the housing 26 includes a main section including an elongated cylindrical tubular member 120. The upper end of the housing includes a sub 122 which is threadedly coupled to the tubular section 120 utilizing conventional complementary threaded portions and an o-ring seal 124. The sub 122 is also threadedly coupled to the plug 28 by a similar sealed, threaded connection, as illustrated. The sub 122 includes a transverse shoulder portion 125 which is engaged with the resilient support pad 117. The pad 117 is, in turn, engaged with the head member 88 of sleeve 40 for supporting the upper end of the sleeve within the housing. The sub 122 also includes a transverse bulkhead 128 through which projects a suitable multiconductor calibration connector 130 which terminates a multiconductor harness 133. The bulkhead 128 also includes a one-way valve 132 for conducting cooling air from the interior of the sleeve 40 through the bulkhead 128. Upon assembly of the sub 122 to the housing 26, with the sleeve 40 and its components disposed within the tubular section 120, the connector 130 is preferably inserted through a hole 129 in the bulkhead 128 and loosely held while the sub is threadedly secured to the section 120. The connector 130 is then secured to the bulkhead by a locknut or the like 131. A mating connector 135 is attached to the end of a harness 134 which extends through the plug 28 and comprises the core portion of the wireline cable as previously described. Accordingly, the plug 28 may be disconnected from the remaining part of the housing 26 for servicing the probe 24 as will be described further herein. The connector 130 also includes a protective cap member 137 suitably tethered to the sub 122.

Referring briefly to FIG. 4F, the lower end of the housing 26 includes a removable plug section 136 which is threadedly engaged with the tubular section 120 in the same manner as the sub 122. The resilient support pad 119 is disposed against an end wall 137 of the plug section 136 and supports the lower end of the sleeve 40 as illustrated. A cooling air passage 140 extends through the plug section 136 and the support plug 119 and is adapted to be aligned with the passage 116 in the plug 110. A flexible hose 142 is suitably secured to the plug section 136 and is disposed in a cavity 144 formed in the plug section. The cavity 144 is closed by a removable head member 148. The head member 148 may be easily removed during servicing of the probe 24 for disconnecting the probe from the lower dampening mechanism 38 and for conducting cooling air through the probe by connecting the hose 142 to the source of conditioned cooling air 37 by way of a quick disconnect coupler 143.

Figure 5:
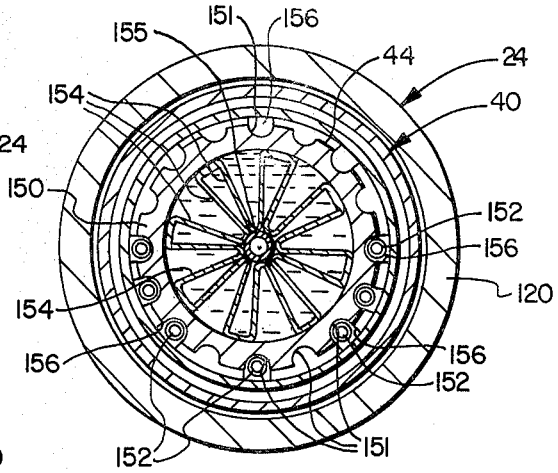
FIG. 5 is a section view taken along the line 5—5 of FIG. 4A.

Referring again to FIG. 4A and to FIG. 5, the components disposed within the sleeve section 80, in addition to the closure plug 42, include the isothermal heat absorbing unit 44, which is of a particularly unique configuration and is similar in its structural features to additional heat absorbing units to be described herein. The heat absorbing unit 44 is characterized by a housing formed in part by a cylindrical metal tube 150 of a heat conductive material such as copper or aluminum. The tube 150 includes circumferentially spaced apart longitudinal grooves 151 formed on its outer surface and through some of which electrical conductors 152 are trained and then are grouped in the harness 133 after passing through suitable passages formed in the plug 42. The tube 150 is closed at its opposite ends by head members 153 which are suitably secured, such as by welding or brazing to the the tube and which define an internal chamber which is filled with a unique heat absorbing material adapted to undergo a phase change at a temperature which will provide a preferred operating temperature or temperature range of the probe 24. The heat absorbing material will be described in detail in conjunction with another heat absorbing unit described herein.

The housing of the heat absorbing unit 44 is also provided with heat transfer surfaces formed by a continuous strip of thin metallic material such as copper which is folded and soldered to the inner wall of the tube 150 to provide plural radially inwardly projecting fins 154. The heat absorbing unit 44 also includes a central tube member 155 which provides a cooling air flow passage through the center of the heat absorbing unit and in communication with the passage 47. The interior chamber of the heat absorbing unit occupied by the fins 154 is filled with material which is adapted to undergo a phase change from a solid to a substantially liquid phase and which enjoys a characteristic wherein its latent heat of fusion is substantial. The arrangement of the fins 154 minimizes the heat flow path to the phase change material which has not undergone a phase change as the heat absorption process occurs. Accordingly, the heat absorbing unit 44 has a particularly high heat absorption capacity for its bulk at the desired operating temperature of the probe 24. Heat absorbing material may be introduced into the interior of the unit 44 through suitable fill plug openings, not shown, in the tube 150.

Figure 4B:
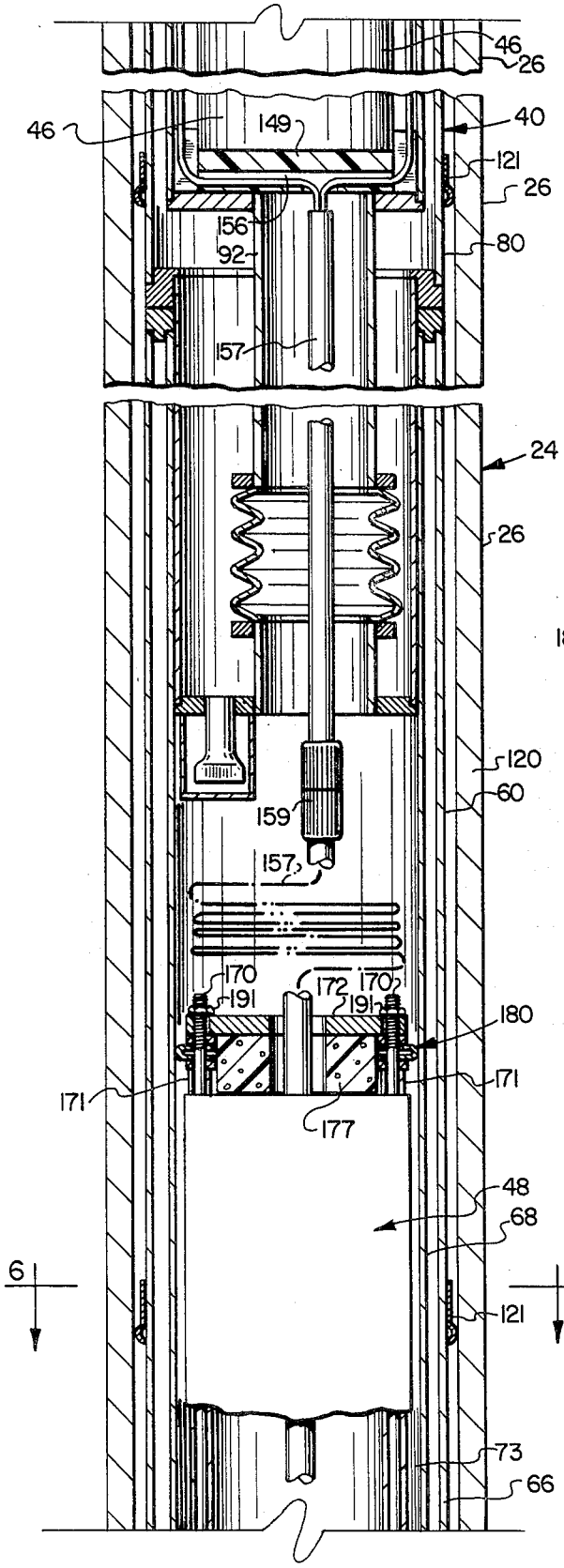

Referring to FIGS. 4A and 4B, the battery pack 46, which is also disposed in the sleeve section 80, is suitably mounted between the heat absorbing unit 44 and the end wall or head member 96. The battery pack 46 preferably includes a plurality of generally cylindrical batteries which are disposed end-to-end within the chamber 86 in the sleeve section 80 and are supported at opposite ends by shock absorbing support blocks 149 which are each formed with suitable passages 156 for conducting cooling air through the chamber 86 and to permit routing of electrical conductors 152. The conductors 152, which extend through the chamber 86, and suitable power cables from the batteries are grouped in a harness 157 which is connected to one portion of a separable plug and socket type connector 159. A continuing portion of the harness 157 extends into the upper end of the lower sleeve section 60 and is of sufficient length to permit the separable parts of connector 159 to be assembled to each other when the sleeve sections are axially separated.

Figure 6:
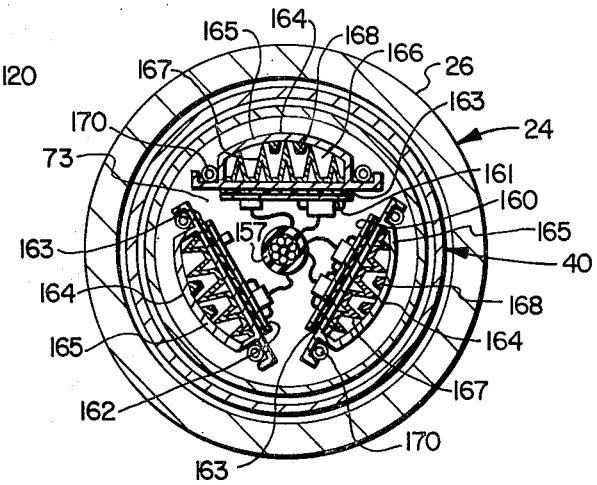
FIG. 6 is a section view taken along the line 6—6 of FIG. 4B.
Figure 7:
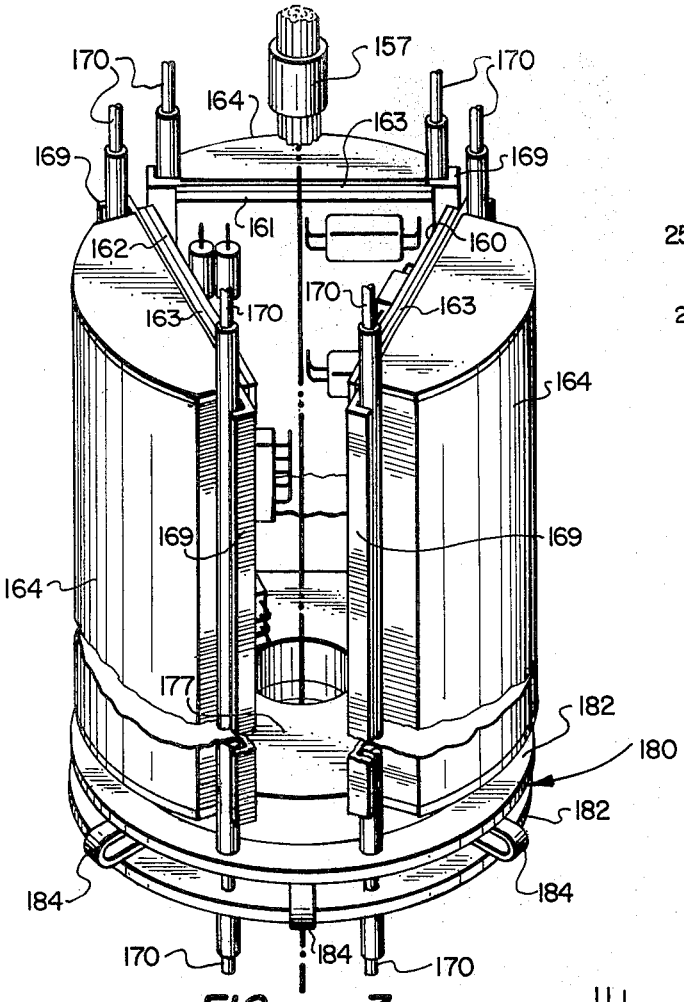
FIG. 7 is a perspective view of a portion of the upper electronics module.

Referring now to FIGS. 4B, 4C, 6 and 7, the upper electronics module 48 is generally characterized by an array of circuit boards which include an analog-to-digital converter, a timing logic circuit, power supply units and conditioning circuitry, and a transmitter circuit. These circuits are suitably mounted on circuit board members 160, 161 and 162, as illustrated in FIGS. 6 and 7, having a triangular cross sectional arrangement and with their respective components facing inwardly toward the longitudinal central axis of the probe 24. The harness 157 extends down through the central portion of the chamber 73 and respective conductors, now shown, may extend between the harness and the circuit boards as required. The upper electronics module 48 also includes isothermal heat absorbing units, generally designated by the numerals 164 in FIGS. 6 and 7. The heat absorbing units 164 extend over substantially the entire length of the circuit boards 160, 161, and 162, respectively, and are secured to the back or outwardly facing sides of the boards by a layer of heat conductive but electrically insulative material such as an epoxy composition 163. The heat absorbing units 164 each comprise a somewhat D-shaped hollow housing 165 closed at both ends and having a sealed interior chamber 166 provided with suitable thin walled fins 167. The fins 167 are preferably formed of a continuous strip of copper or aluminum sheet and the integral base portions of the fins are soldered to the inner surface of the flat side of the housing 164. The housing 164 may be an extruded copper or aluminum section.

The chambers 166 are filled with a quantity of the aforementioned heat absorbing material to provide the desired heat absorbing capacity of the units. The heat absorbing units 164 may also include closed cell resilient foam type volume change compensator elements 168 or diaphragms disposed in the chambers 166 to minimize the formation of voids during a phase change of the material disposed in the chambers. The heat absorbing units 44 may include similar volume compensators. The housings 165 include laterally projecting longitudinal edge portions forming opposed flanges 169 which partially journal elongated tie rods 170. The tie rods 170 extend through tubular sleeves 171 and 173, through the entire length of the electronics module 48 from a supporting plate 172 at the upper end of the electronics module, FIG. 4B, downward beyond the electronics module at its lower end to a flange 174, FIG. 4C, which forms part of a cylindrical stator 175 of an electrical slip ring assembly, generally designated by the numeral 176. The slip ring assembly 176 is of a conventional type commercially available and having a rotor member 178 rotatably supported within and by the stator 175 on precision rolling element bearings. The slip ring assembly 176 is adapted to rotatably support one end of the cluster assembly 52 and provide for conducting electrical signals between components in the upper electronics module 48 and the cluster assembly and the electrical components of the probe 24 mounted below the cluster assembly.

Certain ones of the major components of the probe 24, including the upper electronics mode 48 and the upper bearing assembly 50 comprising, in part, the slip ring assembly 176, are supported within the sleeve section 60 by unique support structure which will now be described in conjunction with FIGS. 4B and 4C. The support structure is characterized by a plurality of spaced apart, support units, each generally designated by the numeral 180. As shown by way of example in FIG. 4C and FIG. 7, each support unit 180 comprises a pair of circular ring members 182 between which are disposed a plurality of circumferentially spaced and radially projecting resilient metal bands 184. The bands 184 have a somewhat U shaped configuration and are secured along opposed leg portions thereof to each of the rings 182, respectively. In response to moving the rings 182 axially toward each other, the outward distal ends of the bands 184 expand in an outward radial direction to grip the inner surface of the wall 68 of the sleeve. The radial expansion clamp type support units 180 are spaced apart by the tubular sleeve members 171 and 173 previously described. The tie rods 170 are threaded at their ends adjacent the support plate 172 and are provided with lock nuts 191 for causing the support plate to move the sleeves 171 and 173 axially to force radial outward expansion of the bands 184 of each support unit to frictionally grip the inner surface of the sleeve wall 68. The circuit boards 160, 161 and 162 are preferably also disposed between respective upper and lower resilient ring shaped support pads 177 which are clamped against the boards by the action of tightening the tie rod nuts 191. The lower bearing and drive assembly 54 and lower electronics module 56 are secured within the sleeve section 60 in a similar manner as will be described herein.

Figure 4C:
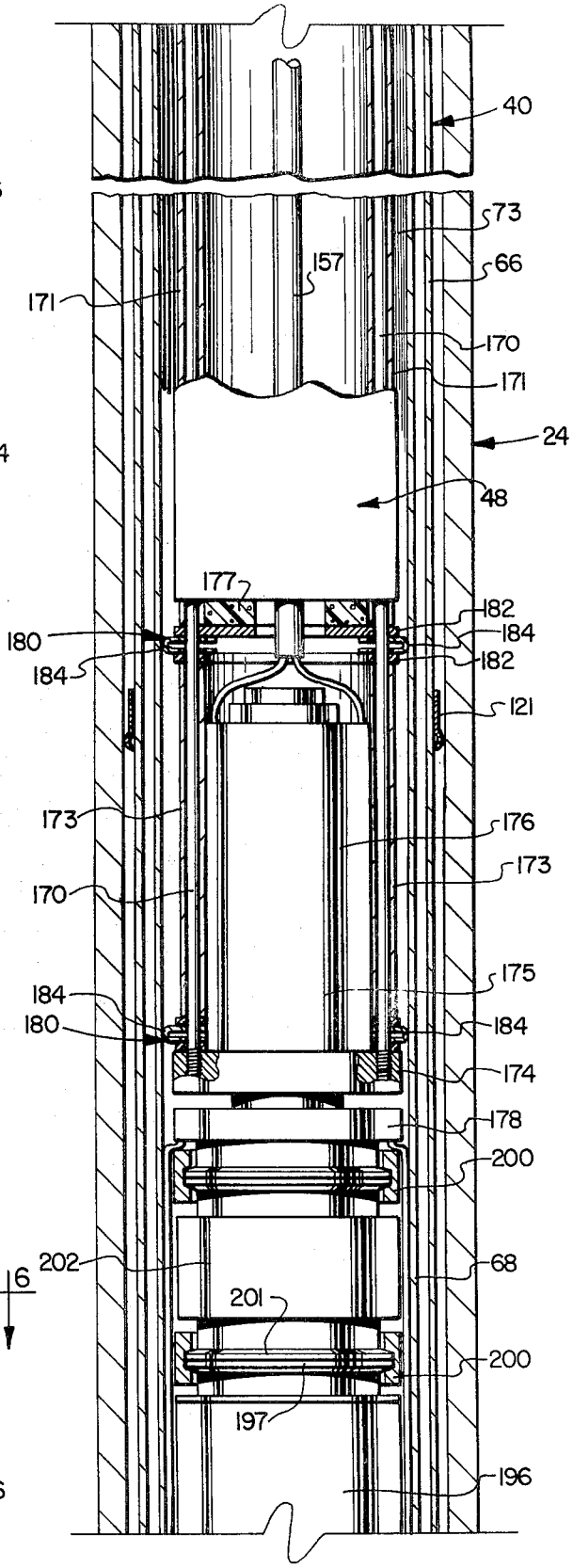
Figure 4D:
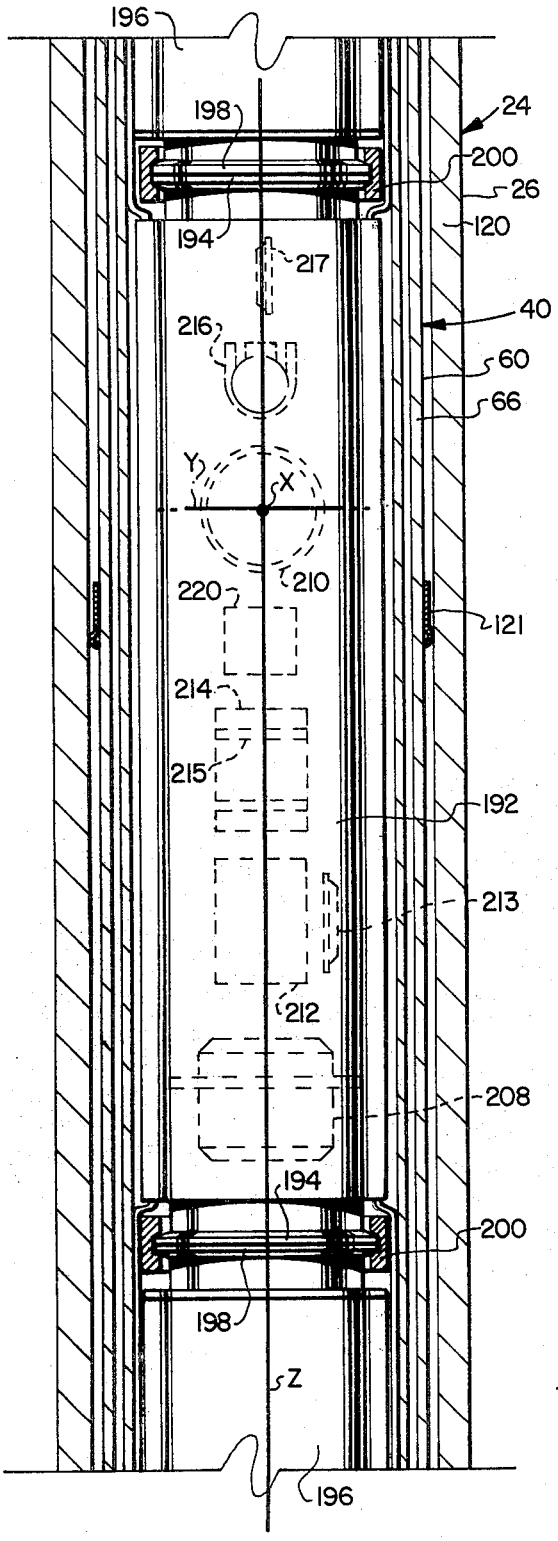
Figure 4E:
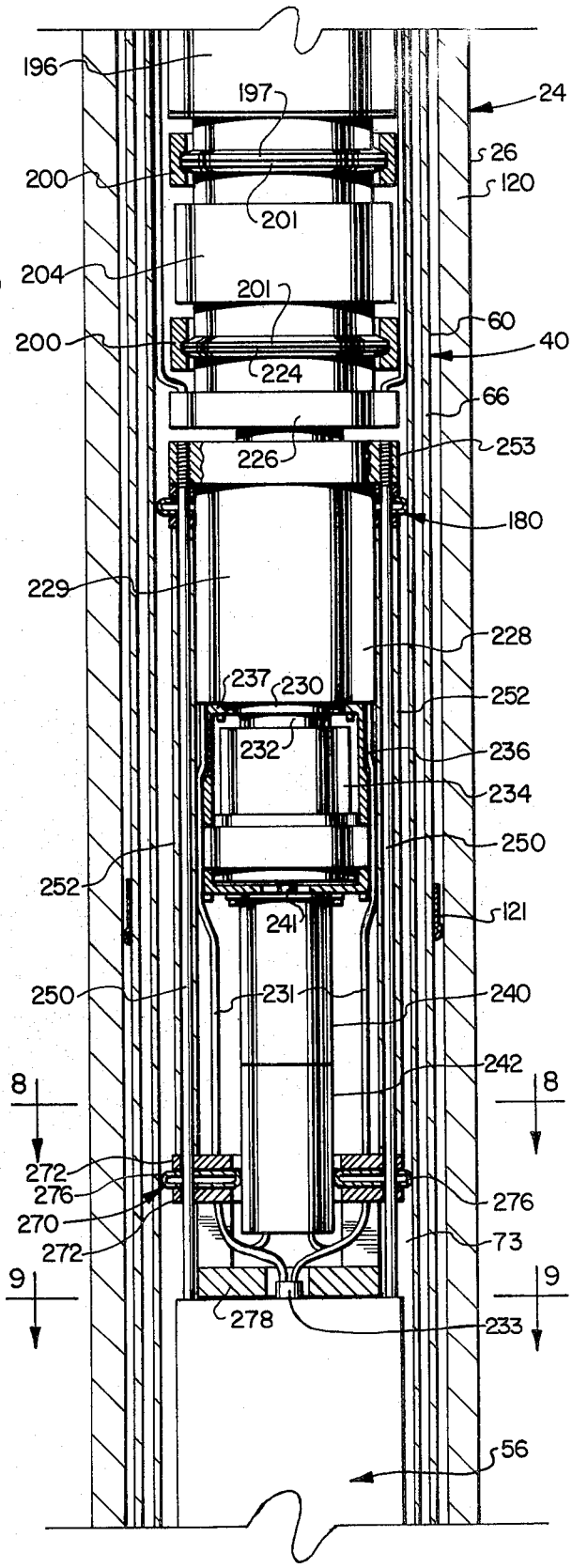
Figure 4F:
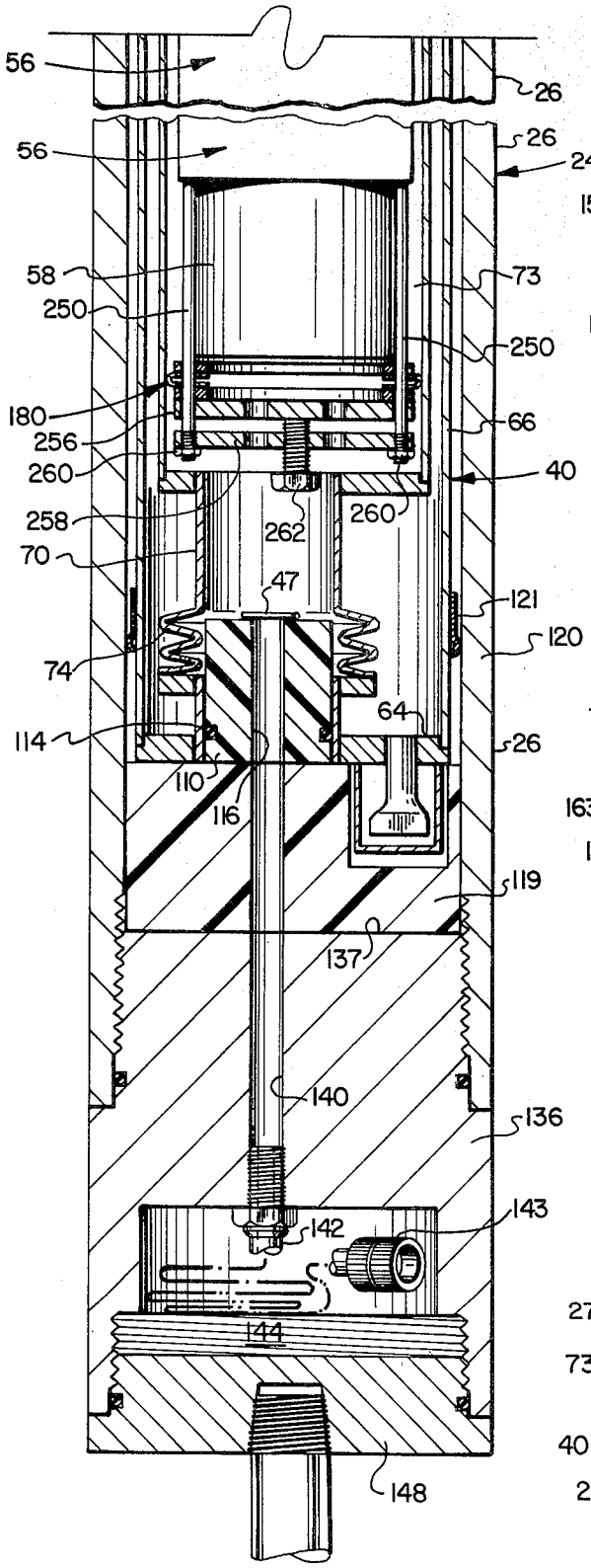

Referring now to FIGS. 4C, 4D and 4E, in particular, the cluster assembly 52 includes an elongated generally cylindrical, rigid support member 192, FIG. 4D, rotatably supported by the upper and lower bearing and slip ring assemblies generally designated by the numerals 176 and 228, respectively. The bearing and slip ring assemblies 176 and 228 provide bearing means for journalling the support member 192 and also for conducting electrical signals between the electronics modules mounted in the housing and instruments mounted on the cluster by way of suitable conductors leading from the support member 192 to the rotors of the slip ring assemblies which are connected to the support member. The housing 192 includes opposed radially extending flanges 194 at its opposite longitudinal ends. The housing 192 is secured to opposed rotating isothermal heat absorbing units 196 which are also provided with opposed flanges 197 and 198. The heat absorbing units 196 are similar in some respects to the heat absorbing unit 44 and are clamped to the housing 192 in conductive heat flow communication with the housing by so-called V-band type or opposed split ring type clamp generally designated by the numeral 200. The clamps 200 may, for example, comprise two half circular ring members which are secured together by threaded fasteners or the like to clamp the flanges 198 and 194 securely together and concentric with each other. The clamps 200 may, for example, be substantially similar to a V-band type clamp commercially available from Aeroquip Corporation, Lawrance, Kans. As shown in FIGS. 4C and 4E, the opposed ends of the respective heat absorbing units 196 are similarly secured by clamps devices 200 to flanges 201 formed on respective flexural couplings 202 and 204. The coupling 202 is secured to the rotor 178 of the upper slip ring assembly by a clamp 200 and is adapted to accommodate any skew misalignment of the housing 192 relative to its associated supporting structure. The coupling 204 is adapted to accommodate any axial or skew misalignment of the housing 192 with respect to drive mechanism disposed below the housing and which will be described further herein. The couplings 202 and 204 are of a type which eliminate any stresses on the housing 192 due to mechanical and thermal induced misalignment and accommodate axial play and skew misalignment, but do not permit any rotational or radial play about the axis of rotation of the housing 192, which axis is designated as the Z axis in FIG. 4D.

The housing 192 is preferably fabricated of a material having substantial stiffness such as, for example, a beryllium alloy or the like. The housing 192 is provided with suitable chambers for supporting instruments including a first two-degree-of-freedom gyro, generally designated by the numeral 208, and a second two-degree-of-freedom gyro, generally designated by the numeral 210. The gyro 208 is arranged to have its spin axis coincident with the Z axis and the gyro 210 is arranged to have its spin axis perpendicular to the Z axis and coincident with an axis perpendicular to the plane of the drawing figure and designated as the X axis in FIG. 4D. The housing 192 is also adapted to support an X axis accelerometer unit 212, a Y axis accelerometer 214, and a Z axis accelerometer 216. The accelerometers are each provided with an electronics servo loop assembly which are mounted on the housing 192 and which are respectively designated by the numerals 213, 215, and 217. The housing 192 is further adapted to support a pick off excitation transformer 220. The function of the gyros and accelerometers described briefly herein and indicated schematically in FIG. 4D will be further described in conjunction with the operating characteristics of the probe 24.

Referring further to FIG. 4E, the coupling 204 is provided with a second end flange 201 of the same configuration as the flanges on the coupling 202 and the heat absorbing units 196 and adapted to be clamped to a flange 224 formed on a rotor 226 of the slip ring assembly 228. Slip ring assembly 228 is substantially similar to the slip ring assembly 176 and forms lower bearing support means for the cluster assembly 52. The rotor of the slip ring assembly 228 extends through a stator member 229 and includes an end portion 230 which is drivenly coupled to the output shaft 232 of a power transmission unit comprising a harmonic drive unit, generally designated by the numeral 234. The harmonic drive unit 234 is of a type commercially available and one unit which is preferred is made by Harmonic Drive Division, Emhart Corporation, Wakefield, Mass. as their Model 1C. The harmonic drive unit 234 includes a housing member which is secured to a support housing 236. The housing 236 includes a flange 237 adapted to secure the housing 236 to the slip ring stator 229. A speed reduction gear unit 240 is mounted on the housing 236 and is suitably connected to an input shaft 241 for the harmonic drive unit 234. The reduction gear unit 240 is also coupled to torque producing means comprising a DC electric motor 242 whereby the housing 192 of the cluster assembly 52 may be rotatably positioned by the motor through the gear reduction unit 240, the harmonic drive unit 234, the rotor 226, the coupling 204, and the heat absorbing unit 196 coupled to the lower end of the cluster housing.

Figure 9:
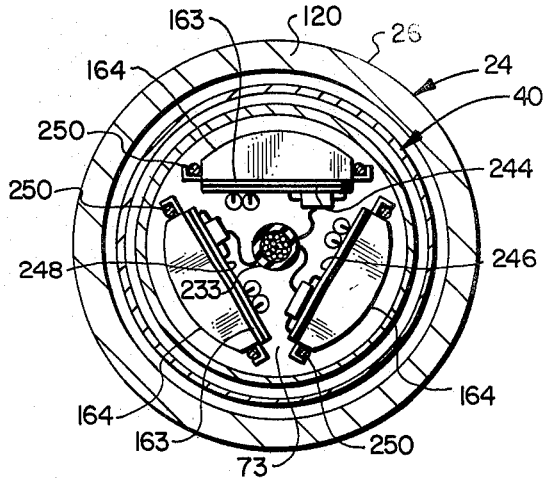
FIG. 9 is a section view taken along the line 9—9 of FIG. 4E.

As shown in FIGS. 4E, 4F and FIG. 9, the lower electronics module 56 also comprises a triangular array of circuit boards 244, 246 and 248 which are arranged to face each other and which are each also provided with elongated isothermal heat absorbing units 164 mounted on the respective boards in the same manner as the units 164 are mounted on the boards 160, 161 and 162 of the upper electronics module. The electronics module 56 is also arranged to have electrical conductors 231 extending between the slip ring assembly 228 and a centrally disposed wiring harness 233 extending down through the center of chamber 73 whereby conductors leading to the respective portions of the module 56 may be conveniently routed.

A heat absorbing unit 58, substantially similar to the unit 44, is disposed below the lower electronics module 56 and is suitably secured in assembly with the lower electronics module and the lower drive assembly by elongated tie rods 250 similar to the tie rods 170. The tie rods 250 are threadedly connected to a flange 253 of the stator 229 and, as shown in FIG. 4F, extend through suitable passages in an end plate 256 below the lower end of the electronics module 56 and are secured in assembly with a second end plate 258 by nuts 260. The end plate 256 is operable to bear against one of the support units 180 interposed between the end plate and the isothermal heat absorbing unit 58. A bolt 262 is threadedly engaged with the plate 258 and bears against the plate 256.

Figure 8:
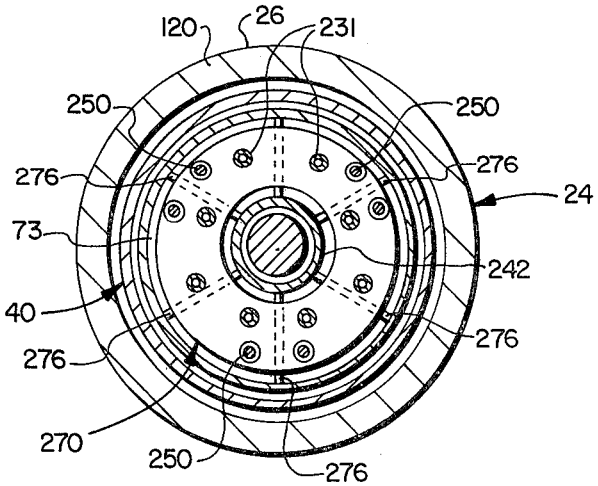
FIG. 8 is a section view taken along the line 8—8 of FIG. 4E.

The lower bearing and drive assembly 54, comprising the components described which are disposed between the lower heat absorbing unit 196 and the lower electronics module 56, together with the lower electronics module, are secured within the chamber 73 by a plurality of spaced apart support units 180 in the same manner that the upper drive assembly and upper electronics module are supported. The sleeves 252 are disposed around the tie rods 250 between a support unit 180 which is engaged with the stator flange 253, and a support unit 270 similar to the support units 180 and including spaced apart ringlike plates 272 between which are disposed a plurality of circumferentially spaced and radially extending resilient metal band members 276. Referring to FIG. 8 also, the band members 276 are similar to the bands 184 except that the bands 184 form a closed loop and both the radially inward and outward ends of the bands are expandable in opposite directions to engage the outer sidewall of the motor 242 are well as the inner surface of the sleeve wall 68. An intermediate support plate 278, contiguous with one of the rings 272, is interposed between the top of the module 56 and the support unit 270.

The process of placing the components of the probe 24 in the sleeve 40 and the sleeve in the housing 26 will now be generally described. The disassembly process is believed to be apparent from the following description. The upper electronics module 48, upper drive assembly 50, cluster assembly 52, lower drive assembly 54, and lower electronics module 56 are preassembled to each other to form an elongated assembly with the respective sets of tie rods loosely secured so that the bands of the supporting units 180 and 270 are not radially extended to form a force fit within the sleeve section 60. The assembly described above is inserted in the sleeve 60 with the upper sleeve section 80 removed therefrom until the plate 258, FIG. 4F, is closely adjacent but spaced from the end wall 69 of the sleeve. With the plug 110 removed, the bolt 262 is tightened against the plate 256 to force the bands of the support units 180 and 270 to expand radially outwardly into gripping engagement with the inner surface of the sleeve wall 68. The plug 110 may then be inserted into the passage formed by the conduit 70 and the bellows 74. The upper bearing assembly 50 and upper electronics module 48 are then also secured in the sleeve section 60 by tightening the nuts 191 on the tie rods 170. This operation will force the bands 184 of the support units 180 associated with the upper bearing assembly and upper electronics module radially outwardly also into gripping engagement with the sleeve wall 68. The components disposed in the sleeve section 60 are thereby substantially physically isolated from the sleeve wall by a somewhat resilient, shock absorbing mounting structure which provides for longitudinal insertion of these components within the elongated tubular sleeve so that the components are physically secured within the sleeve and are substantially mechanically and thermally isolated from the sleeve structure.

Referring to FIGS. 4A and 4B, the battery pack 46 and the upper portion of the wiring harness 157 are then lowered into the interior of the upper sleeve section 80 so that the harness extends through the passage formed by the sleeve wall 92 and the associated part of connector 159 extends beyond the end wall 100. The batteries of the battery pack 46 are suitably journalled by the support blocks 149 so that an annular passage is formed between the wall 84 and the batteries and which is in communication with the passages 156 in the respective blocks. The heat absorbing unit 44 is also then placed in the sleeve section 80 together with the plug 42 to close off the upper end of the sleeve with the wiring harness 133 and the connector 130 extending loosely from the sleeve upper end. The mating portions of the connector 159 are then assembled and the excess length of the lower part of harness 157 is suitably folded and stored in the upper portion of chamber 73 as the upper sleeve 80 is telescoped into the bore formed by the wall 68 of the lower sleeve section 60.

The probe components are now completely assembled in the thermal insulating sleeve 40 and the sleeve may be lowered into the tubular section 120 of housing 26 with the plug section 136 secured thereto but with the sub 122 removed. The sleeve 40 is inserted in the housing 26 with the passage 116 aligned with the passage 140 in the plug section 136. The housing sub 122 is then threadedly engaged with the section 120 with the support ring 117 interposed between the shoulder 125 and the upper end face of the sleeve. The connector 130 is pushed into the passage 129 in the sub 122 before it is threaded into the section 120 and is loosely held from the opposite side while the housing sections are secured to each other. In this way, the connector 130 may be prevented from substantially twisting the wiring harness 133 during rotation of the sub 122 with respect to the section 120. The connector 130 is then secured by nut 131. The wiring harness 134 is of sufficient length so that the connector part 135 may be coupled to the connector 130 and the plug 28 rotated to threadedly couple it to the sub 122 without damaging the harness itself.

The probe is now ready for conditioning for a survey and this procedure will be described in further detail herein in conjunction with the description of the overall circuitry and operation of the probe. Servicing of the unit between surveys normally comprises recharging the batteries, cooling the heat absorbing units to condition the phase change material for absorbing heat during the survey, raising the internal temperature to a stabilized operating level and calibration of the probe prior to deployment. For example, if the probe 24 is retrieved after a survey and requires reconditioning for another survey, the probe would normally be cleaned externally, disconnected from the plug 28 and the wireline cable 30 and removed to the bench 36A. At this time, the lower end plug 148 of the outer housing is removed and the coiled hose 142 extended and connected to the cooling and conditioning air supply unit 37.

Conditioning air or other suitable inert cooling and conditioning medium is pumped through the probe by way of passages 140 and 116, and into the interior of the lower sleeve section 60. In accordance with the unique arrangement of the circuit boards of the electronic modules 48 and 56 and the heat absorbing unit 164 cooling air flows over these components thoroughly and through the central portion of chamber 73 as well as along the outer circumferential portion thereof. The cooling air path is also generally over the entire exterior of the housing 192 and the heat absorbing units 196. After flowing through the upper electronics module 48 cooling air flows through the longitudinal passage formed by the wall 92, through passages 156 in the lower block 149 through the chamber 86, then through passages in the upper support block 149, the passage formed by tube 155, through passage 47 and out through valve 132. The arrangement of the battery pack 46 with respect to the flow path of cooling air also provides for purging the chamber 86 of gases generated during charging of the batteries. The isothermal heat absorbing units are monitored by temperature sensors suitably placed on the units, or preferably on the housing 192, until their temperatures are lowered to less than the phase change temperature of the material disposed in the heat absorbing units. The conditioning air temperature is then raised to the phase change temperature of the material in the heat absorbing units 44, 164, 196 and 58. The isothermal heat absorbing units are monitored unit they are stable at the operating temperature, battery charging is terminated and the conditioning air flow is then shut off.

Figure 10:
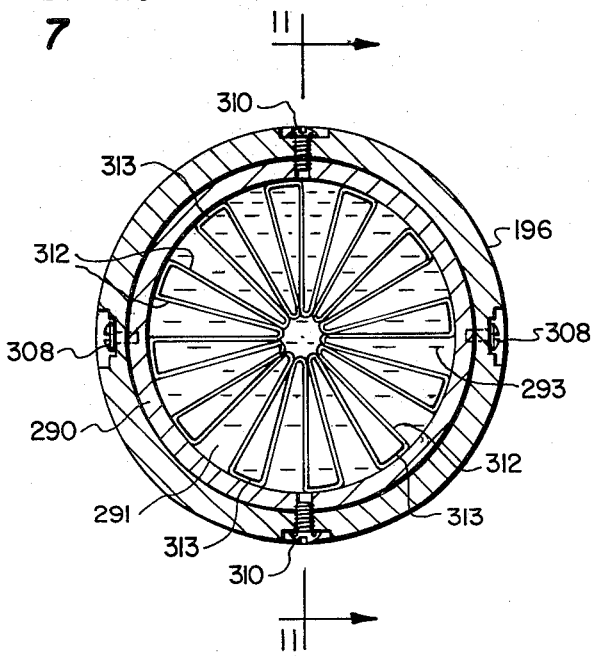
FIG. 10 is a transverse section view of an embodiment of one of the isothermal heat absorbing units of the present invention.
Figure 11:
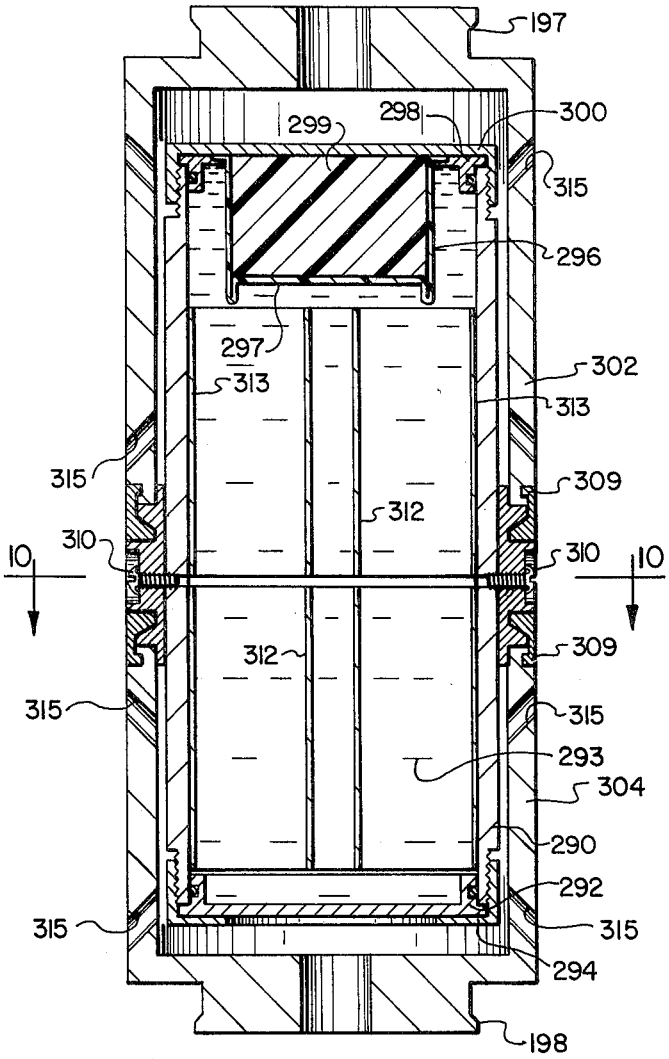
FIG. 11 is a longitudinal section view taken along the line 11—11 of FIG. 10.

As previously mentioned, an important aspect of the present invention is the provision of the isothermal heat absorbing units for conducting heat away from the cluster assembly 52, for maintaining the cluster assembly at a stable and desired operating temperature or temperature range, and for maintaining the electronics modules at a desired temperature or temperature range. Referring now to FIGS. 10 and 11, a preferred embodiment of the heat absorbing units 196 will be described in further detail. The heat absorbing unit 196 is preferably characterized by an elongated, cylindrical tubular housing member 290 which is externally threaded at its opposite ends and closed at one end by a flanged closure member 292 which is retained by a threaded cap 294. The opposite end of the housing member 290 is closed by an expansion device generally designated by the numeral 296. The expansion device 296 may be a sealed bellows or, as shown, a rolling flexible diaphragm member 297 which encloses a quantity of compressible resilient foam rubber or the like 299. The diaphragm 297 is secured to an end closure member 298 and retained in assembly with the housing 290 by a retainer cap 300. The expansion device 296 is operable to accommodate the thermal expansion and contraction of heat absorbing material disposed in the interior of the heat absorbing unit 196, and generally designated by numeral 293. The expansion device 296 might also comprise a pod of closed cell resilient foam material disposed within the interior of the housing member 290 and having a sufficient elastic memory to undergo cyclic compression and expansion to accommodate the thermal expansion and contraction of the material 293. It is also contemplated that the expansion volume of the interior of the heat absorbing unit 196 might also be provided by simply leaving an air space within the interior chamber 291 formed by the housing member 290.

The heat absorbing unit 196 is supported by opposed elongated cylindrical sleeve members 302 and 304 which are provided at their opposed distal ends with the flanges 197 and 198, respectively. The housing sleeves 302 and 304 are secured to a cylindrical housing member 306 which itself is contiguous with and secured to the outside of the housing member 290 by suitable means such as soldering. The housing member 306 can also be formed integral with member 290. Split ring type clamp members 309 are adapted to secure the sleeves 302 and 304 to the member 306. Self sealing fasteners 310 are also threadedly disposed in opposed threaded holes in the housing member 290, which fasteners may be used as fill and vent plugs for filling the interior chamber 291 completely with phase change material 293.

As with the previously described heat absorbing units, the heat absorbing unit 196 is provided with sets of radially extending fins 312 which may be formed as continuous strips of heat conductive material such as copper, or aluminum. The base portion 313 of the fins 312 are secured to the inner wall of the housing member 290 by soldering, for example, to enhance the heat flow path. By supporting the housing 290 with the sleeves 302, 304 and the band member 306, heat is conducted longitudinally along the cluster housing 192, for example, and through the coupling flanges and then through the housing sleeve 304 directly to the circumferential central portion of the heat absorbing unit. In this way, heat transfer to the material 293 is more uniform throughout the volume of material within the housing 290 and the capacity of the unit to absorb heat per unit time is more uniform than if heat transfer were primarily across an end face of the housing 290. However, the provision of the internal heat conducting fin arrangements for the heat absorbing units 44 and 196 assures a substantial and even flow of heat between the heat absorbing material and the heat load with an end type coupling to the load or the center type coupling formed by the sleeves 302-304 and the band 306. Passages 315 are formed in the sleeves 302 and 304 to allow a forced flow of cooling air to circulate over the exterior of of the housing 290 so as to more rapidly cool the phase change material.

Figure 12:
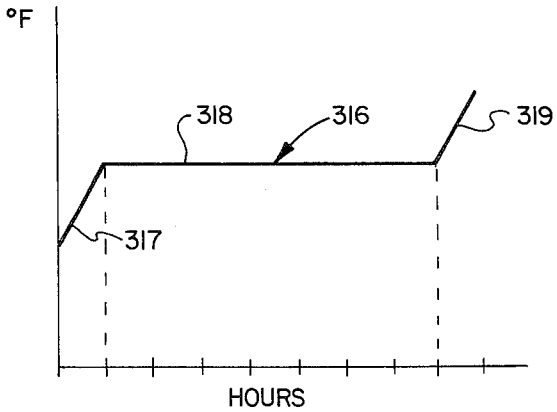
FIG. 12 is a diagram of the temperature characteristic with respect to caloric input of a typical one of the heat absorbing units of the present invention.

The performance of the heat absorbing unit 196 is represented by the diagram of FIG. 12 which comprises a time versus temperature diagram indicating generally the typical heat absorption characteristics of the one of the heat absorbing units. In the diagram of FIG. 12 the ordinate represents temperature and the abscissa represents time. The curve designated by the numeral 316 includes three distinct sections and indicates the change in temperature of the material 293 assuming relatively uniform heat generation rates. Section 317 of the curve indicates the heating of the material 293 to its melting point. Normally, the heat absorbing units are conditioned to heat the material 293 to its melting point and phase change just commenced before the a survey is begun so that uniform temperature in the probe is maintained. Section 318 of the curve commences with a transition from section 317 and continues as a straight line of nearly constant temperature over the duration of expected performance of the heat absorbing unit. The slope change in the curve 316 between the section 318 and section 319 indicates a point at which all of the material 293 has melted and the material in its liquid phase is being heated at a rate reflecting the specific heat of the liquid plus that of the housing in which the liquid is disposed. A normal operating cycle of the heat absorbing units 44, 58, 164 and 196 would utilize only the curve section 318 of the operating characteristic of the heat absorbing material.

Clearly, it is important that the section 318 of the curve 316 occur at a desired operating temperature and that the time at which this temperature is maintained be maximized. In pursuing the present invention, it has been determined that a material comprising 21.6% lithium hydroxide, 31.9% boric acid, and 46.5% water, by volume, and having a freezing temperature of 116° F. has been particularly suitable for use with heat absorbing units for the probe 24. The particular material used has a heat capacity of approximately 13,000 BTU/Ft$^3$ during isothermal phase change, a specific heat in the solid phase of 0.41 BTU/Lb.°F. and a specific heat in the liquid phase of 0.80 BTU/Lb.°F. The material density in the liquid phase is approximately 93 Lb./Ft.$^3$ and the material exhibits a volumetric expansion on melting of approximately four percent.

A second phase change material comprising lithium nitrate trihydrate has been tested also and found to be generally suited for use in the heat absorbing units of the probe 34. This material has a freezing temperature of 86° F., a heat capacity of 11,900 BTU/Ft.$^3$ during phase change, a specific heat in the solid phase of 0.45 BTU/Lb.°F., a specific heat in the liquid phase of 0.73 BTU/Lb.°F., a density of 89.3 Lb./Ft.$^3$, and a volumetric expansion on melt of 8 percent. However, the phase change temperature of this material is lower than some expected ambients and therefor would require more difficult cooling of the probe. On the other hand the assembly 52, the electronics modules and the heat absorbing units would provide for more rapid flow of heat between there components with the material having the lower freezing temperatures.

The characteristics of this material include one undesired effect which has been overcome with a unique nucleating agent to reduce supercooling of the material in changing from the liquid to the solid state. The effect of large and irregular amounts of supercooling of the heat absorbing material in the heat absorbing units, when being cooled, may result in one of more of the heat absorbing units not undergoing a phase change whereby the overall reliability of the probe in its operating cycle would be adversely affected. Accordingly, it is important that the heat absorbing material undergo a phase change reliably at a predetermined temperature. The addition of small amounts of asbestos fibers to the aforedescribed material having the phase change temperature of 86° F. reduced the amount of supercooling from a range of 16° F. to approximately 5.4° F. A preferred asbestos fiber is a grade 7D02 fiber, referring to the Quebec Standard Grading System, and is considered a good nucleating agent for certain other heat absorbing phase change materials also.

Figure 13:
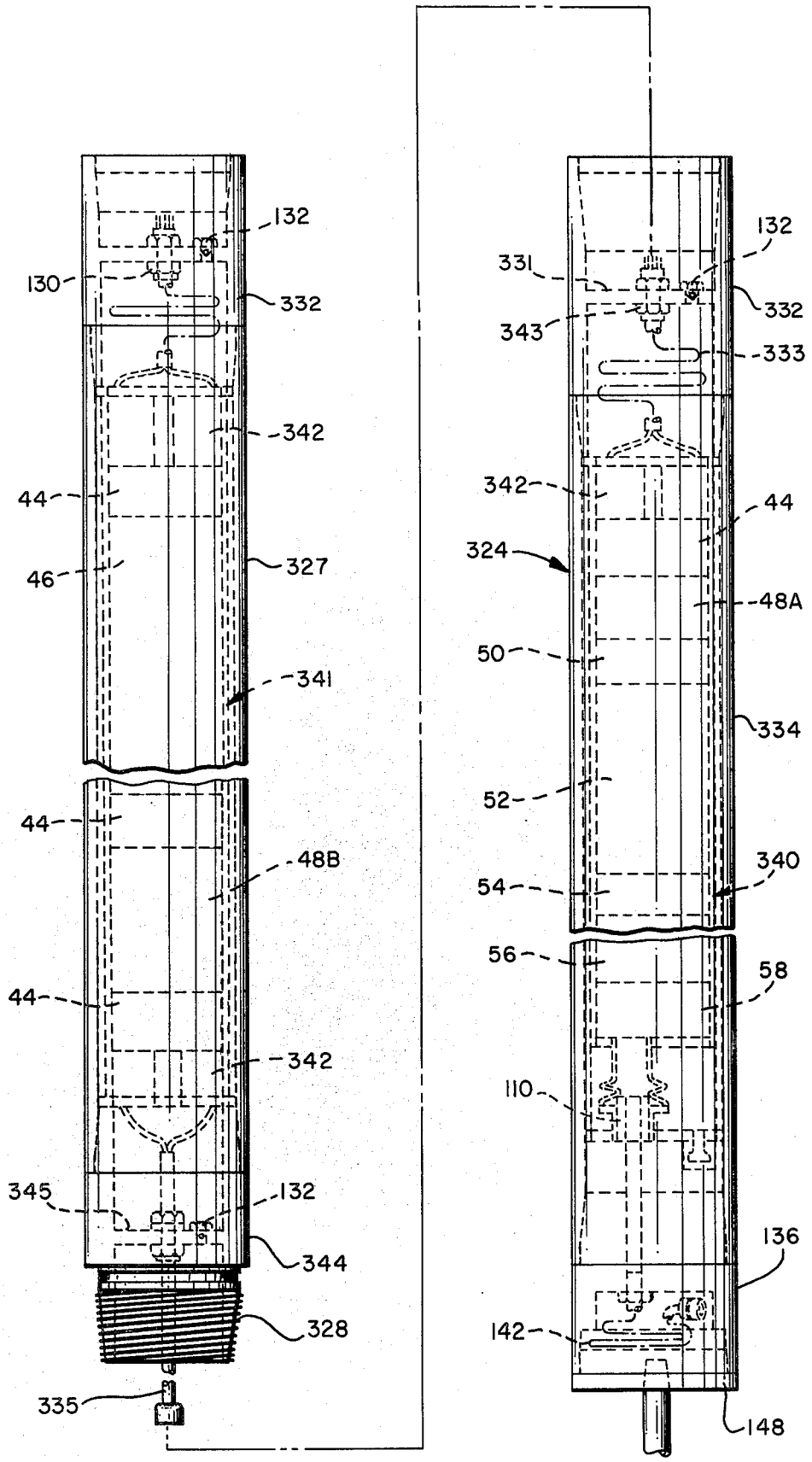
FIG. 13 is a longitudinal side elevation of an alternate embodiment of the survey probe.

Referring now to FIG. 13 an alternate embodiment of the survey probe is illustrated and generally designated by the numeral 324. In many applications of well survey probes it is necessary to transport the probe and other equipment to a well site offshore or in other relatively inaccessible areas thereby requiring a high degree of portability. Since the overall length of the probe may be in the range of 15 to 20 feet it is desirable to provide the probe in two or more sections which may be of approximately equal length. In FIG. 13 the probe 324 includes two housing sections 326 and 327 which may be coupled together by a threaded portion 328 secured on the lower portion of the housing 327 and which is received in a cooperating threaded socket formed on a sub 322 similar to the sub 122 of the probe embodiment illustrated in FIG. 4A. The housing section 326 includes an elongated tubular member 334 which is closed at its lower end by plug sections 136 and 148. A thermally insulating sleeve section similar to the sleeve 40 is disposed in the housing member 334 and generally designated by the numeral 340. The sleeve 340 is similar to the sleeve section 60 and is provided with a thermally insulating closure plug 342 at the top end and a closure plug 110 at the bottom end. The probe housing section 326 is adapted to include the end closure heat absorbing unit 58, the lower electronics module 56, the lower drive assembly 54, the cluster assembly 52, the upper drive assembly 50 and a portion of the upper electronics module designated by the numeral 48A. Accordingly, electrical conductors interconnecting the components in the housing section 326 with those in the housing section 327 are provided in a wiring harness 333 connected to a connector 343 similar to the connector assembly 130 and extending through a transverse bulkhead 331 in the sub 332. The connector 343 is adapted to be connected to a continuing wiring harness 335 extending from the lower end of the housing section 327. The sub 332 also includes a one-way flow control valve 132 for conducting cooling air out of the housing section 326 which has been introduced by way of the conduit 142 disposed in the plug section 136.

The upper housing section 327 includes a lower removable sub section 344 having a transverse bulkhead portion 345 and being threadedly coupled to the housing section 327. The upper end of the housing section 327 also includes a sub 332 coupled thereto in the same manner as the aforedescribed components. A thermal insulating vacuum sleeve section 341 similar to the section 340 is disposed in the housing section 327 and is provided with suitable end closure plugs 342 and heat absorbing units 44 disposed on each end of the remaining portion of the upper electronics module designated by numeral 48B. A battery pack 46 is disposed in the sleeve section 341 and secured therein in the same manner as described in conjunction with the probe 24. A one-way valve 132 is provided in each of the subs 344 and 332 of the upper section of the probe 324. The calibration connector assembly 130 is disposed in the sub 332 of the upper housing section 327 and is arranged similarly to the embodiment of FIG. 4A.

The provision of the multiple section housing for the probe 324 also has the advantage that certain portions of the upper electronics module 48 which are placed in the module section 48B are physically further removed from potential electrical interference with the cluster assembly 52 and the lower electronics module 56. In the assembled condition of the housing sections 326 and 327 cooling air may be introduced through the flexible conduit 142 in the same manner as cooling of the probe 24. Cooling air will flow through the interior of the sleeve section 340, through the one-way valves 132 in the subs 332 and 344 and into the interior of the sleeve section 341. Cooling air will exit the upper end of the probe 324 through the one-way valve 132 disposed in the upper sub 332. The housing sections 326 and 327 may be easily assembled and disassembled by threadedly coupling and uncoupling the subs 332 and 344 on the respective housing sections and electrically connecting the components in the respective housing sections through the connector assembly 343. Accordingly, the probe 324 enjoys somewhat greater portability than a probe disposed in a single integral outer housing such as the housing 26.

Figure 14A:
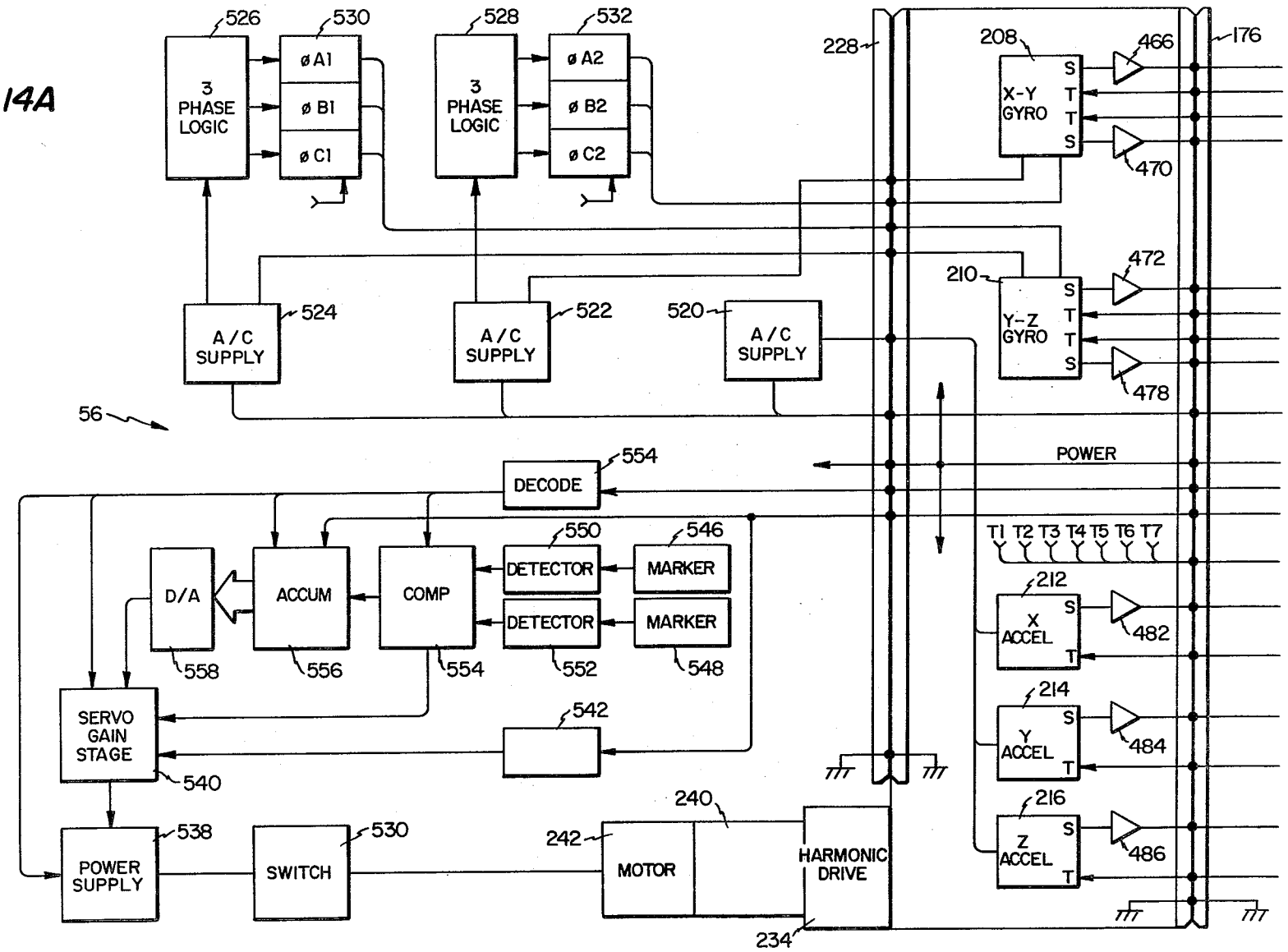
FIGS. 14A, 14B and 14C form a joint schematic diagram of the electronic components of the present invention.
Figure 14B:
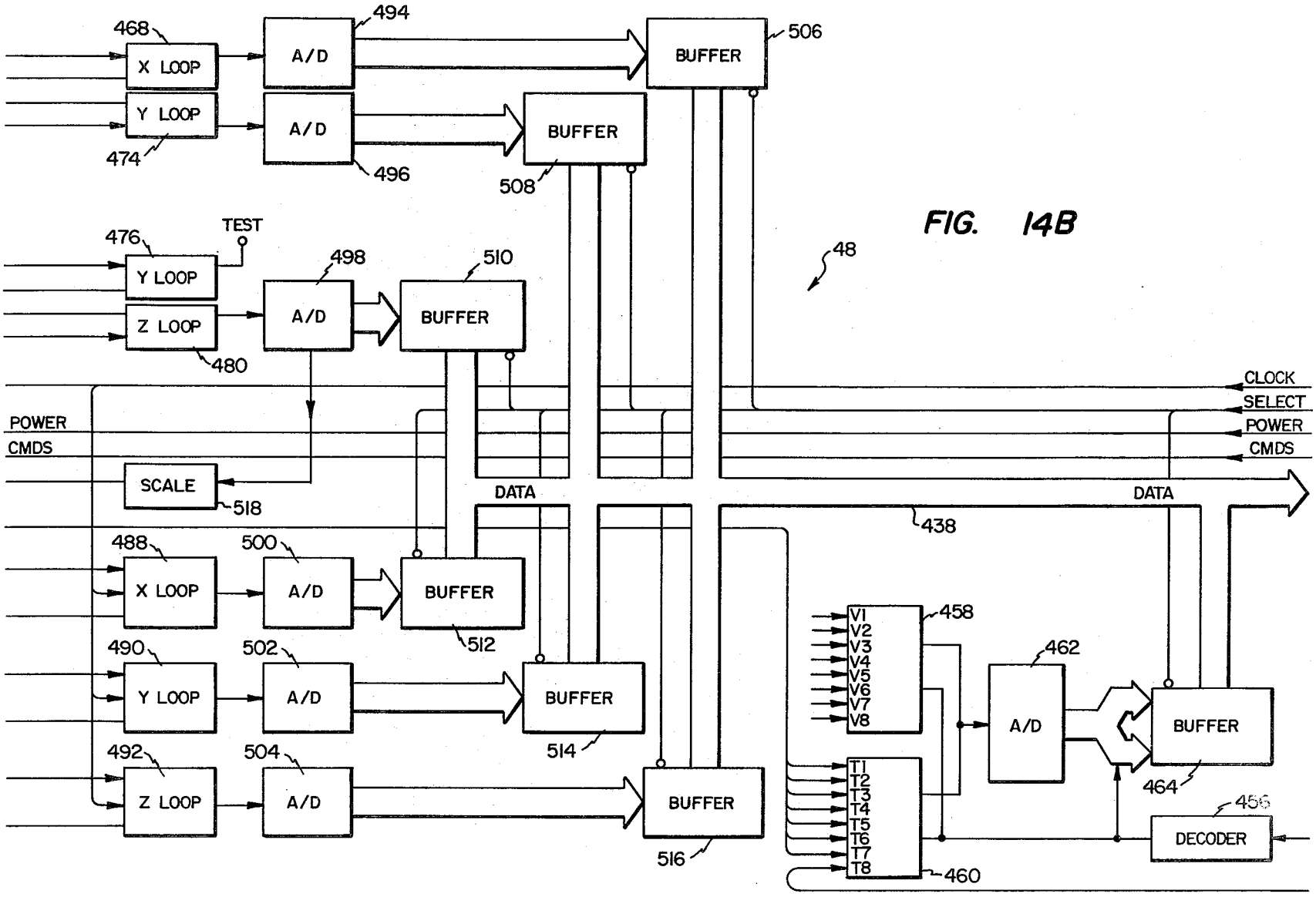
Figures 14C, 15:
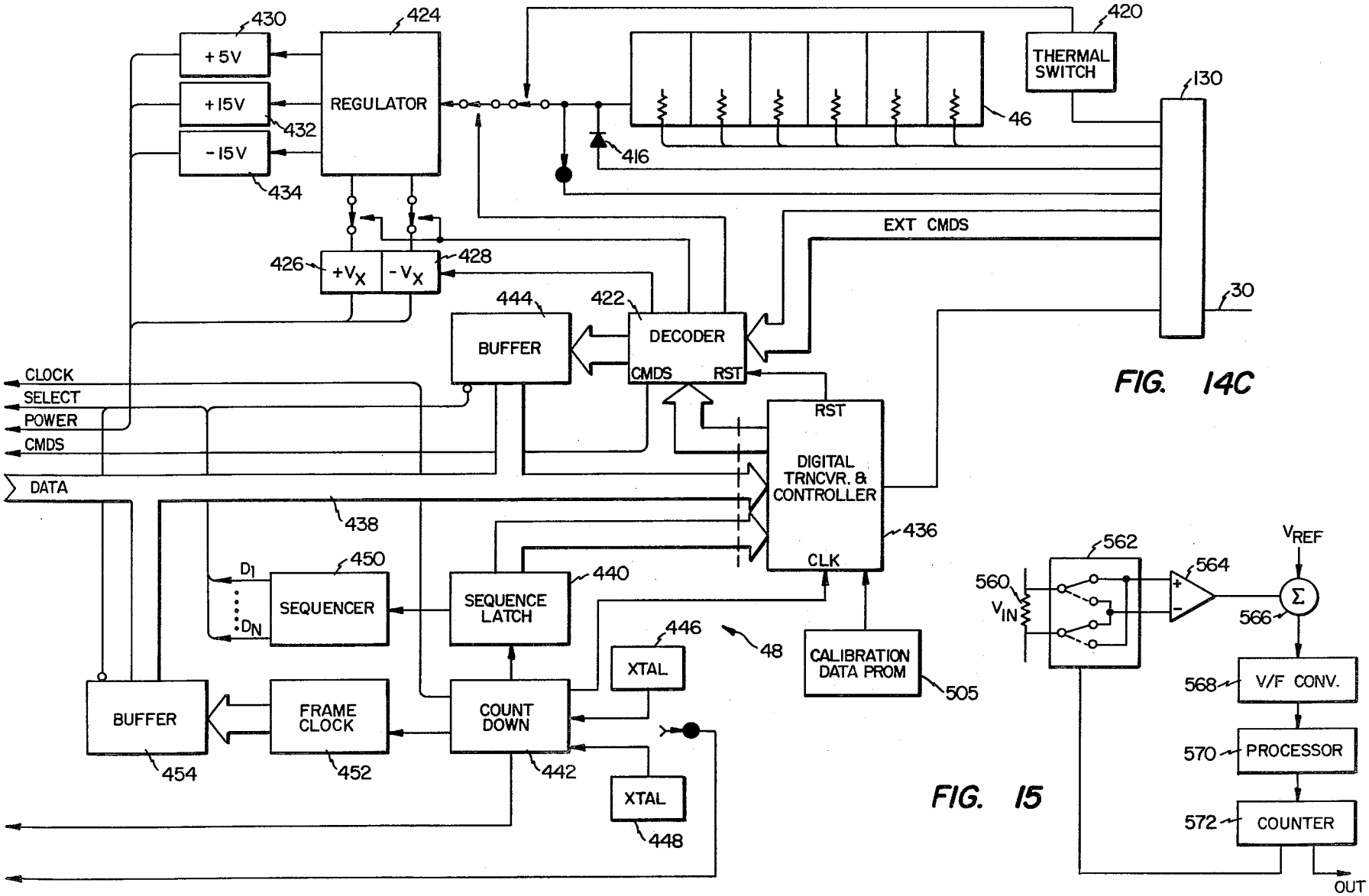
FIG. 15 is a schematic diagram of the analog to digital converter of the present invention.

With reference now to the joint figure formed by the FIGS. 14*a*, 14*b*, and 14*c*, there is depicted a schematic diagram of the major components of the cluster assembly and electronics module of survey probe 24.

Examining upper electronics module 48, it can be seen that electrical power for operating the inertial instruments and electronics within survey probe 24 is provided by the pack of rechargeable batteries 46. Batteries 46 may be provided by gelled electrolyte lead-acid batteries or a suitable alternate rechargeable type battery known in the art. Batteries 46 may be electrically coupled in parallel or in series to provide the necessary voltage levels to operate probe 24, and recharged by means of battery charger 35 coupled through calibration connector 130 and diode 416. Calibration connector 130 is utilized by the operator to charge batteries 46 and monitor the operation of probe 24 prior to sealing for borehole operation. In addition to providing a method of charging batteries 46, calibration connector 130 includes connections for monitoring the individual voltages of batteries 46; monitoring the temperature at various points throughout probe 24 by means of thermal measurement devices; overriding thermal safety switch 420; and, providing operational commands to command decoder 422. In this manner, probe 24 may be operated while connected to connector for the purposes of initial calibration of the inertial instruments and transmission of individual instrument identification to permit the operator to calibrate the instrument.

The output of batteries 46 is coupled to preregulator 424 where the direct current output of batteries 46 is converted to a variable pulse width square wave in order to accurately control the voltage output. Preregulator 424 also includes a conventional electromagnetic interference filter to minimize the noise present on the power supply voltage. The various outputs of preregulator 424 are coupled to positive supply 426 and negative supply 428, and to voltage regulators 430, 432 and 434, which provide regulated output voltages at positive 5 volts, positive 15 volts and negative 15 volts respectively. Those skilled in the art will appreciate that positive supply 426 and negative supply 428 can be selectively boosted for gyro start-up by an appropriate command. The various voltage supplies are then coupled throughout upper electronics module 48, through upper slip ring assembly 176 to cluster assembly 52, and through lower slip ring 228 to lower electronics module 56.

While probe 24 is operating suspended from wireline cable 30 in wellbore 20, communication to and from the probe and control of certain functions within the probe is accomplished by means of digital transceiver and controller 436. Digital transceiver and controller 436 is coupled to the surface utilizing insulated electrical conductor included within the harness 134 of wireline cable 30. It should be appreciated by those skilled in the art that transceiver and controller 436 may communicate with the surface over a single conductor utilizing well known multiplex techniques to separate transmission from reception, or utilizing multiple electrical conductors to permit contemporaneous transmission and reception. Communication between the various inertial instruments and data output ports within probe 24 and digital transceiver and controller 436 is accomplished utilizing internal tristate, sixteen bit data bus 438. Additionally, digital transceiver and controller 436 is coupled to command decoder 422 and sequence latch 440, the operation of which will be explained herein. Clocking pulses for digital transceiver and controller 436 are provided by a clock input from synchronous countdown circuit 442.

In a preferred embodiment of the present invention, selected commands are transmitted to probe 24 utilizing a four bit digital word. Those skilled in the digital art will appreciate that by utilizing a four bit digital word, sixteen discrete commands may be transmitted. Command decoder 422 is utilized, in this embodiment of the present invention, to decode these digital command words and to couple the necessary command signals to data bus 438 by means of tristate buffer 444. While the precise commands utilized will vary in accordance with the particular inertial instruments utilized, it is anticipated that separate commands will be utilized to sequentially power up certain sections of probe 24, to operate the inertial instruments within cluster assembly 52, and to shut down the probe 24 for various safety reasons. It is also anticipated that certain selected commands or subroutines may be accomplished internally by direction from digital transceiver and controller 436 in response to a single command and selected period of elapsed time, or in response to selected outputs from the inertial instruments or internal monitors. For such applications, digital transceiver and controller 436 can be implemented utilizing an appropriately programmed microprocessor. In the depicted embodiment of the present invention, digital transceiver and controller 436 and command decoder 422 also utilize a separate "reset" line to ensure that complete communications are available at all times. A "reset" signal is periodically transmitted down wireline cable 30 through digital transceiver and controller 436 to command decoder 422. The failure of command decoder 422 to receive this "reset" command at predetermined intervals will be utilized to indicate a loss of communications with the surface and will cause command decoder 422 to shut down the probe 24 to prevent its possible damage.

The timing and control of data transmission along data bus 438 is accomplished by means of sequence latch 440. Sequence latch 440 is necessary to control and accurately sequence access to data bus 438 by each of the tristate buffers coupling a data port to data bus 438. Timing signals for sequence latch 440 are generated by crystal oscillators 446 and 448 which are utilized in conjunction with synchronous count down circuit 442 to provide the various system clocks. One output of synchronous count down circuit 442 is coupled to sequence latch 440. Sequence latch 440 then controls access to data bus 438 by means of frame sequencer 450. Frame sequencer 450 is a digital counter which repetitively steps through a multiple stage count to alternately select one of the tristate buffers coupled to data bus 438. A four bit frame identification signal is synchronously coupled to digital transceiver and controller 436 to identify which of the possible inputs is currently coupled to data bus 438.

A second output of synchronous count down circuit 442 is coupled to frame clock circuit 452. Frame clock circuit 452, in the disclosed embodiment of the present invention, is utilized to periodically couple a "real time" clock onto data bus 438 for transmission to the surface. In this manner, data transmitted to the surface will have an elapsed time reference with respect to the beginning of each survey. The clock data from frame clock circuit 452 is coupled to data bus 438 by means of tristate buffer 454.

Similarly, another output of synchronous count down circuit 442 is coupled to submultiplex decoder 456. Submultiplex decoder 456 is utilized to control the outputs of multiplexers 458 and 460. Multiplex 458 is coupled to various voltage levels and multiplex 460 is coupled to various temperatures throughout survey probe 24. The outputs of multiplexers 458 and 460 are then coupled to a conventional eight bit analog-to-digital converter 462 and submultiplex decoder 456 controls the application of eight bits of temperature data and eight bits of voltage data to sixteen bit tristate buffer 464.

Those skilled in the art will appreciate that other internal "housekeeping" type data may also be coupled to the surface in this manner, and that the frequency of transmission for this type of data may be substantially lower than that of inertial instrument data. For example, in one embodiment of the present invention, a calibration data PROM 505 is mounted within probe 24 and is utilized to store original or factory calibration data for each individual probe. The actual data stored may vary as a matter of design choice; however, it is anticipated that data will be included on the relative orientations of the mounting axes of each inertial instrument, temperature compensation matrices for each instrument and acceptable diagnostic limits for each inertial instrument. This data is typically accessed during calibration and is coupled to digital transceiver and controller 436 by means of tristate buffer 507.

The remainder of upper electronics module 48 comprises six additional data ports coupled to data bus 438. Each data port includes an output from an inertial instrument which is coupled via upper slip ring assembly 176 through an associated servo loop and an extremely accurate analog-to-digital converter to a tristate buffer. The instruments contained within cluster assembly 52 include three specific force measurement devices, commonly referred to as "accelerometers". Each of these three accelerometers is carefully oriented to measure force along a specific axis with respect to survey probe 24. Thus, accelerometer 212 is oriented to measure force along an "X" axis; accelerometer 214 is oriented to measure force along a "Y" axis; and, accelerometer 216 is oriented to measure force along a "Z" axis in a commonly oriented cartesian coordinate system. By carefully measuring the force or acceleration along each axis, and by removing that portion of such acceleration which is due to the earth's gravitational field, it is possible to establish the acceleration experienced by survey probe 24 due to its movement through a borehole.

Also contained within cluster assembly 52 are the two gyroscopic instruments 208 and 210. Gyroscopic instruments are instruments which display strong angular momentum characteristics and which can be utilized to maintain a known spatial reference. Thus, a gyroscope can be mounted in a gimballed platform and the gimbals can be driven utilizing a closed loop servo system to maintain an inertially non-rotating platform. Alternatively, the gyroscope may be fixedly mounted to a platform and a closed loop servo system may be utilized to apply torque to the gyroscope which is proportional to the angular velocity of the platform. In either example, the torque signal applied is proportional to the angular velocity of the system and can be utilized to derive the relative angular orientation between the gyroscopes initial and present spatial reference. In the disclosed embodiment of the present invention, the gyroscopes utilized are two-degree-of-freedom gyroscopes, that is, each gyroscope includes two sensitive axes, those axes which are orthogonal to each other, and to the spin axis. In this manner, gyroscope 208 is sensitive to angular velocity about the "X" and "Y" axes, and gyroscope 210 is sensitive to angular velocity about the "Y" and "Z" axes. By utilizing two-degree-of-freedom gyroscopes, it is possible to fully defined a three axis coordinate system with only two gyroscopes. Additionally, by fixedly mounting gyroscopes 208 and 210 to cluster assembly 52, it is possible to construct the probe 24 with a sufficiently small diameter to permit its utilization in relatively narrow boreholes. However, in order to maintain the amount of torque experienced about each axis within the same general order of magnitude, in a preferred embodiment of the present invention, cluster assembly 52 is gimballed about the "Z" axis to compensate the position of cluster assembly 52 for any twisting or turning due to wireline cable 30.

As discussed above, the torque signal generated by each instrument is coupled to a servo amplifier and into a closed loop servo system. Thus, the "X" axis output of gyroscope 208 is coupled through servo amplifier 466 and upper slip ring assembly 176 into servo loop 468 and back to the torque input of gyroscope 208. In a similar manner, servo amplifier 470 and 472 and servo loops 474 and 476 are coupled to the "Y" axis outputs of gyroscopes 208 and 210 (one "Y" axis being redundant with two two-degree-of-freedom gyroscopes), and servo amplifier 478 and servo loop 480 are coupled to the "Z" axis of gyroscope 210. Additionally, servo amplifiers 482, 484 and 486 and servo loops 488, 490 and 492 are coupled in like manner to the outputs of accelerometers 212, 214 and 216 respectively.

Data from each inertial instrument is captured by applying an analog signal output from each inertial instrument to a precision sixteen bit analog-to-digital converter. The circuitry of these precision analog-to-digital converters will be described in greater detail with reference to FIG. 16. Precision analog-to-digital converters 494, 496, 498, 500, 502 and 504, are each coupled to a corresponding servo loop and through tristate buffers 506, 508, 510, 512, 514 and 516 to data bus 438. In this manner, as each tristate buffer is sequentially selected by frame sequencer 450, data from a selected inertial instrument is coupled to data bus 438. In addition to being transmitted by digital transceiver and controller 436, data representative of rotation about the "Z" axis is coupled from precision analog-to-digital converter 498 through scaling circuit 518 to be utilized in driving the "Z" axis gimbal discussed above.

Lower slip ring assembly 228 and upper slip ring assembly 176 are necessary to maintain electrical contact through cluster assembly 52 due to the gimballed rotation requirements for the cluster assembly. It is considered an important feature of the present invention that upper electronics module 48 and lower electronics module 56 are separated by the cluster assembly 52, despite the added mechanical complexity necessary to accomplish this. Upon examining the contents of upper electronics module 48 and lower electronics module 56, those skilled in the art will observe that the electronically "noisy" circuitry typically involved with electric motors and three phase power generation is located in lower electronics module 56. In this manner, the amount of electrical "noise" likely to interfere with the transmission of extremely accurate digital data is minimized.

Referring now to lower electronics module 56, the circuitry contained therein can be divided into two major groups. Lower electronics module 56 contains the drive mechanism and control circuitry necessary to gimbal instrument cluster assembly 52 and the various alternating current supplies and excitation voltages necessary to operate the inertial instruments.

Three digital signals from synchronous count down circuit 442 are coupled through upper slip ring assembly 176 and lower slip ring assembly 228 to alternating current voltage supplies 520, 522 and 524. Alternating current voltage supply 520 provides a 16 KHz sinusoidal signal to accelerometers 212, 214 and 216. Alternating current voltage supplies 522 and 524 provide a sinusoidal supply to gyroscopes 208 and 210 which is approximately 48 KHz in frequency. A second output of voltage supply 522 and 524 is supplied to three phase generators 526 and 528, which together with shaping circuits 530 and 242 serve to provide the 400 Hz three phase sinusoidal supply voltage necessary for the wheel supplies of gyroscopes 208 and 210.

Finally, referring to the remainder of lower electronics module 56, the circuitry utilized to rotate or gimbal cluster assembly 52 is depicted. Pulse width modulated power supply 538 is controlled by servo gain stage 540 and is utilized to provide a controlled and variable voltage supply which is utilized in the rotation of cluster assembly 52. Power switch 530 is utilized to alter the polarity of the output of pulse width modulated power supply 538 to alter the direction of rotation of direct current motor 242. Motor 242 includes an electromagnetic interference filter to minimize electronic "noise" caused by its operation and motor 242 is coupled through gear head 240 to harmonic drive assembly 234 which is utilized to rotate cluster assembly 52. Harmonic drive assembly 234 is utilized to rotate cluster assembly 52 to permit cluster assembly 52 to be held relatively still during these periods of time when motor 242 has been stopped, since harmonic drive assemblies do not have the backlash problems an ordinary gear drive system would include.

As a matter of design choice, motor 242 can be utilized to rotate cluster assembly 52 in several different modes for different functions. Primarily, in the "unwinding" mode, the output of servo gain stage 540 is controlled by the output of frequency-to-voltage converter 542 which is driven by the output of scaling circuit 518. Scaling circuit 518 is coupled to an output of the "Z" axis servo loop and serves to rotate cluster assembly 52 in a manner which will compensate for any rotation induced by wireline cable 30.

In the depicted embodiment, servo command decoder 544 can be utilized to alter the method of control of servo gain stage 540 in order to rotate cluster assembly 52 in a constant clockwise or counterclockwise direction for initial calibration measurements, or to a zero and one hundred eighty degree point for gyrocompassing operations. The zero and one hundred eighty degree points can be located utilizing the output of the "Z" axis servo loop or by means of mechanical scribes, slits or markers 546 and 548 which can be located on a convenient structural portion of survey probe 24. In the disclosed embodiment, the location of markers 546 and 548 is detected by means of digital detector circuits 550 and 552 which are coupled to comparator 554. The output of comparator 554 is then coupled through digital accumulator 556 to eight bit digital-to-analog converter 558 to control servo gain stage 540. In this manner, motor 242 can be made to control the rotation of cluster assembly 52 in response to the output of the "Z" axis gyroscope servo loop, in response to the detection of the zero and one hundred eighty degree markers, or in response to a command to drive the cluster assembly 52 either clockwise or counterclockwise.

Referring now to FIG. 15, there is depicted a schematic diagram of the precision analog-to-digital converter of the present invention.

Extremely accurate analog-to-digital conversion is possible utilizing unipolar analog signals and standard voltage to frequency converter devices which convert a particular voltage to a selected frequency with a high degree of accuracy. The difficulty associated with accurate analog-to-digital conversion arises when analog signals are used which are not unipolar.

A voltage to frequency converter of the type known in the art will typically convert voltages in a selected range (i.e., zero volts to twenty volts) to frequencies in a selected range. However, when the analog signal varies between a negative voltage and a positive voltage (i.e., minus ten volts to positive ten volts), it is necessary to sum the analog voltage with some reference or offset voltage (positive ten volts in the example utilized) to cause the analog voltage to vary within the range of the voltage to frequency converter. It is this necessity of providing a reference or offset voltage which introduces inaccuracies which cannot be corrected. The most accurate voltage regulator may be off several percent and a zero level in the analog signal will not then generate a zero level in a digital signal. In order to correct this deficiency, it is necessary to find a method of analog-to-digital conversion which compensates for errors in such offset voltages.

The circuitry of FIG. 15 illustrates a precision analog-to-digital converter which compensates for errors in offset voltage. The input voltage ($V_{IN}$) is measured across a resistor 560 through a commutating switch device 562 which is controlled to periodically switch at a desired sampling rate. In the position depicted, assuming unity gained for amplifier 564, the inputs into summing junction 566 are $V_{IN}$ and $V_{REF}$, the offset voltage. The output of summing junction 566 is then applied to voltage to frequency converter 568, having a gain constant K, the output of which (F1) is expressed in equation (1).

$$F1 = K(V_{IN} + V_{REF}) \quad (1)$$

The output of voltage to frequency converter 468 is coupled to processing circuit 470 which effectively blocks the output for some small period of time at the beginning of each sample period to permit the output to stabilize after switching. The frequency output of processing circuit 470 is then applied to up/down counter 472 which counts up to that value.

At the conclusion of a selected sample time, commutating switch device 462 switches positions and simultaneously converts up/down counter 472 from an up counter to a down counter. In the position indicated by the phantom lines in commutating device 462, the inputs into summing junction 466 are now $-V_{IN}$ and $V_{REF}$. The output of summing junction 466 is then applied to voltage to frequency converter 468, the output of which (F2) is expressed in equation (2).

$$F2 = K(-V_{IN} + V_{REF}) \quad (2)$$

This output is then processed by processing circuit 570 as before and applied to counter 572 in its down counter mode. After completing these two identical sample times, the value present in up/down counter 572 will be F1 minus F2, as expressed in equation (3).

$$\begin{aligned} F1 - F2 &= K(V_{IN} + V_{REF}) - K(-V_{IN} + V_{REF}) \\ &= 2KV_{IN} \end{aligned} \quad (3)$$

Those skilled in the art should appreciate that in this manner, the term depending upon the reference or offset voltage has been completely eliminated. Therefore, any errors in the magnitude of offset voltage will cancel, leaving the digital output of up/down counter 572 equal to a value directly related to the input voltage.

As previously described, the three accelerometers and two gyroscopes are fixedly mounted on a member 52. The member 52 is preferably machined from a single billet of metal in such a manner that the individual instruments, together with the associated electronics in the case of the accelerometers, can be bolted directly to this member. It has proven to be unsatisfactory to attempt to adjust the positions of the instruments on the cluster in order to align them with the respective sensitive axes with the desired precision. Accordingly, the cluster is manufactured with the various mounting surfaces for the instruments positioned as accurately as reasonably possible within reasonable machining tolerances, the instruments are then bolted securely and permanently in place, and then the precise relationship of the instruments determined in the assembly facility for calibration purposes. As a result, each tool manufactured is unique in its alignment of axes, and this information must be taken into consideration when the tool is used. In addition, temperature correction factor matrices within the small variations in temperature allowed by the isothermal temperature control system must also be obtained for each individual instrument in each probe. For example, at least scale factor, mass unbalance, and restraint (i.e., bias) sensing for each gyro, and scale factor and bias for each accelerometer must be compiled. In addition, acceptable limits for each of these values are established so that if the values measured during on-site calibration are not within limits, the alternate probe will be used as will presently be described. This information for each tool is stored on a machine readable means either within or outside the probe. For this reason, the fixed calibration data is physically retained with the respective probes, and, in fact, can be carried internally of the probe if desired and loaded into the computer mainframe each time the probe is connected to the computer mainframe for use. Alternatively, the fixed calibration data module can be separated from the instrument as shown, and inserted by the operator into the computer when the probe is used. If desired, the probe can also transmit an identification number to the computer during the start-up so that the computer can verify that the appropriate fixed calibration data has been received from the module.

Figure 16A:
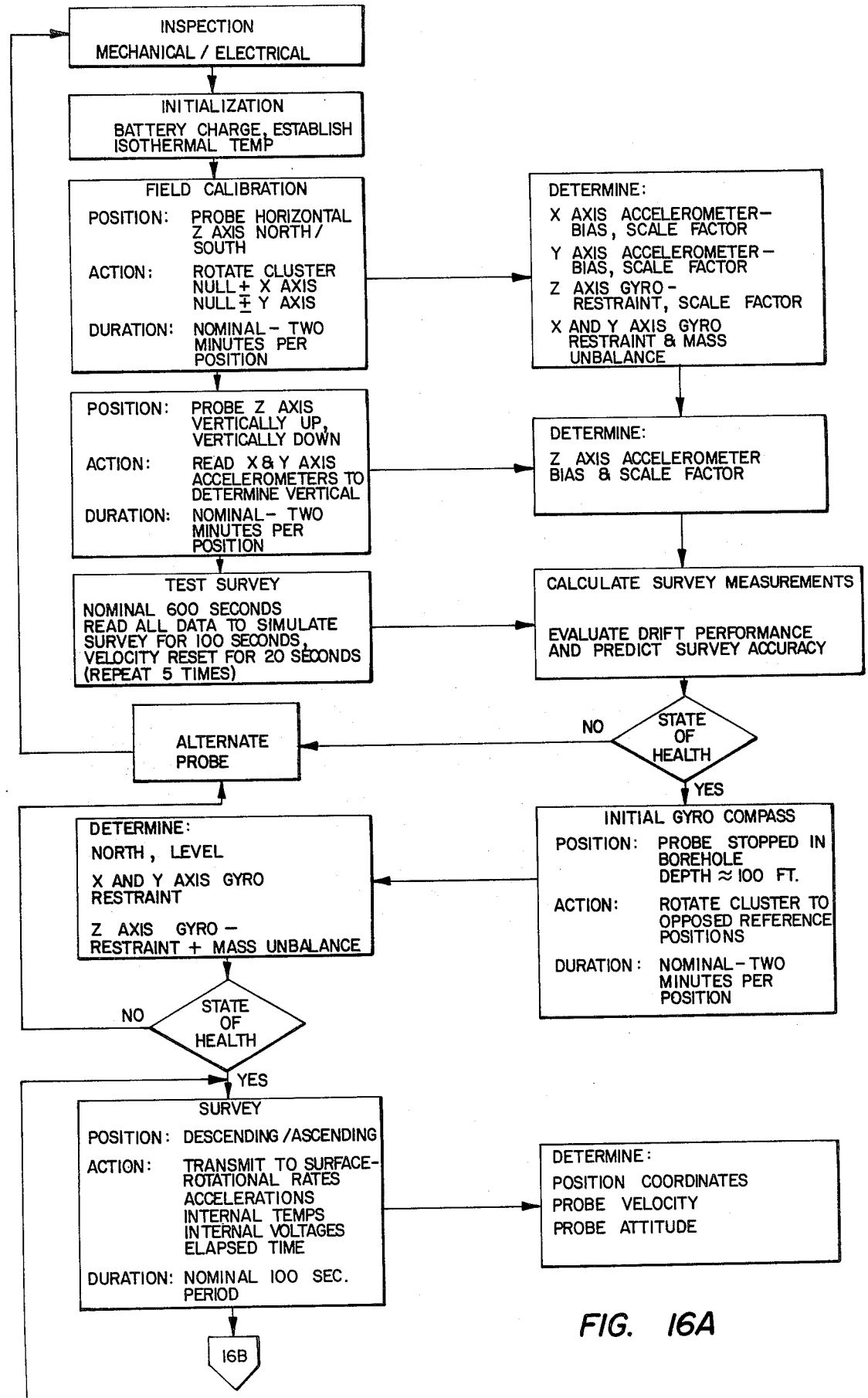
FIGS. 16A and 16B are a flow diagram of a typical borehole survey utilizing the system of the present invention.
Figure 16B:
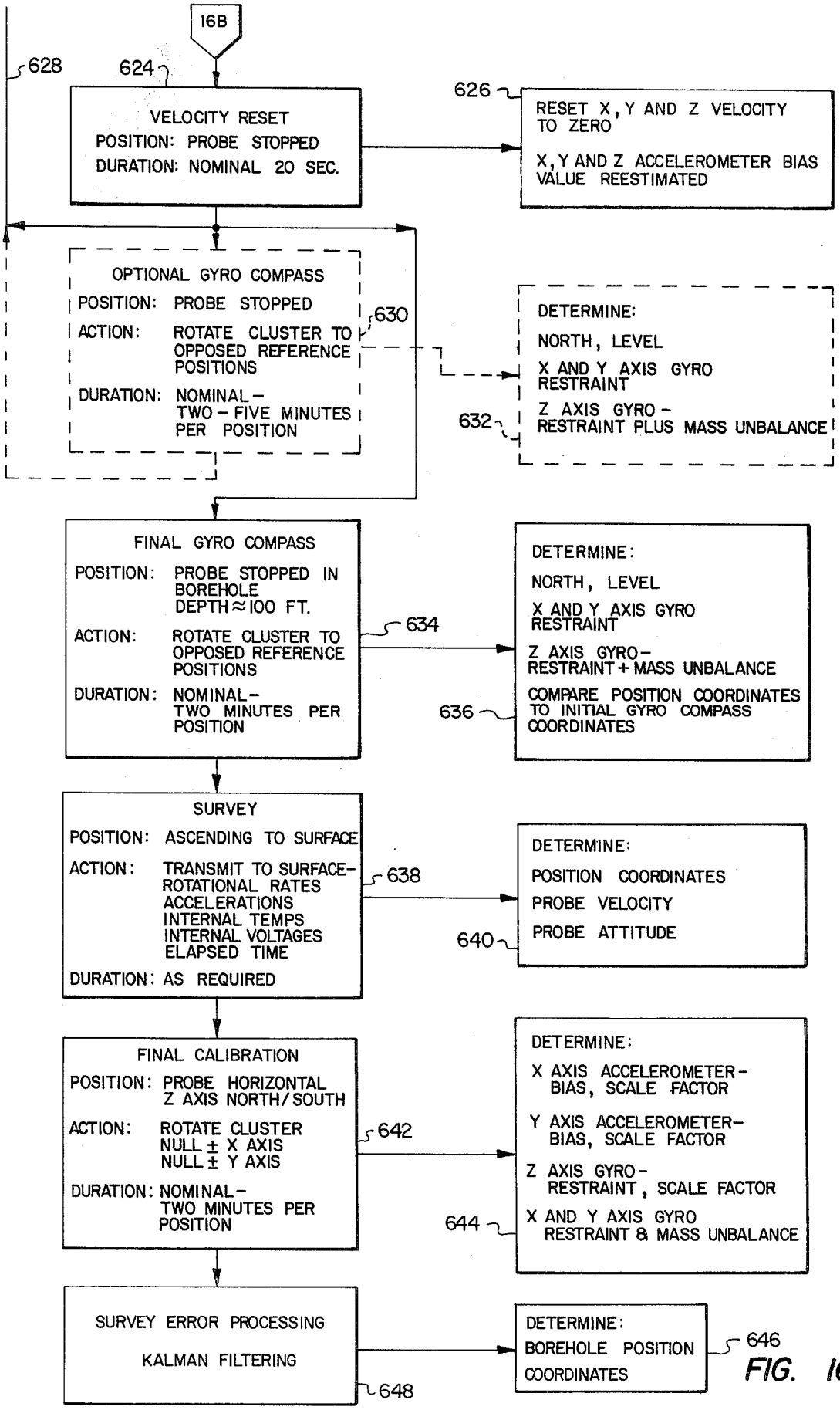

The typical survey is conducted by transporting the system illustrated in FIG. 1A, including usually both the primary and alternate probes to the wellsite and then following the procedures represented in the flow diagram of FIGS. 16A and 16B. For land applications, the entire system may be transported in a single van, as illustrated in FIG. 1A. For offshore surveys, the system may be packaged in a number of small units adapted to be transported by helicopter. At the wellsite, a standard wireline unit, such as the unit 32, is utilized. In the preferred embodiment, a wireline cable including a single electrical conductor may be utilized, or alternatively, the more expensive wireline cable consisting of plural electrical conductors, typically seven, may be used. These wireline units have standard connectors, such as connector 135, on the wireline cable, which are adapted to mate with the probe and provide both mechanical support and electrical communication. The wireline unit may be connected to the computer mainframe through the multiplex switching system 41, which may comprise either true electrical switches between two receptacles, or may merely be a single electrical receptacle which may alternatively receive the connector of the calibration cable or the connector of the cable from the wireline unit.

The first thing is to unpack the probes and remove the end pressure caps from the vessel and to visually inspect the probe for damage. Then the probe is connected to the computer either through the calibration cable or through a suitable wireline cable. A mechanical and electrical checkout is then performed by the computer as represented by block 602 in FIG. 16A. The electrical connections may include resistance and continuity checks for the electrical circuits, which may also be done by handheld units, if desired.

It is convenient to place the unit on the test stand at this time with the longitudinal axes, i.e., the Z axis, disposed nominally horizontally and aligned nominally in the north-south direction. For the field calibration, it is convenient to place the calibration stand as near the wellbore as practical, preferably on the rig floor, but such calibrations can, in accordance with an important advantage of the invention, be carried out at a location off the rig floor and on solid ground. In any event, the location for the field calibrations is chosen to provide a very quiet and stable platform essentially free from motion. When the optional Z axis accelerometer calibration procedure is to be accomplished by orienting the probe with its longitudinal axis vertical with the +Z axis accelerometer pointing upward and then downward, the manipulation of the probe can be accomplished by the calibration stand in any sequence.

The cable 41*a* may include multiple conductors, even when a single conductor wireline is to be used to run the probe in the wellbore, to connect the battery charger and other command and diagnostic functions to the probe.

Air at a temperature less than about 100° F. is then circulated through the probe. A standard catalytic converter such as a Hydrocap converter is preferably connected to sub 122 to receive air discharged through valve 132 and to convert to water any hydrogen gas which may be generated by charging the batteries. The battery charger is then turned on and monitored until the batteries are at least eighty percent charged. As previously described, in addition to charging the batteries through the calibration cable 41A, the computer is reviewing data from the probe and can command the cluster to rotate within the unit, can test various voltages for operation within the unit, can measure various temperatures within the unit, and can override the thermal safety switch.

Once the batteries have been at eighty percent charged, the computer then commands the start of the sequence to turn on electronics, start the gyros, and close all servo loops. When the first battery is determined to have reached one hundred percent charge, and the isothermal absorbers have been cooled to a temperature below about 110° F. to assure that they have been fully converted to the solid crystalline state, the temperature of the air from the forced air supply is then raised to 116° F., and the temperature of selected inertial measurement instruments monitored until they also have reached isothermal operating temperature associated with the phase change material being at the phase change temperature of 116° F. At that time, the battery charger is stopped, the forced air supply is turned off, the calibration cable is disconnected, and the head members of the pressure vessel 26 are replaced. Alternatively, in situations where the calibration procedure cannot be carried out in close proximity to the wellbore, the calibration cable may be used to connect the data stream from the probe to the computer. Then after the calibration procedure presently to be described, the probe can be transported to the rig floor without being connected to the computer because it is powered internally and will keep all components operating.

The connector 135 from the wireline unit may then be connected to the probe 24 and the computer 25 is connected through the multiplex switch 41 to the wireline unit 32. The computer 25 then establishes communication with the probe and conducts self-test procedures to assure that the probe is again working properly.

The probe is then operating on the internal battery supply at the desired internal temperature of 116°, and is communicating with the computer by way of the wireline unit, and the field calibration procedure represented by blocks 606, 605 and 609 may be started. As previously mentioned, two-way communication is established with the probe at this time, either by way of a multiplexed signal over a single conductor cable, or by using selected wires of a standard seven conductor logging cable, or by the calibration cable.

With the Z axis, i.e., the longitudinal axis of the probe generally horizonal and nominally north-south, the computer initiates a command which results in the cluster assembly 52 rotating until the X axis accelerometer, for example, has reached its minimum output, nominally zero acceleration, and is pointing east. The Y axis accelerometer will then be pointing downwardly. The outputs from all accelerometers and gyros (as well as all other standard data) are then read at the normal operating sampling rate for a period of two to five minutes. The cluster assembly 52 is then again rotated until the plus Y axis accelerometer reaches a minimum output, nominally zero, so that it is pointing west, at which point the X axis accelerometer is pointing vertically downwardly. This should result in the cluster having been rotated about the Z axis by nominally ninety degrees. The outputs from all accelerometers and gyros are read again for two to five minutes. This procedure is repeated to again null the X axis accelerometer at its minimum reading after approximately ninety degrees of rotation, and after a two to five minute sampling period, and a further rotation of about ninety degrees to a position where the Y axis accelerometer again gives its minimum reading. From the data collected during each of the four sampling periods of two to five minutes, the computer statistically selects the appropriate readings of each of the instrument outputs and computes bias factors and scale factors for both the X and Y accelerometers, the restraint factor and scale factor for the Z axis gyro, and the restraint and mass unbalance term of the X axis and Y axis gyro. In addition, the orientation of the X, Y and Z axes relative to north and horizontal is determined, all as represented by block 608.

Next, an optional, although preferred, procedure is followed in order to calibrate the Z axis accelerometer as represented by blocks 605 and 607. In this procedure, the probe is positioned vertically, first with the positive Z axis up, then vertically down, for a sufficient period to obtain a statistically accurate readings, normally about two minutes in each position. The vertical position can be determined by nulling both the X and Y axis accelerometers, the bias factors and scale factors of which have previously been calibrated. From this procedure, the Z axis accelerometer bias and scale factors can be readily calculated. In this regard, it should be noted that no other provision is made to measure depth in the borehole with accuracy, although if desired, a mechanical system such as collar counters or wireline odometers may also be employed.

In accordance with another important aspect of the invention, the scale factors for the X axis and Y axis gyros can also be field calibrated while the probe is positioned on the calibration stand. The stand has a pivot axis which can be adjusted nominally to horizontal and the probe is clamped to a support frame pivoted on the pivot axis. The probe is then positioned on the frame at a right angle to the pivot axis. Then the cluster assembly is rotated until the X axis is parallel to the pivot axis and the probe moved at a rate measurable by the gyros from a position vertically up to a position vertically down, with short sample periods at each vertical position. Then the cluster assembly is rotated until the Y axis is positioned parallel to the pivot axis and the probe positioned vertically up, then rotated to the vertically down position. This procedure, together with the procedures previously described, allows all variable factors, i.e., restraint factors, mass unbalance factors, and scale factors, of all three gyros and all variable factors, i.e., bias factors and scale factors, of the accelerometers to be calibrated immediately prior to, and under the same conditions as the survey run. These factors typically vary from day-to-day, so that current calibrations allow greater accuracy with less expensive and smaller instruments over longer useful lives at less cost of operation than would otherwise be attainable if no field calibration procedures were used.

The computations made after the initial field calibrations represented by blocks 605, 606, 607 and 608 are then compared to a set of normal ranges for these factors for the specific probe, as represented by block 610. If any factor is outside the acceptable range, the primary probe is disconnected, the alternate probe is substituted, and the procedure repeated.

After a probe appears to be satisfactory based on the calculated inertial instrument calibrations falling within previously established norms, the probe is then held very still, preferably in the vertical calibration position, although any position is satisfactory, for some predetermined period of time, for example, 5 to 10 minutes, during which normal survey data is transmitted and normal survey calculations made. For example, as will presently be described in greater detail, survey calculations are made for 100 second periods, separated by velocity reset periods of 20 seconds. The 10 minute period allows five survey and five velocity reset cycles to be observed. During this period, any indicated movement of the probe is a drift error in the total system. From this observed drift error, the accuracy of the subsequent survey can be predicted with considerable certainty. If the predicted accuracy of the system is not satisfactory, the survey with the particular probe may be aborted and an alternate probe used, before the probe is ever taken to the rig floor. This greatly reduces the possibility that a time consuming and expensive survey run will be made without obtaining valid survey data.

If the primary or alternate probes pass the state of health comparison, the probe is then rotated to the vertical position in a careful manner either by an erector, not shown, formed on the bench 36A, or by the wireline unit 32, or both. Care should be taken not to exceed a rotational rate which would cause a gyro or accelerometer to hit the limit stops as a result of rough handling, because the calibration values may be changed. This can be done after the calibration card is disconnected and before the wireline cable is connected because movement of the probe is not being measured and the probe is stabilized and running on internal power.

The probe is then held in a nominally vertical position in a very quiet environment. This is preferably accomplished by lowering the probe a measured distance into the wellbore, and particularly into the well fluids which are typically present in the bore so that the instrument will be held as motionless as possible. For this purpose, the distance from the top of the wellbore can be accurately measured utilizing the wireline, and is typically on the order of one hundred feet, for example. The probe will normally be disposed in the relatively large diameter surface casing 22 and it may be desirable to deploy the stabilizer mechanisms 38 plus a suitable locking mechanism engageable with the casing, rather than permit the probe to have any slight motion. The computer 25 then commands the motor 242 to successively move the cluster assembly to precisely two reference positions one hundred eighty degrees apart, and to sample for a period of two to five minutes at each position as represented by block 612. The actual orientation of the two positions relative to north is not relevant, only that the two positions be at some accurately known relative position preferably one hundred eighty degrees apart. From the data received by the computer while the cluster assembly is at each of the two positions, and while being rotated therebetween, the computer can calculate a refined orientation of the probe, both with respect to the vertical, or conversely, local horizontal, and with respect to the axis of rotation of the earth, or true north. The data is also used to calculate restraint factors of the X axis gyro and Y axis gyro, and the restraint factor plus the mass unbalance factor for Z axis gyro as represented by block 614.

From the computations represented in blocks 607, 608 and 614, all error factors relating to the gyros and accelerometers can be and are calculated. Specifically, the restraint factors, mass unbalance factors, for all three gyros, the scale factor for the Z axis gyro, and the bias factors and scale factors for all three accelerometers are calculated essentially at the instant the survey is to be started. The calculation of the Z axis accelerometer bias and scale factor according to the calibration procedure represented by Blocks 605 and 607 provides greater accuracy of the instrument, but in some applications may be omitted because the Z axis accelerometer bias factor is reset at the reference position represented at block 612, and at selected zero velocity fixes which will presently be described. At this time, a further state of health comparison can be made as represented by block 616 and if the comparison is satisfactory, starting the survey as represented by line 618.

The survey is then initiated by lowering the probe at the maximum rate available from the wireline unit for a period of approximately one hundred seconds as represented by box 620 in FIG. 16B during which time data relating to rotational rates about the X, Y and Z axes, acceleration information along the X, Y and Z axes, internal temperatures and voltages, and elapsed time is continuously transmitted from the probe to the computer. From this information, the computer determines, as represented by block 622, the X, Y and Z position coordinates of the probe with respect to elapsed time, the probe velocity and the probe attitude, the attitude being displayed to assist the operator in lowering the probe through highly deviated wellbores.

The probe is then stopped for a sampling period of approximately twenty seconds to provide a zero velocity recalibration, as represented by block 624, at which time the drive motor is turned off due to the absence of rotational motion of the probe and the harness drive holds the cluster very still. During this zero velocity fix, it is important that the probe be held as motionless as possible. During the zero velocity fix, any calculated velocity by the computer is an error velocity, and an indicated rate output by an accelerometer or gyro is an error, provided that the values due to rotation of the earth are removed. The duration of the stop is normally 20 seconds, but is dependent upon the rate at which the noise level can be reduced and the sample period required for the filter to statistically determine the values read from the various accelerometers and gyros with the required accuracy. Thus, during the velocity stop, the computer makes calculations as represented in box 626, namely, resets the estimated X, Y and Z velocity components and implicitly provides revised estimates of X, Y and Z accelerometer bias.

The probe is repeatedly lowered at maximum attainable velocity for periods of one hundred seconds and then stopped for twenty second intervals as represented by return line 628. After selected zero velocity stops, for example, every fifteenth velocity stop, an optional gyro compass routine may be used as represented at block 630. This procedure is a repeat of that represented by block 606 where the cluster is rotated sequentially to the two known positions approximately one hundred eighty degrees apart, where the data is sampled for periods of two to five minutes. The computer then determines, as represented by block 632, can again determine north and horizontal, and the restraint factors and scale factors for the X and Y axes gyros, and the sum of the restraint factor plus mass unbalance factor of the Z axis gyro.

The use of the gyro compass procedure 630 at selected intervals, typically about every fifteenth velocity stop, or roughly five or six times per survey, may reduce the gyro accuracy requirement if the probe is sufficiently stable during the process. The gyro compass operation permits recomputation of the X, Y, gyro restraint, Z axis gyro drift, and system heading and attitude. Consequently, the system effect of gyro drift stability is reduced to the drift stability error between the gyro compassing periods and the error of the gyro compassing heading and attitude reset.

This procedure is repeated until the bottom of the borehole is reached, where another velocity reset procedure 624 and gyro compass procedure 630 will normally be repeated. The the probe is then raised at maximum velocity for one hundred seconds and then stopped for twenty seconds, with a two position recalibration commanded every fifteenth stop, until the instrument reaches the survey initiation point within the upper portion of the borehole, which in the present example was about one hundred feet. At this point, a final velocity reset procedure 624 and gyro compass procedure 634 is performed with the corresponding computations represented at 626 and 636.

The data continues to be read as the probe is then raised to the top of the wellbore, removed and rotated to the horizontal position with a Z axis nominally oriented along the north-south axis of rotation of the earth, and preferably placed back on the bench 36A in as near the same initial position as reasonably practical, as represented by blocks 638 and 640. Then, a final calibration procedure, represented by block 642 is performed which is identical to that described in regard to block 606. The cluster is sequentially rotated to four positions for sampling periods, the positions being determined by successively nulling the X axis accelerometer, the Y axis accelerometer, the X axis accelerometer again, and finally the Y axis accelerometer again. Then, as represented by block 644, and using part of the data computed in block 636, the computer then recomputes the bias factors and scale factors of the X axis and Y axis accelerometers, the restraint factor and scale factors of the Z axis gyro, and the restraint and mass unbalance factor terms for the X axis and Y axis gyro.

All data during the survey has been recorded and is therefore available for additional data processing to improve accuracy. The computer then proceeds to determine the borehole position coordinates, as represented by block 646 using survey error processing and Kalman filtering as represented by block 648.

More specifically, after each survey is complete, the data obtained is analyzed utilizing a covariance method of error analysis with zero velocity fixes utilizing a Kalman filter mechanization. This method requires that all the navigation system errors be described by a set of linear differential equations, with the statistics of the forcing functions specified a priori. The error equations are linearized about an assumed path of travel, and the system errors are described by a covariance matrix; i.e., a matrix of the error variances and covariances.

In order to apply the covariance technique, the differential equations for the system are written in the first order linear form:

$$\dot{x}=Fx+Gw$$

Where:

x=System Error State Vector
F=System Dynamics Matrix
G=White Noise Sensitivity Matrix
w=White Noise Forcing Vector
$(\dot{\ })$=Time Differentiation The position and velocity errors will be determined by propagating an error covariance matrix with time where the error covariance matrix is defined as:

$$P=\langle xx^T\rangle$$

Where: $\langle\ \rangle$ indicates a mathematical expectation.

The error state vector, x, contains the basic system errors plus additional elements for each contributing error source in the complete system.

The elements of the state vector are as follows:

| | |
|---|---|
| 9 system errors | 3 misalignment error angles<br>3 inertial position errors<br>3 inertial velocity errors |
| 6 system component error sources | 3 gyro bias drifts<br>3 accelerometer biases |

The component error sources can also contain additive white noise without increasing the dimension of the state vector.

Specifically the elements of the 15-element state vector are as follows:

$$x=\{\epsilon_N,\epsilon_E,\epsilon_D,\delta L,\delta l,\delta\dot{L},\delta\dot{l},\delta h,\delta\dot{h},(u)\omega_x,(u)\omega_y,(u)\omega_z,(u)f_x,(u)f_y,(u)f_z\}$$

where:

$\epsilon_N$=tilt about North
$\epsilon_E$=tilt about East
$\epsilon_D$=rotation about vertical
$\delta L$=latitude error
$\delta l$=longitude error
$\delta h$=altitude error
(u)$f_k$,(k=x, y, z),=accelerometer uncertainty of kth axis
(u)$\omega_k$,(K=x, y, z),=gyro uncertainty of $K^{th}$ axis The 15×15 dimension F matrix has the following elements:

$$F = \begin{bmatrix} f_{1,1}, f_{1,2}, \cdots f_{1,15} \\ f_{2,1} \\ \cdot \\ \cdot \\ \cdot \\ f_{15,1} \qquad f_{15,15} \end{bmatrix}$$

Where the non-zero elements are

| | | | |
|---|---|---|---|
| $f_{1,2}$ | $= -\dot{\lambda}\sin L$ | $f_{2,1}$ | $= -f_{1,2} = \dot{\lambda}\sin L$ |
| $f_{1,3}$ | $= \dot{L}$ | $f_{2,3}$ | $= \dot{\lambda}\cos L$ |
| $f_{1,4}$ | $= f_{1,2} = -\dot{\lambda}\sin L$ | $f_{2,6}$ | $= -1$ |
| $f_{1,7}$ | $= \cos L$ | $f_{2,10}$ | $= C_{21}$ |
| $f_{1,10}$ | $= C_{11}$ | $f_{2,11}$ | $= C_{22}$ |
| $f_{1,11}$ | $= C_{12}$ | $f_{2,12}$ | $= C_{23}$ |
| $f_{1,12}$ | $= C_{13}$ | | |
| $f_{3,1}$ | $= -f_{1,3} = -\dot{L}$ | $f_{4,6}$ | $= 1$ |
| $f_{3,2}$ | $= -f_{2,3} = -\dot{\lambda}\cos L$ | $f_{5,7}$ | $= 1$ |
| $f_{3,4}$ | $= f_{3,2} = -\dot{\lambda}\cos L$ | | |
| $f_{3,7}$ | $= -\sin L$ | $f_{6,2}$ | $= -f_D/r$ |
| $f_{3,10}$ | $= C_{31}$ | $f_{6,3}$ | $= f_E/r$ |
| $f_{3,11}$ | $= C_{32}$ | $f_{6,4}$ | $= -\dot{l}(\dot{l} + 2\omega_{ie})\cos 2L$ |
| $f_{3,12}$ | $= C_{33}$ | $f_{6,6}$ | $= -2\dot{h}/r$ |
| $f_{7,1}$ | $= f_D/r \cos L$ | $f_{6,7}$ | $= \dot{\lambda}\sin 2L$ |
| $f_{7,3}$ | $= -f_N/r \cos L$ | $f_{6,8}$ | $= -\frac{1}{r}\ddot{L} + \frac{1}{2}\dot{l}(1 + 2\omega_{ie})\sin 2L$ |
| $f_{7,4}$ | $= (\ddot{l} + 2\dot{\lambda}\dot{h}/r + 2\dot{L}\dot{\lambda}\cot L)\tan L$ | $f_{6,9}$ | $= -2\dot{L}/r$ |
| $f_{7,6}$ | $= 2\dot{\lambda}\tan L$ | $f_{6,13}$ | $= C_{11}/r$ |
| $f_{7,7}$ | $= -2(\dot{h}/r - \dot{L}\tan L)$ | $f_{6,14}$ | $= C_{12}/r$ |
| $f_{7,8}$ | $= -\frac{1}{r}(\ddot{l} - 2\dot{L}\dot{\lambda}\tan L)$ | $f_{6,15}$ | $= C_{13}/r$ |
| $f_{7,9}$ | $= 2\dot{\lambda}/r$ | $f_{8,9}$ | $= 1$ |
| $f_{7,13}$ | $= C_{21}/r \cos L$ | | |
| $f_{7,14}$ | $= C_{22}/r \cos L$ | | |
| $f_{7,15}$ | $= C_{23}/r \cos L$ | | |
| $f_{9,1}$ | $= f_E$ | | |
| $f_{9,2}$ | $= -f_N$ | | |
| $f_{9,4}$ | $= -r\dot{l}(\dot{l} + 2\omega_{ie})\sin 2L$ | | |
| $f_{9,6}$ | $= 2r\dot{L}$ | | |
| $f_{9,7}$ | $= 2r\dot{\lambda}\cos^2 L$ | | |
| $f_{9,8}$ | $= \dot{L}^2 + \dot{l}(\dot{l} + 2\omega_{ie})\cos^2 L - (\kappa - 2)\omega_S^2$ | | |
| $f_{9,13}$ | $= -C_{31}$ | | |
| $f_{9,14}$ | $= -C_{32}$ | | |
| $f_{9,15}$ | $= -C_{33}$ | | |

The 15×6 dimension white noise sensitivity matrix, G, has the following form:

$$G = \begin{bmatrix} g_{1,1} \; g_{1,2} \; \cdots g_{1,6} \\ \cdot \\ \cdot \\ \cdot \\ \cdot \\ g_{15,1} \; g_{15,2} \cdots g_{15,6} \end{bmatrix}$$

The non-zero elements are:

| | | | |
|---|---|---|---|
| $g_{1,1}$ | $= C_{11}$ | $g_{7,4}$ | $= C_{21}/r \cos L$ |
| $g_{1,2}$ | $= C_{12}$ | $g_{7,5}$ | $= C_{22}/r \cos L$ |
| $g_{1,3}$ | $= C_{13}$ | $g_{7,6}$ | $= C_{23}/r \cos L$ |
| $g_{2,1}$ | $= C_{21}$ | $g_{9,4}$ | $= -C_{31}$ |
| $g_{2,2}$ | $= C_{22}$ | $g_{9,5}$ | $= -C_{32}$ |
| $g_{2,3}$ | $= C_{23}$ | $g_{9,6}$ | $= -C_{33}$ |
| $g_{3,1}$ | $= C_{31}$ | | |
| $g_{3,2}$ | $= C_{32}$ | | |
| $g_{3,3}$ | $= C_{33}$ | | |
| $g_{6,4}$ | $= C_{11}/r$ | | |
| $g_{6,5}$ | $= C_{12}/r$ | | |
| $g_{6,6}$ | $= C_{13}/r$ | | |

Finally, the 6 dimension vector of instrument white noise is given by:

$$W = \{W_{gx}, W_{gy}, W_{gz}, W_{ax}, W_{ay}, W_{az}\}$$

Where $W_{gk}$,(k=x, y, z),=Gyro white noise associated with the kth instrument $W_{ak}$,(K−X, y, z),=accelerometer white noise associated with the kth instrument The analysis is based on the minimum variance estimator as derived by Kalman. The technique provides the best available estimate of the state from the data.

Between measurements the covariance matrix propagates by the following equation:

$$\dot{P} = FP + PF^T + GQG^T$$

Where F and G were previously defined and the noise strengths define Q:

$$<W(t)W(-t)^T>=Q\delta(t-\tau)$$

where (t) is the unit impulse fuction. To solve the covariance differential equation, the initial state vector must be specified:

$$P(0)=<x(0)\,x\,(0)^T>$$

To incorporate measurements the scalar measurement technique is used:

$$m=h^Tx+r$$

h selects the components of the INS error while r is additive white measurement noise.

Whenever a measurement is taken, the estimate of the error state is updated as follows:

$$\hat{x}^+=\hat{x}+K(m-h^T\hat{x})$$

where $\hat{x}$=estimate of x just before measurement $\hat{x}^+$=estimate of x after incorporating the measurement K=vector of Kalman filter gains.

The optimum update of the covariance matrix is:

$$P=(I-Kh^T)P$$

where $$K=\frac{1}{\alpha}\,P\,h$$
$$=h^+\,P\,h+R$$

$R=<r>^2$=random measurement error variance.

In this manner, estimates of the error in each measurement can be obtained, increasing the accuracy of the resultant survey.

From the above description of preferred embodiments of the invention, it will be appreciated that a unique system for determining the location of a wellbore has been described. The system is particularly useful in surveying very deep, small diameter boreholes which inherently have high pressures and high temperatures. The system has the capability to determine the location of these wellbores with sufficient accuracy to permit, if necessary, interception by a relief well in the event of a blowout. The system includes surface equipment and downhole probes which can be run on a standard wireline having either a single electrical conductor or seven. The system is designed to be operated by relatively unskilled technical personnel in the very severe environments associated with either onshore or offshore wellsites. The system permits the use of any one of several probes with any one of several surface units, yet providing factory calibration data unique to each probe for use by the surface computer.

In addition, both accuracy and reliability are greatly increased by the use of field calibration procedures and computations. Accuracy is improved by calibrating all of the relevant error factors relating to the gyroscopes and accelerometers after the probe has been stabilized at the isothermal operating temperature at the wellsite and just before being lowered into the borehole. Reliability is improved by using these calibrated factors to determine the state of health of the probe and to indicate when the probe should be replaced with an alternate probe before conducting the time consuming and expensive survey. Special procedures are also performed during the running of the survey to recalibrate the inertial instruments during the survey run. Subsequent to the survey run, further statistical calibrations and closure calculation are used in conjunction with filtering techniques to further refine the accuracy of the survey.

By the use of a complete three axis system of accelerometers and rate gyros, errors inherent in prior art dead reckoning systems which rely upon determining the angle of the longitudinal axis of the probe at relatively large intervals of depth are eliminated. In the present system, inertial data is collected continuously while the probe is moving through the wellbore at a high sample rate to provide great accuracy.

The use of inertial survey system in the very small diameter probe necessary to survey deep wellbores is made possible by using rate gyros and accelerometers which are fixedly mounted at spaced intervals along an elongated, small diameter support member and operated in the strap down mode. This cluster of inertial instruments is rotated about the longitudinal axes by a servo loop responsive to a gyro input to minimize rotation of the cluster about the longitudinal axis which would otherwise be great as a result of the twisting of the wireline as it is unwound from the storage drum.

By using rate gyros and accelerometers fixedly mounted at spaced intervals along an elongated cluster support housing, the cluster assembly can be made sufficiently small to be disposed within an insulating vacuum sleeve which, in turn, can still be disposed within a pressure vessel having an external diameter sufficiently small to allow it to be lowered into five inch casing typically used in very deep boreholes. The vacuum sleeve essentially thermally isolates the interior of the sleeve from the exterior, and isothermal phase change units are thermally coupled to all heat generating sources within the sleeve in order to maintain the constant temperature necessary to achieve the desired accuracy or the long period of time necessary to survey a deep borehole. The instrument cluster and electronics and associated isothermal phase change material are mounted in a unique manner within the small diameter vacuum sleeve in such a manner that air can be passed longitudinally through the sleeve to solidify the isothermal material. The ends of the sleeve and pressure vessel provide access for cooling fluid. The phase change material of this invention is uniquely suited for the application because the phase change temperature is at 116° F. which is greater than any expected ambient temperature in field operations. This simplifies the source of a clean cooling fluid to be circulated through the vacuum sleeve to precondition the probe for a survey run.

By mounting the elongated instrument cluster assembly for rotation relative to the wireline cable and decoupling the rotation of the cluster from rotation induced by the unwinding of the wireline cable, the Z axis rate gyro can have the necessary small dynamic range to thereby achieve the desired accuracy. Further, the torquer utilized in the gyro loop to decouple the cluster from the wireline rotation is also used to achieve field calibrations of the time variable factors of each critical inertial measurement instrument after the instrument is operating at the isothermal temperature and thus assuring continued high accuracy. This also allows the probe to be used for a longer period of time without return to the factory or calibration lab, and permits the use of smaller and less expensive instruments.

As a result of using strapped down gyros on the solid, elongated cluster, the cluster can be made very rigid in the small diameter while simultaneously providing a thermal path to isothermal heat absorbing units thermally coupled to and rotated with the cluster assembly. This cylindrical structure can be made to fit closely within the vacuum sleeve and yet results in no thermal shorts from the high temperature of the borehole.

This combination of components also provides a very small diameter, relatively elongated system which is sufficiently rigid to give the necessary accuracy, yet which can be thermally controlled. The cluster assembly is rotated by a drive system which holds the cluster very still when the drive motor is not energized, thus permitting zero velocity resets. The cluster assembly also includes a differential and slip joint to allow for axial misalignment and thermal expansion without inducing bending moments in the cluster which would cause errors in the system.

The use of rate gyros and accelerometers with analog readouts requires high accuracy A-to-D conversion. This accuracy is provided by a combination of substantially isothermal temperature controlled reference voltage for linearity and a unique switched sampling system for zero offset errors. The digital data can then be transmitted up the long lossy wireline at satisfactory sampling rates without degrading the survey computation. The location of the use system clock within the probe and the communication of the lapsed time with the inertial measurement data provides precise correlation of the data and minimizes adverse consequences of momentary interruption in data stream.

The use of a battery power supply is necessary because of the difficulty in transmitting sufficient power at adequately stabilized voltages over the long wireline necessary for deep wellbores. This also permits a single conductor cable to be used to lower the tool while utilizing a surface computer. The multiplex data transmitter further permits commands to the instrument to rotate the instrument cluster on command during the initial and final calibration procedures. Alternatively, automatic means can be positioned within the instrument to automatically command rotation to the 180° for gyro computing and calibration.

Although preferred embodiments of the invention have been described in detail, it is to be understood that various changes, substitutions and alterations can be made therein without departing from the spirit of the invention as defined by the appended claims.

What is claimed is:

1. The survey system for determining the location of relatively deep boreholes with great accuracy comprising:

a tubular probe having a maximum diameter less than about four inches and adapted to be lowered into a wellbore;

a flexible cable attached to the upper end of the probe including at least one electrical data transmission path and having sufficient length to lower the probe into the borehole;

reel means for controllably paying out and retrieving the flexible cable to lower the probe into and retrieve the probe from the wellbore;

computer means including keyboard input means, data processing means, data readout means and data recording means electrically connectable by the flexible cable to the probe to receive data from and give commands to circuit means therein;

the probe comprising:

(1) a tubular pressure vessel;

(2) vacuum sleeve means disposed within the tubular pressure vessel for substantially thermally isolating the interior thereof from the pressure vessel;

(3) an inertial cluster assembly including (a) an elongated, rigid, thermally conductive support member disposed within the vacuum sleeve;

(b) inertial sensing means for sensing acceleration of the inertial assembly along three substantially orthogonally disposed sense axes, one of which is aligned with the longitudinal axes of the probe, and for sensing rates of rotation about the same three orthogonally disposed axes, the inertial sensing means being rigidly mounted at spaced points on the support member in heat exchange relationship therewith;

(c) transducer and circuit means for sensing the temperatures of the inertial sensing means, and producing an electrical signal representative of the temperatures thereof;

(d) isothermal phase change material in at least one cylindrical container rigidly and thermally coupled to the support member to absorb heat generated by the inertial sensing means to maintain the inertial sensing means at a temperature within a predetermined narrow range for a period of time greater than that required to complete the well survey;

(e) cluster circuit means associated with the inertial sensing means mounted on the rotating cluster assembly and thermally coupled to the support member;

(4) upper and lower journal means supported in the vacuum sleeve for rotatably supporting the cluster assembly within the vacuum sleeve for rotation about the longitudinal axes of the vacuum sleeve;

(5) first slip ring means including a rotor member mounted to the upper end of the cluster assembly and a stator assembly supported in the vacuum sleeve for establishing a plurality of electrical paths between the interior of the vacuum sleeve above the cluster and the cluster assembly;

(6) second slip ring means including a rotor member mounted on the lower end of the cluster assembly and a stator member supported within the vacuum sleeve for establishing a plurality of electrical paths between the cluster assembly and the interior of the vacuum sleeve below the cluster assembly;

(7) controllable torque means coupled to rotate the cluster assembly including electric motor means for locking the cluster assembly relative to the vacuum sleeve;

(8) rechargeable battery power supply means disposed within the pressure vessel;

(9) upper circuit means disposed within the vacuum sleeve above the cluster assembly, lower circuit means disposed within the vacuum sleeve below the cluster assembly, the upper and lower circuit means being mounted on and thermally coupled to elongated thermally conductive containers substantially filled with an isothermal phase change material for maintaining the circuits within a predetermined narrow temperature range for a period of time longer than a desired survey run, the upper, lower and cluster circuit means including subcircuit means for (a) producing a digital signal representative of the temperature sensed by the temperature means;
(b) initiating and terminating operation of the inertial sensing means on command;
(c) producing analog signals representative of the inertial measurements of said inertial sensing means and converting the analog signals to digital signals representative of the inertial measurements of each inertial sensing means;
(d) transmitting the digital signals from the probe over the cable to the computer means; and
(e) in response to command signals received by the probe from the computer system
(i) enabling a servo loop including an inertial measuring signal and the torque means to approximately decouple the rotation of the cluster assembly from rotation of the pressure vessel and vacuum sleeve,
(ii) rotating the cluster assembly to at least two predetermined positions relative to the vacuum sleeve,
(iii) rotating the cluster assembly to achieve at least four dwell positions, determined by measuring outputs from the inertial sensing means;

(10) the upper and lower circuit means, the cluster assembly, and the battery power supply means being supported within the vacuum sleeve in a manner to permit circulation of cooling fluid through the vacuum sleeve in heat exchange relationship with each container of isothermal phase change material,

(11) the upper and lower ends of the thermal sleeve having upper and lower thermal barrier means forming substantially a thermal barrier between the interior of the thermal sleeve and the pressure vessel,

(12) lower port means extending through the lower thermal barrier means to pass conditioning fluid therethrough and upper port means extending through the upper thermal barrier means to pass thermal conditioning fluid therethrough, the upper and lower port means including means for coupling the port means to a source of conditioning fluid and circulating the conditioning fluid from one end of the vacuum sleeve to the other to cool the isothermal phase change material below the isothermal temperature,

(13) electrical conductor means extending through the upper thermal barrier means for providing at least one electrical data transmission path through the thermal barrier, the conductor means including a disconnectable coupling means,

(14) the pressure vessel including a lower pressure resistant closure means which is removable to permit fluid access to the lower port means and an upper pressure resistant closure means which is removable to permit fluid access to the upper port means,

(15) electrical conductor means extending through the upper thermal barrier of the pressure vessel for connection to the computer means for establishing data transmission therebetween,

(16) an electrical conductor means for recharging the battery power supply extending through one of the thermal barrier means; and

(17) means for disconnectably coupling the pressure vessel to the flexible cable for suspending the probe therefrom;

said computer means and data processing and recording means including:
(1) means for receiving digital signals transmitted from the probe via a data path and for transmitting control data to the probe via a data path,
(2) means for displaying information based on data received from the probe,
(3) means for inputting command signals to the probe in response to operator actuated input signals, the computer means and circuit means carried by said probe including means for, in response to at least one command signal,
(a) initiating operation of the inertial sensing means,
(b) rotating the cluster assembly while monitoring outputs of the inertial sensing means to position one of the sense axes at four positions, vertically up and down and horizontally east and west when the probe is oriented generally horizontally with the longitudinal axis generally north-south, for predetermined sample periods while reading and storing the outputs of the inertial sensing means,
(c) computing calibration data for selected inertial instruments from the sampled data and comparing the computed calibration to predetermined norms to permit a decision to abandon the survey run with the probe,
(d) rotating the cluster assembly to at least two sample positions while the probe is oriented with the longitudinal axis vertical, in predetermined relationship one to the other while reading and storing the outputs from the inertial sensing means,
(e) completing calculation of current calibrations for selected inertial sensing means,
(f) initiating a survey mode wherein outputs from the inertial sensing means and temperature sensing means are continuously read and stored and certain computations made for the duration of a survey trip while,
(i) initiating a decoupling mode where the inertial cluster assembly is decoupled from rotational movement of the pressure vessel by the inertially referenced servo loop while the probe is moving longitudinally of the wellbore,
(ii) periodically, while the probe is stationary within the wellbore, stopping rotation of the cluster assembly relative to the pressure vessel for a selected time interval,
(iii) periodically, while the probe is stationary within the wellbore, rotating the inertial cluster assembly to at least two data sample positions at selected relative positions for selected time intervals, and
(g) computing the path of the probe relative to a three dimensional coordinate system using the inertial measurements produced by the inertial sensing means as calibrated and corrected by calibration computations made from the output readings obtained during selected survey procedures.

2. The survey system for determining the location of relatively deep boreholes with great accuracy comprising:
a tubular probe;
a flexible cable attached to the upper end of the probe including at least one electrical data transmission path and having sufficient length to lower the probe into the borehole;

reel means for controllably paying out and retrieving the flexible cable to lower the probe into and retrieve the probe from the wellbore;

computer means including keyboard input means, data processing means, data readout means and data recording means electrically connectable by the flexible cable to the probe to receive data from and give commands to circuit means therein;

the probe comprising:

(1) a tubular pressure vessel;

(2) an inertial cluster assembly including (a) an elongated, rigid support member disposed within the pressure vessel;

(b) inertial sensing means for sensing acceleration of the inertial assembly along three substantially orthogonally disposed sense axes, one of which is aligned with the longitudinal axes of the probe, and for sensing rates of rotation about the same three orthogonally disposed axes, the inertial sensing means being rigidly mounted at spaced points on the support member;

(3) upper and lower journal means for rotatably supporting the cluster assembly within the pressure vessel for rotation about the longitudinal axes of the pressure vessel;

(4) slip ring means including a rotor member mounted to the cluster assembly and a stator assembly supported in the pressure vessel for establishing a plurality of electrical paths between the interior of the pressure vessel and the cluster assembly;

(5) controllable torque means coupled to rotate the cluster assembly including electric motor means;

(6) circuit means disposed within the pressure vessel;

(a) initiating and terminating operation of the inertial sensing means on command;

(b) producing digital data signals representative of the inertial measurements of each inertial sensing means;

(c) transmitting the digital data signals from the probe over the cable to the computer means; and (d) in response to command signals received by the probe from the computer system (i) enabling a servo loop including an inertial measuring signal and the torque means to approximately decouple the rotation of the cluster assembly from rotation of the pressure vessel, (ii) rotating the cluster assembly to at least two predetermined positions relative to the pressure vessel, (iii) rotating the cluster assembly on command to achieve at least four dwell positions determined by measuring outputs from the inertial sensing means;

said computer means and data processing and recording means including:

(1) means for receiving digital data transmitted from the probe via a data path and for transmitting control data to the probe via a data path, (2) means for displaying information based on data received from the probe, (3) means for inputting command signals to the probe in response to operator actuated input signals, the computer means and circuit means carried by said probe including means for, in response to at least one command signal, (a) initiating operation of the inertial sensing means, (b) rotating the cluster assembly while monitoring outputs of the inertial sensing means to position one of the sense axes at four positions, vertically up and down and horizontally east and west when the probe is oriented generally horizontally with the longitudinal axis generally north-south, for predetermined sample periods while reading and storing the outputs of the inertial sensing means, (c) computing calibration data for selected inertial instruments from the sampled data and comparing the computed calibration to predetermined norms to permit a decision to abandon the survey run with the probe, (d) rotating the cluster assembly to at least two sample positions while the probe is oriented with the longitudinal axis vertical, in predetermined relationship one to the other while reading and storing the outputs from the inertial sensing means, (e) completing calculation of current calibrations for selected inertial sensing means, (f) initiating a survey mode wherein outputs from the inertial sensing means and temperature sensing means are continuously read and stored and certain computations made for the duration of a survey trip while, (i) initiating a decoupling mode where the inertial cluster assembly is decoupled from rotational movement of the pressure vessel by the inertially referenced servo loop while the probe is moving longitudinally of the wellbore, (ii) periodically, while the probe is stationary within the wellbore, stopping rotation of the cluster assembly relative to the pressure vessel for a selected time interval, (iii) periodically, while the probe is stationary within the wellbore, rotating the inertial cluster assembly to at least two data sample positions at selected relative positions for selected time intervals, and (g) computing the path of the probe relative to a three dimensional coordinate system using the inertial measurements produced by the inertial sensing means as calibrated and corrected by claibration computations made from the output readings obtained during selected survey procedures.

3. The survey system for determining the location of relatively deep boreholes with great accuracy comprising:

a tubular probe;

a flexible cable attached to the upper end of the probe including at least one electrical data transmission path and having sufficient length to lower the probe into the borehole;

reel means for controllably paying out and retrieving the flexible cable to lower the probe into and/or retrieve the probe from the wellbore;

computer means including keyboard input means, data processing means, data readout means and data recording means electrically connectable by the flexible cable to the probe to receive data from and give commands to circuit means therein;

the probe comprising:

(1) a tubular pressure vessel;

(2) an inertial cluster assembly including (a) an elongated, rigid support member disposed within the pressure vessel;

(b) inertial sensing means for sensing acceleration of the inertial assembly along three substantially orthogonally disposed sense axes, one of which is aligned with the longitudinal axes of the probe, and for sensing rates of rotation about the same three orthogonally disposed axes, the inertial sensing means being rigidly mounted at spaced points on the support member;

(3) upper and lower journal means for rotatably supporting the cluster assembly within the pressure vessel for rotation about the longitudinal axes of the pressure vessel;

(4) slip ring means including a rotor member mounted to the cluster assembly and a stator assembly supported in the pressure vessel for establishing a plurality of electrical paths between the interior of the pressure vessel and the cluster assembly;

(5) controllable torque means coupled to rotate the cluster assembly including electric motor means;

(6) circuit means disposed within the pressure vessel;

(a) producing digital data signals representative of the inertial measurements of each inertial sensing means;

(b) transmitting the digital data signals from the probe over the cable to the computer means;

said computer means and data processing and recording means including:

(1) means for receiving digital data transmitted from the probe via a data path, (2) means for visually presenting information based on data received from the probe, (3) means for computing the path of the probe relative to a three dimensional coordinate system using the inertial measurements produced by the inertial sensing means.

4. The survey system for determining the location of relatively deep boreholes with great accuracy comprising:

a tubular probe;

a flexible cable attached to the upper end of the probe including at least one electrical data transmission path and having sufficient length to lower the probe into the borehole;

reel means for controllably paying out and retrieving the flexible cable to lower the probe into and retrieve the probe from the wellbore;

computer means including keyboard input means, data processing means, data readout means and data recording means electrically connectable by the flexible cable to the probe to receive data from and give commands to circuit means therein;

the probe comprising:

(1) a tubular pressure vessel;

(2) an inertial cluster assembly including (a) an elongated, rigid support member disposed within the pressure vessel;

(b) inertial sensing means for sensing acceleration of the inertial assembly along three substantially orthogonally disposed sense axes, one of which is aligned with the longitudinal axes of the probe, and for sensing rates of rotation about the same three orthogonally disposed axes, the inertial sensing means being rigidly mounted at spaced points on the support member;

(3) upper and lower journal means supported in the pressure vessel for rotatably supporting the cluster assembly within the pressure vessel for rotation about the longitudinal axes of the pressure vessel;

(4) slip ring means including a rotor member mounted to the upper end of the cluster assembly and a stator member supported in the pressure vessel for establishing a plurality of electrical paths between the interior of the pressure vessel and the cluster assembly;

(5) controllable torque means coupled to rotate the cluster assembly including electric motor means;

(6) rechargeable battery power supply means disposed within the pressure vessel;

(7) circuit means disposed within the pressure vessel including subcircuit means for (a) producing digital signals representative of the inertial measurements of each inertial sensing means;

(b) transmitting the digital data from the probe over the cable to the computer means; and (c) in response to command signals received by the probe from the computer system (i) enabling a servo loop including an inertial measuring signal and the torque means to approximately decouple the rotation of the cluster assembly from rotation of the pressure vessel, (ii) rotating the cluster assembly to at least two predetermined positions relative to the pressure vessel, (iii) rotating the cluster assembly to achieve at least four dwell positions, determined by measuring outputs from the inertial sensing means;

said computer means and data processing and recording means including:

(1) means for receiving digital data transmitted from the probe via a data path and for transmitting control data to the probe via a data path, (2) means for displaying information based on data received from the probe, (3) means for inputting command signals to the probe in response to operator actuated input signals, the computer means and circuit means carried by said probe including means for, in response to at least one command signal, (a) initiating operation of the inertial sensing means, (b) rotating the cluster assembly while monitoring outputs of the inertial sensing means to position one of the sense axes at four positions, vertically up and down and horizontally east and west when the probe is oriented generally horizontally with the longitudinal axis generally north-south, for predetermined sample periods while reading and storing the outputs of the inertial sensing means, (c) computing calibration data for selected inertial instruments from the sampled data and comparing the computed calibration to predetermined norms to permit a decision to abandon the survey run with the probe, (d) rotating the cluster assembly to at least two sample positions while the probe is oriented with the longitudinal axis vertical, in predetermined relationship one to the other while reading and storing the outputs from the inertial sensing means, (e) completing calculation of current calibrations for selected inertial sensing means, (f) initiating a survey mode wherein outputs from the inertial sensing means and temperature sensing means are continuously read and stored and certain computations made for the duration of a survey trip while (i) initiating a decoupling mode where the inertial cluster assembly is decoupled from rotational movement of the pressure vessel by the inertially referenced servo loop while the probe is moving longitudinally of the wellbore, (ii) periodically, while the probe is stationary within the wellbore, stopping rotation of the cluster assembly relative to the pressure vessel for a selected time interval, (iii) periodically, while the probe is stationary within the wellbore, rotating the inertial cluster assembly to at least two data sample positions at selected relative positions for selected time intervals, and (g) computing the path of the probe relative to a three dimensional coordinate system using the inertial measurements produced by the inertial sensing means as calibrated and corrected by calibration computations made from the output readings obtained during selected survey procedures.

5. In a survey system for determining the location of relatively deep boreholes with great accuracy including:

a tubular probe having a maximum diameter less than about four inches and adapted to be lowered into a wellbore;

a flexible cable attached to the upper end of the probe including at least one electrical data transmission path and having sufficient length to lower the probe into the borehole;

reel means for controllably paying out and retrieving the flexible cable to lower the pressure vessel into and retrieve the pressure vessel from the wellbore;

computer means including keyboard input means, data processing means, data readout means and data recording means electrically connectable by the flexible cable to the probe to receive data from and give commands to circuit means therein;

the improved probe comprising:

(1) a tubular pressure vessel;

(2) thermal isolation means including a vacuum sleeve disposed within the tubular pressure vessel for substantially thermally isolating the interior thereof from the pressure vessel;

(3) an inertial cluster assembly including (a) an elongated, rigid, thermally conductive support member disposed within the thermal isolation means;

(b) inertial sensing means for sensing acceleration of the cluster assembly along three substantially orthogonally disposed sense axes, one of which is aligned with the longitudinal axes of the probe, and for sensing rates of rotation about the same three orthogonally disposed axes, the inertial sensing means being rigidly mounted at spaced points on the support member in heat exchange relationship therewith;

(c) transducer and circuit means for sensing the temperatures of the inertial sensing means, and producing an electrical signal representative of the temperatures thereof;

(d) isothermal phase change material in at least one cylindrical container rigidly and thermally coupled to the support member to absorb heat generated by the inertial sensing means to maintain the inertial sensing means at a temperature within a predetermined narrow range for a period of time greater than that required to complete the well survey;

(4) upper and lower journal means for rotatably supporting the cluster assembly within the thermal isolation means for rotation about the longitudinal axes of the thermal isolation means;

(5) at least one slip ring means including a rotor member mounted to one end of the cluster assembly and a stator member supported in the vacuum sleeve for establishing a plurality of electrical paths between the interior of the thermal isolation means and the cluster assembly;

(6) torque means coupled to rotate the cluster assembly including electric motor means for locking the cluster assembly relative to the thermal isolation means when the motor means is inoperative;

(7) circuit means disposed within the thermal isolation means and mounted on and thermally coupled to elongated thermally conductive containers substantially filled with an isothermal phase change material for maintaining the circuits within a predetermined narrow temperature range for a period of time longer than a desired survey run, the circuit means including subcircuit means for (a) sensing the temperature of the inertial instruments and producing a digital signal representative of the temperature;

(b) initiating and terminating operation of the inertial instruments on command;

(c) producing digital signals representative of the inertial measurements of each inertial instrument;

(d) transmitting the digital data from the probe over the cable to the computer means; and (e) in response to command signals received by the probe from the computer system (i) enabling a servo loop from a gyro input signal to the torque means to approximately decouple the rotation of the cluster assembly from rotation of the pressure vessel and vacuum sleeve, (ii) rotating the cluster assembly to at least two predetermined positions relative to the vacuum sleeve, (iii) rotating the cluster assembly to achieve a plurality of sample positions, the positions being determined by measuring outputs from the inertial instruments;

(8) the contents of the thermal isolation means being disposed to permit circulation of conditioning fluid through the vacuum sleeve in heat exchange relationship with each container of isothermal phase change material, (9) the upper and lower ends of the vacuum sleeve having upper and lower thermal barrier means forming substantially a thermal barrier between the interior of the vacuum sleeve and the pressure vessel,

(10) lower port means extending through the lower thermal barrier means to pass conditioning fluid therethrough and upper port means extending through the upper thermal barrier means to pass thermal conditioning fluid therethrough, the upper and lower port means including means for coupling the port means to a source of conditioning fluid and circulating the conditioning fluid from one end of the vacuum sleeve to the other to cool the isothermal phase change material below the isothermal temperature,

(11) electrical conductor means extending through the upper thermal barrier means for providing at least one electrical data transmission path through the thermal barrier, the conductor means including a disconnectable coupling means,

(12) the pressure vessel including a lower pressure resistant closure means which is removable to permit fluid access to the lower port means and an upper pressure resistant closure means which is removable to permit fluid access to the upper port means,

(13) electrical conductor means extending through the upper thermal barrier of the pressure vessel for connection to the computer means for establishing data transmission therebetween,

(17) means for disconnectably coupling the pressure vessel to the flexible cable for suspending the probe therefrom.

6. In a survey system for determining the location of relatively deep boreholes with great accuracy including a tubular probe having a maximum diameter less than about four inches and adapted to be lowered into a wellbore;

a flexible cable attached to the upper end of the probe including at least one electrical data transmission path and having sufficient length to lower the probe into the borehole;

reel means for controllably paying out and retrieving the flexible cable to lower the pressure vessel into and retrieve the pressure vessel from the wellbore;

computer means including keyboard input means, data processing means, data readout means and data recording means electrically connectable by the flexible cable to the probe to receive data from and give commands to circuit means therein;

the improved probe comprising:

(1) a tubular pressure vessel;

(2) vacuum sleeve means disposed within the tubular pressure vessel for substantially thermally isolating the interior thereof from the pressure vessel;

(3) an inertial cluster assembly including (a) an elongated, rigid, thermally conductive support member disposed within the vacuum sleeve;

(b) inertial sensing means for sensing acceleration of the inertial assembly along three substantially orthogonally disposed sense axes, one of which is aligned with the longitudinal axes of the probe, and for sensing rates of rotation about the same three orthogonally disposed axes, the inertial sensing means being rigidly mounted at spaced points of the support member in heat exchange relationship therewith;

(c) isothermal phase change material in at least one cylindrical container rigidly and thermally coupled to the support member to absorb heat generated by the inertial sensing means to maintain the inertial sensing means at a temperature within a predetermined narrow range for a period of time greater than that required to complete the well survey;

(4) upper and lower journal means supported in the vacuum sleeve for rotatably supporting the cluster assembly within the vacuum sleeve for rotation about the longitudinal axes of the vacuum sleeve;

(5) slip ring means including a rotor member mounted to the cluster assembly and a stator assembly supported in the vacuum sleeve for establishing a plurality of electrical paths between the interior of the vacuum sleeve and the cluster assembly; and (6) means coupled to rotate the cluster assembly including electric motor means;

(7) circuit means including subcircuit means for (a) producing a digital signal representative of the temperature sensed by the temperature transducer means;

(b) initiating and terminating operation of the inertial sensing means on command;

(c) producing digital signals representative of the inertial measurements of each inertial sensing means;

(d) transmitting the digital data from the probe over the cable to the computer means; and (e) in response to command signals received by the probe from the computer system (i) enabling a servo loop including an inertial measuring signal and the torque means to approximately decouple the rotation of the cluster assembly from rotation of the pressure vessel and vacuum sleeve, (ii) rotating the cluster assembly to selectable positions relative to the vacuum sleeve;

(8) the circuit means and the cluster assembly being supported within the vacuum sleeve in a manner to permit circulation of cooling fluid through the vacuum sleeve in heat exchange relationship with each container of isothermal phase change material; and (9) closable port means in the pressure vessel for circulating a conditioning fluid into and out of the pressure vessel to remove heat from the isothermal phase change material in preparation for a survey run.

7. In a survey system for determining the location of relatively deep boreholes with great accuracy including a tubular probe;

a flexible cable attached to the upper end of the probe including at least one electrical data transmission path and having sufficient length to lower the probe into the borehole;

reel means for controllably paying out and retrieving the flexible cable to lower the probe into and retrieve the probe from the wellbore;

computer means including keyboard input means, data processing means, data readout means and data recording means electrically connectable by the flexible cable to the probe to receive data from and give commands to circuit means therein;

the improved probe comprising:

(1) a tubular pressure vessel;

(2) an inertial cluster assembly including (a) an elongated, rigid support member disposed within the pressure vessel;

(b) inertial sensing means for sensing acceleration of the inertial assembly along three substantially orthogonally disposed sense axes, one of which is aligned with the longitudinal axes of the probe, and for sensing rates of rotation about the same three orthogonally disposed axes, the inertial sensing means being rigidly mounted at spaced points on the support member;

(3) upper and lower journal means supported in the pressure vessel for rotatably supporting the cluster assembly within the pressure vessel for rotation about the longitudinal axes of the pressure vessel;

(5) first slip ring means including a rotor member mounted to the upper end of the cluster assembly and a stator assembly supported in the pressure vessel for establishing a plurality of electrical paths between the interior of the pressure vessel and the cluster assembly;

(6) controllable torque means coupled to rotate the cluster assembly including electric motor means;

(7) circuit means disposed within the pressure vessel including subcircuit means for (a) producing digital signals representative of the inertial measurements of each inertial sensing means;

(b) transmitting the digital data from the probe over the cable to the computer means; and (e) in response to command signals (i) enabling a servo loop including an inertial measuring signal and the torque means to approximately decouple the rotation of the cluster assembly from rotation of the pressure vessel, (ii) rotating the cluster assembly to at least two predetermined positions relative to the pressure vessel (iii) rotating the cluster assembly to achieve at least four dwell positions, determined by measuring outputs from the inertial sensing means.

8. The survey system for determining the location of relatively deep boreholes with great accuracy comprising:

a tubular probe having a maximum diameter less than about four inches and adapted to be lowered into a wellbore;

a flexible cable attached to the upper end of the probe including at least one electrical data transmission path and having sufficient length to lower the probe into the borehole;

reel means for controllably paying out and retrieving the flexible cable to lower the probe into and retrieve the probe from the wellbore;

computer means including keyboard input means, data processing means, data readout means and data recording means electrically coupled by the flexible cable to the probe to receive data from and give commands to circuit means therein;

the probe comprising:

(1) a tubular pressure vessel;

(2) vacuum sleeve means disposed within the tubular pressure vessel for substantially thermally isolating the interior thereof from the pressure vessel;

(3) an inertial cluster assembly including (a) an elongated, rigid, thermally conductive support member disposed within the vacuum sleeve;

(b) inertial sensing means for sensing acceleration of the inertial assembly along three substantially orthogonally disposed sense axes, one of which is aligned with the longitudinal axes of the probe, and for sensing rates of rotation about the same three orthogonally disposed axes, the inertial sensing means being rigidly mounted at spaced points on the support member in heat exchange relationship therewith;

(4) controllable torque means coupled to rotate the support member including electric motor means and mechanical means for locking the inertial cluster assembly relative to the vacuum sleeve;

(5) circuit means disposed within the vacuum sleeve for:

(a) initiating and terminating operation of the inertial sensing means on command;

(b) producing analog signals representative of the inertial measurements of said inertial sensing means and converting the analog signals to digital signals representative of the inertial measurements of said inertial sensing means;

(c) transmitting the digital signals from the probe over the cable to the computer means; and (d) responding to control signals received by the probe from the computer system, the lapse of selected periods of time and selected inertial measurements of said inertial sensing means;

said computer means including:

(1) means for receiving digital signals transmitted from the probe via a data path and for transmitting control signals to the probe via a data path, (2) means for displaying data received from the probe;

(3) means for inputting control signals to the probe in response to operator actuated input signals, said computer means and circuit means carried by said probe including means for, in response to at least one control signal, (a) initiating operation of the inertial sensing means, (b) rotating the cluster assembly while monitoring outputs of the inertial sensing means to position one of the sense axes at each of four different positions for predetermined sample periods while reading and storing the outputs of the inertial sensing means, (c) computing calibration data for said inertial sensing means from the sampled data and comparing the computed calibration to predetermined norms, (d) rotating the cluster assembly to at least two predetermined sample positions while reading and storing the outputs from the inertial sensing means, (e) initiating a survey mode wherein outputs from the inertial sensing means and temperature sensing means are continuously read and position computations made for the duration of a survey trip while (i) initiating a decoupling mode where the inertial cluster assembly is decoupled from rotational movement of the pressure vessel by the inertially referenced servo loop while the probe is rotating longitudinally in the wellbore.

(ii) periodically, while the probe is stationary within the wellbore, stopping rotation of the cluster assembly relative to the pressure vessel for a selected time interval, (iii) periodically, while the probe is stationary within the wellbore, rotating the cluster assembly to at least two predetermined data sample positions for selected time intervals, and computing the path of the probe relative to a three dimensional coordinate system using the inertial measurements produced by the inertial sensing means as calibrated and corrected by computations made from the output readings obtained during a selected survey procedure.

9. The survey system of claim 8 wherein:

said circuit means disposed within the vacuum sleeve includes means for periodically stopping rotation of the cluster assembly relative to the pressure vessel for a selected period of time in response to the lapse of a selected period of time.

10. The survey system of claim 8 wherein:

21. The well survey system of claim 20 wherein:
said well survey system further includes computer means adapted to be electrically coupled to said tubular probe for receiving data therefrom and for transmitting control signals thereto, and wherein said communications means includes digital communications circuitry for transmitting digital signals representative of the outputs of said plurality of inertial measurement sensors to said computer means.

22. The well survey system of claim 20 wherein:
said plurality of inertial measurement sensors include at least one gyroscope and wherein said multiphase power generation means includes means for generating alternating current power at two different frequencies for said at least one gyroscope.

23. The well survey system of claim 20 further including:
rotator means for selectively rotating said plurality of inertial measurement sensors, said rotator means axially displaced from said plurality of inertial measurement sensors and disposed between said plurality of inertial measurement sensors and said second end of said tubular probe whereby any electromagnetic interference generated by said rotator means is isolated from said communications means.

24. A well survey system for determining the location of relatively deep boreholes with great accuracy comprising:
a tubular probe adapted to be passed through a wellbore;
at least one electrical conductor disposed at a first end of said tubular probe for forming an electrical data transmission path from said tubular probe;
a plurality of inertial measurement sensors mounted in fixed relationship within said tubular probe, each of said plurality of inertial measurement sensors having at least one analog output indicative of the state of at least one inertial parameter;
conversion means for converting said at least one analog output of each of said plurality of inertial measurement sensors into a plurality of digital signals representative thereof; and
multiplex means for selectively coupling said plurality of digital signals to said at least one electrical conductor.

25. The well survey system of claim 24 wherein:
said multiplex means includes means for receiving control signals coupled to said at least one electrical conductor.

26. The well survey system of claim 24 wherein:
said conversion means is axially displaced from said pluraltiy of inertial measurement sensors and disposed between said plurality of inertial measurement sensors and said at least one electrical conductor and wherein said system further includes multiphase power generation means for supplying multiphase electrical power to said plurality of inertial measurement sensors, said multiphase power generation means axially displaced from said plurality of inertial measurement sensors and disposed between said plurality of inertial measurement sensors and a second end of said tubular probe whereby any electromagnetic interference generated by said multiphase power generation means is isolated from said conversion means.

27. A well survey system for determining the location of relatively deep boreholes with great accuracy comprising:
a tubular probe adapted to be passed through a wellbore;
at least one electrical conductor disposed at a first end of said tubular probe for forming an electrical data transmission path from said tubular probe;
a plurality of inertial measurement sensors mounted in fixed relationship within said tubular probe, each of said plurality of inertial measurement sensors having at least one analog output indicative of the state of at least one inertial parameter;
conversion means for converting said at least one analog output of each of said plurality of inertial measurement sensors into a digital output signal representative thereof, said conversion means comprising:
switching means for selectively reversing the polarity of said at least one analog output;
summing means for summing the output of said switching means and a selected reference voltage;
digital frequency generation means for generating a selected frequency in response to each particular output of said summing means;
digital counter means coupled to the output of said digital frequency generation means for generating a digital output signal in response thereto; and
means for selectively coupling said digital output signal to said at least one electrical conductor.

28. The well survey system of claim 27 wherein:
said digital counter means includes an upcount mode and a downcount mode and wherein said switching means is coupled to said digital counter means and is effective for selectively altering the mode of operation of said digital counter means.

29. A well survey system for determining the location of relatively deep boreholes with great accuracy comprising:
a tubular probe adapted to be passed through a wellbore;
at least one electrical conductor disposed at a first end of said tubular probe for forming an electrical data transmission path from said tubular probe;
a plurality of inertial measurement sensors rotatably mounted in fixed relationship within said tubular probe;
means for selectively coupling each of the outputs of said plurality of inertial measurement sensors to said at least one electrical conductor;
means for rotating said plurality of inertial measurement sensors about the axis of said tubular probe to each of at least two predetermined positions in response to a control signal.

30. The well survey system of claim 29 further including:
computer means adapted to be electrically coupled to said tubular probe for generating said control signal.

31. The well survey instrument of claim 29 wherein:
said at least two predetermined positions comprise two predetermined positions separated by substantially one hundred and eighty degrees of arc, whereby the outputs of said plurality of inertial measurement sensors at said two predetermined positions may be utilized to determine true north.

32. A well survey system for determining the location of relatively deep boreholes with great accuracy comprising:
a tubular probe adapted to be passed through a wellbore;

said circuit means disposed within the vacuum sleeve includes means for periodically stopping rotation of the cluster assembly relative to the pressure vessel for a selected period of time in response to a selected output of said inertial sensing means indicative of a minimum amount of acceleration being sensed over a selected period of time.

11. The survey system of claim 8 wherein:

said circuit means disposed within the vacuum sleeve includes means for periodically rotating the cluster assembly to at least two predetermined data sample positions for selected time intervals in response to the lapse of a selected period of time.

12. The survey system of claim 8 wherein:

said circuit means disposed within the vacuum sleeve includes means for periodically rotating the cluster assembly to at least two predetermined data sample positions for selected time intervals in response to a selected output of said inertial sensing means indicative of a minimum amount of acceleration being sensed over a selected period of time.

13. A well survey system for determining the location of relatively deep boreholes with great accuracy comprising:

a tubular probe adapted to be passed through a wellbore;

computer means adapted to be electrically coupled to said tubular probe for receiving data therefrom and for transmitting control signals thereto;

at least one electrical conductor forming an electrical data transmission path between said computer means and said tubular probe;

a plurality of inertial measurement sensors rotatably mounted in fixed relationship within said tubular probe for sensing acceleration and/or rotation of said tubular probe;

means for selectively coupling each of the outputs of said plurality of inertial measurement sensors to said at least one electrical conductor;

means of selectively rotating said plurality of inertial measurement sensors about the axis of said tubular probe in response to a control signal;

first means for generating said control signal in response to the output of a selected one of said plurality of inertial measurement sensors; and second means for generating said control signal in response to an electrical signal coupled to said at least one electrical conductor from said computer means.

14. The well survey system of claim 13 wherein:

said means for selectively rotating said plurality of inertial measurement sensors includes means for rotating said plurality of inertial measurement sensors in both clockwise and counterclockwise directions.

15. The well survey system of claim 13 wherein:

said first means for generating said control signal in response to the output of a selected one of said plurality of inertial measurement sensors comprises a servo loop from said selected one of said plurality of inertial measurement sensors and said output comprises a signal representative of the rotation about the longitudinal axis of said tubular probe whereby said plurality of inertial measurement sensors is decoupled from said rotation.

16. A well survey system for determining the location of relatively deep boreholes with great accuracy comprising:

a tubular probe adapted to be passed through a wellbore;

at least one electrical conductor disposed at a first end of said tubular probe for forming an electrical data transmission path from said tubular probe;

a plurality of inertial measurement sensors rotatably mounted in fixed relationship within said tubular probe;

communications means axially displaced from said plurality of inertial measurement sensors and disposed between said plurality of inertial measurement sensors and said at least one electrical conductor for selectively coupling each of the outputs of said plurality of inertial measurement sensors to said at least one electrical conductor; and rotator means for selectively rotating said plurality of inertial measurement sensors, said rotator means axially displaced from said plurality of inertial measurement sensors and disposed between said plurality of inertial measurement sensors and a second end of said tubular probe whereby any electromagnetic interference generated by said rotator means is isolated from said communications means.

17. The well survey system of claim 16 wherein:

said well survey system further includes computer means adapted to be electrically coupled to said tubular probe for receiving data therefrom and for transmitting control signals thereto, and wherein said communications means includes digital communications circuitry for transmitting digital signals representative of the outputs of said plurality of inertial measurement sensors to said computer means.

18. The well survey system of claim 17 wherein:

said rotator means is responsive to a selected control signal coupled to said at least one electrical conductor from said computer means for selectively rotating said plurality of inertial measurement sensors within said tubular probe.

19. The well survey system of claim 16 wherein:

said rotator means is responsive to the output of a selected one of said plurality of inertial measurement sensors for selectively rotating said plurality of inertial measurement sensors within said tubular probe.

20. A well survey system for determining the location of relatively deep boreholes with great accuracy comprising:

a tubular probe adapted to be passed through a wellbore;

at least one electrical conductor disposed at a first end of said tubular probe for forming an electrical data transmission path from said tubular probe;

a plurality of inertial measurement sensors mounted in fixed relationship within said tubular probe;

communications means axially displaced from said plurality of inertial measurement sensors and disposed between said plurality of inertial measurement sensors and said at least one electrical conductor for selectively coupling each of the outputs of said plurality of inertial measurement sensors to said at least one electrical conductor; and multiphase power generation means for supplying multiphase electrical power to said plurality of inertial measurement sensors, said multiphase power generation means axially displaced from said plurality of inertial measurement sensors and disposed between said plurality of inertial measurement sensors and a second end of said tubular probe whereby any electromagnetic interference generated by said multiphase power generation means is isolated from said communications means.

at least one electrical conductor disposed at a first end of said tubular probe for forming an electrical data transmission path from said tubular probe;

a plurality of inertial measurement sensors mounted in fixed relationship within said tubular probe;

a plurality of operating parameter sensors disposed at selected locations within said tubular probe; and means for selectively coupling each of the outputs of said plurality of inertial measurement sensors and each of the outputs of said plurality of operating parameter sensors to said at least one electrical conductor.

33. The well survey system of claim 32 wherein:

said operating parameter sensors are temperature sensing devices whereby the operating temperatures of various components within said tubular probe may be monitored.

34. The well survey system of claim 32 wherein:

said operating parameter sensors are voltage sensing devices, whereby the operating voltages within various components within said tubular probe may be monitored.

35. A well survey system for determining the location of relatively deep boreholes with great accuracy comprising:

a tubular probe adapted to be passed through a wellbore;

at least one electrical conductor disposed at a first end of said tubular probe for forming an electrical data transmission path from said tubular probe;

a plurality of inertial measurement sensors mounted in fixed relationship within said tubular probe;

timing means having an output indicative of the elapsed time from a selected point in time; and means for periodically coupled each of the outputs of said plurality of inertial measurement sensors and said output of said timing means to said at least one electrical conductor.

36. The method of surveying a relatively deep borehole to determine its location using:

a probe comprising a tubular pressure vessel having an inertial cluster assembly including an elongated, rigid support member within the vessel and inertial sensing means for sensing acceleration of the inertial assembly along three substantially orthogonally disposed sense axes, one of which is aligned with the longitudinal axes of the probe, and for sensing rates or rotation about the same three orthogonally disposed axes, the inertial sensing means being rigidly mounted at spaced points on the support member, the steps comprising:

(a) positioning the longitudinal axis of the probe generally horizontal and in a generally north-south direction;

(b) initiating operation of the inertial sensing means;

(c) rotating the cluster assembly while monitoring outputs of the inertial sensing means to position one of the sense axes at four positions, vertically up and down and horizontally east and west, for predetermined sample periods while reading and storing the outputs of the inertial sensing means;

(d) computing current calibration data for selected inertial instruments from the sampled data and comparing the computed calibration data to predetermined norms to permit a preliminary decision to abandon the survey run with the probe;

(e) positioning the probe with the longitudinal axis in the vertical position at a known point in the top of the wellbore and rotating the cluster assembly to at least two sample positions in predetermined relationship one to the other while reading and storing the outputs from the inertial sensing means;

(f) completing computations of current calibrations for selected inertial sensing means and the position of true north and horizontal;

(g) initiating a survey mode wherein the probe traverses the wellbore while the outputs from the inertial sensing means are continuously read and stored and certain computations made for the duration of a survey trip while (i) substantially preventing rotation of the inertial cluster assembly while the probe is moving longitudinally of the wellbore;

(ii) periodically substantially stopping movement of the inertial cluster within the wellbore while continuing to read and store data for a selected time interval;

(iii) periodically, while the probe is stationary within the wellbore, rotating the inertial cluster assembly to at least two data sample positions at selected relative rotational positions for selected time intervals; and computing the path of the probe relative to a three dimensional coordinate system using the inertial measurements produced by the inertial sensing means as calibrated from corrections made.

37. The method of claim 36 wherein, at least prior to performing computations to determine the statiscally most likely coordinates of the path of the borehole, initial restraint factors, mass unbalance factors are determined prior to the start of the run for the X axis gyro, the Y axis gyro, and the restraint, mass unbalance and the scale factor of the Z axis gyro, and the bias factors and scale factors for the X axis accelerometer and the Y axis accelerometer.

38. The method of claim 36 further characterized by:

stopping the probe at said known point in the top of the wellbore and rotating the cluster assembly to at least two sample positions in predetermined relationship one to the other while reading and storing the outputs from the inertial sensing means;

removing the probe from the wellbore and positioning the probe generally horizontal and in a generally north-south direction; and rotating the cluster assembly while monitoring outputs of the inertial sensing means to position one of the sense axes at four positions, vertically up and down and horizontally east and west, for predetermined sample periods while reading and storing the outputs of the inertial sensing means.

39. The method of surveying a relatively deep borehole to determine its location using:

a probe comprising a tubular pressure vessel having an inertial cluster including an elongated, rigid support member within the vessel and inertial sensing means for sensing acceleration of the inertial assembly along three substantially orthogonally disposed sense axes, one of which is aligned with the longitudinal axes of the probe, and for sensing rates of rotation about the same three orthogonally disposed axes, the inertial sensing means being rigidly mounted at spaced points on the support member, the steps comprising:

(a) positioning the longitudinal axis of the probe generally horizontal and in a generally north-south direction;

(b) initiating operation of the inertial sensing means;

(c) rotating the cluster assembly while monitoring outputs of the inertial sensing means to position one of the sense axes at four positions, vertically up and down and horizontally east and west, for predetermined sample periods while reading and storing the outputs of the inertial sensing means;

(e) positioning the probe with the longitudinal axis in the vertical position at a known point in the top of the wellbore;

(f) rotating the cluster assembly to at least two sample positions in predetermined relationship one to the other while reading and storing the outputs from the inertial sensing means;

(g) computing current calibrations for selected inertial sensing means and the position of true north and horizontal;

(h) initiating a survey mode wherein the probe traverses the wellbore while the outputs from the inertial sensing means are continuously read and stored and certain computations made for the duration of a survey trip while (i) substantially preventing rotation of the inertial cluster assembly while the probe is moving longitudinally of the wellbore;

(ii) periodically substantially stopping movement of the inertial cluster within the wellbore while continuing to read and store data for a selected time interval;

computing the path of the probe relative to a three dimensional coordinate system using the inertial measurements produced by the inertial sensing means as calibrated during the current survey procedure.

40. The method of surveying a relatively deep borehole to determine its location using:

a probe comprising a tubular pressure vessel; an elongated, rigid support member within the vessel; and inertial sensing means for sensing acceleration of the inertial assembly along three substantially orthogonally disposed sense axes, one of which is aligned with the longitudinal axes of the probe, and for sensing rates of rotation about the same three orthogonally disposed axes, the inertial sensing means being rigidly mounted at spaced points on the support member to form a cluster assembly, the steps comprising:

(a) positioning the longitudinal axis of the cluster assembly generally horizontal and in a generally north-south direction;

(b) initiating operation of the inertial sensing means;

(c) rotating the cluster assembly while monitoring outputs of the inertial sensing means to position at least one of the sense axes at at least one predetermined position while reading and storing the data outputs of the inertial sensing means for a sample period;

(d) computing current calibration data for selected inertial instruments from the data outputs and comparing the computed calibration data to predetermined norms to permit a preliminary decision to abandon the survey run with the probe.

41. The method of surveying a relatively deep borehole to determine its location using:

a probe comprising a tubular pressure vessel; an elongated, rigid support member within the vessel; and inertial sensing means for sensing acceleration of the inertial assembly along three substantially orthogonally disposed sense axes, one of which is aligned with the longitudinal axes of the probe, and for sensing rates of rotation about the same three orthogonally disposed axes, the inertial sensing means being rigidly mounted at spaced points on the support member, the steps comprising:

(a) positioning the longitudinal axis of the probe generally horizontal and in a generally north-south direction;

(b) initiating operation of the inertial sensing means;

(c) rotating the cluster assembly while monitoring outputs of the inertial sensing means to position one of the sense axes at four positions, vertically up and down and horizontally east and west, for predetermined sample periods while reading and storing the outputs of the inertial sensing means;

(d) computing current calibration data for selected inertial instruments from the sampled data and comparing the computed calibration data to predetermined norms to permit a preliminary decision to abandon the survey run with the probe;

(e) positioning the probe with the longitudinal axis in the vertical position at a known point in the top of the wellbore;

(f) rotating the cluster assembly to at least two sample positions in predetermined relationship one to the other while reading and storing the outputs from the inertial sensing means;

(g) completing computations of current calibrations for selected inertial sensing means and the position of true north and horizontal;

(h) initiating a survey mode wherein the probe traverses the wellbore while the outputs from the inertial sensing means are continuously read and stored and certain computations made for the duration of a survey trip while (i) substantially preventing rotation of the inertial cluster assembly while the probe is moving longitudinally of the wellbore;

(ii) periodically substantially stopping movement of the inertial cluster within the wellbore while continuing to read and store data for a selected time interval;

computing the path of the probe relative to a three dimensional coordinate system using the inertial measurements produced by the inertial sensing means as calibrated from corrections made.

42. The method of surveying a relatively deep borehole to determine its location using:

a probe comprising a tubular pressure vessel; an elongated, rigid support member within the vessel; and inertial sensing means for sensing acceleration of the inertial assembly along three substantially orthogonally disposed sense axes, one of which is aligned with the longitudinal axes of the probe, and for sensing rates of rotation about the same three orthogonally disposed axes, the inertial sensing means being rigidly mounted at spaced points on the support member, the steps comprising:

(a) positioning the probe with the longitudinal axis in the vertical position at a known point in the top of the wellbore;

(b) rotating the cluster assembly to at least two sample positions in predetermined relationship one to the other while reading and storing the outputs from the inertial sensing means;

(c) initiating a survey mode wherein the probe traverses the wellbore while the outputs from the inertial sensing means are continuously read and stored and certain computations made for the duration of a survey trip while (i) substantially preventing rotation of the inertial cluster assembly while the probe is moving longitudinally of the wellbore;

(ii) periodically substantially stopping movement of the inertial cluster within the wellbore while continuing to read and store data for a selected time interval;

computing the path of the probe relative to a three dimensional coordinate system using the inertial measurements produced by the inertial sensing means.

43. The survey system for determining the location of relatively deep boreholes with great accuracy comprising:

a tubular probe having a maximum diameter less than about four inches and adapted to be lowered into a wellbore;

a flexible cable attached to the upper end of the probe including at least one electrical data transmission path and having sufficient length to lower the probe into the borehole;

reel means for controllably paying out and retrieving the flexible cable to lower the probe into and retrieve the probe from the wellbore;

computer means including keyboard input means, data processing means, data readout means and data recording means electrically coupled by the flexible cable to the probe to receive data from and give commands to circuit means therein;

the probe comprising:

(1) a tubular pressure vessel;

(2) vacuum sleeve means disposed within the tubular pressure vessel for substantially thermally isolating the interior thereof from the pressure vessel;

(3) an inertial cluster assembly including (a) an elongated, rigid, thermally conductive support member disposed within the vacuum sleeve;

(b) inertial sensing means for sensing acceleration of the inertial assembly along three substantially orthogonally disposed sense axes, one of which is aligned with the longitudinal axes of the probe, and for sensing rates of rotation about the same three orthogonally disposed axes, the inertial sensing means being rigidly mounted at spaced points on the support member in heat exchange relationship therewith;

(4) controllable torque means coupled to rotate the support member including electric motor means and mechanical means for locking the inertial cluster assembly relative to the vacuum sleeve;

(5) circuit means disposed within the vacuum sleeve for:

(a) initiating and terminating operation of the inertial sensing means on command;

(b) producing analog signals representative of the inertial measurements of said inertial sensing means and converting the analog signals to digital signals representative of the inertial measurements of said inertial sensing means;

(c) transmitting the digital signals from the probe over the cable to the computer means; and (d) responding to control signals received by the probe from the computer system, the lapse of selected periods of time and selected inertial measurements of said inertial sensing means;

said computer means including:

(1) means for receiving digital signals transmitted from the probe via a data path and for transmitting control signals to the probe via a data path, (2) means for displaying data received from the probe;

(3) means for inputting control signals to the probe in response to operator actuated input signals, said computer means and circuit means carried by said probe including means for, in response to at least one control signal, (4) means for accessing stored data representative of selected fixed calibration data for said probe, (a) initiating operation of the inertial sensing means, (b) rotating the cluster assembly while monitoring outputs of the inertial sensing means to position one of the sense axes at each of four different positions for predetermined sample periods while reading and storing the outputs of the inertial sensing means, (c) computing calibration data for said inertial sensing means from the sampled data and said selected fixed calibration data and comparing the computed calibration to predetermined norms, (d) rotating the cluster assembly to at least two predetermined sample positions while reading and storing the outputs from the inertial sensing means, (e) initiating a survey mode wherein outputs from the inertial sensing means and temperature sensing means are continuously read and position computations made for the duration of a survey trip while (i) initiating a decoupling mode where the inertial cluster assembly is decoupled from rotational movement of the pressure vessel by the inertially referenced servo loop while the probe is rotating longitudinally in the wellbore, (ii) periodically, while the probe is stationary within the wellbore, stopping rotation of the cluster assembly relative to the pressure vessel for a selected time interval.

(iii) periodically, while the probe is stationary within the wellbore, rotating the cluster assembly to at least two predetermined data sample positions for selected time intervals, and computing the path of the probe relative to a three dimensional coordinate system using the inertial measurements produced by the inertial sensing means as calibrated and corrected by computations made from the output readings obtained during a selected survey procedure.

44. The survey system of claim 43 wherein:

said stored data representative of selected fixed calibration data for said probe is stored in a tape cassette unit associated with said probe.

45. The survey system of claim 43 wherein:

said stored data representative of selected fixed calibration data for said probe is stored in a solid state memory device mounted within said probe.

46. A method of operating a borehole survey system which includes a tubular probe adapted to be lowered into a wellbore having a plurality of inertial measurement sensors disposed therein, a flexible cable attached to the upper end of said probe including at least one electrical data transmission path and having sufficient length to lower the probe into the borehole and a computer means electrically coupled by means of the flexible cable to the probe for receiving data therefrom and for transmitting control signals thereto, comprising:

identifying fixed calibration data intrinsic to said probe as a result of manufacture;

storing said fixed calibration data in a substantially permanent media associated with said probe;

operating said plurality of inertial measurement sensors for a selected period of time over a selected range of movement to obtain current calibration data prior to each operation of said system;

coupling said current calibration data to said computer means;

coupling said fixed calibration data to said computer means;

lowering said tubular probe into a wellbore while measuring and storing the outputs of said plurality of inertial measurement sensors;

utilizing said computer to calibrate said outputs of said plurality of inertial measurement sensors in response to said fixed calibration data and said current calibration data; and computing the path of said probe utilizing the calibrated outputs of said plurality of inertial measurement sensors.

47. The method of surveying a borehole to determine its location using a probe having an elongated, rigid support member and inertial sensing means rigidly mounted on the support member to form a cluster assembly, the inertial sensing means including means for sensing acceleration of the inertial assembly along three substantially orthogonally disposed sense axes, one of which is aligned with the longitudinal axis of the probe, and for sensing rates of rotation about the same three axes, which comprises:

calibrating the inertial sensing means for measuring acceleration along the axes aligned with the longitudinal axis of the probe by successively positioning the probe with said sense axis disposed vertically upwardly and vertically downwardly for sample periods while reading the outputs from said sensing means, and computing the bias factor and scale factor from the sampled outputs.

48. The method of claim 47 wherein the vertical position of said sense axis is determined by nulling the outputs from the inertial sensing means for the other two orthogonally disposed axes.

49. The method of surveying a relatively deep borehole to determine its location using:

a probe comprising a tubular pressure vessel; an elongated, rigid support member within the vessel; and inertial sensing means for sensing acceleration of the inertial assembly along three substantially orthogonally disposed sense axes X, Y and Z, With the Z axis being aligned with the longitudinal axes of the probe, and for sensing rates of rotation about the same three orthogonally disposed axes, the inertial sensing means being ridigly mounted at spaced points on the support member, the steps comprising:

(a) positioning the longitudinal axis of the probe generally horizontal and in a generally north-south direction;

(b) initiating operation of the inertial sensing means;

(c) rotating the cluster assembly while monitoring outputs of the inertial sensing means to position one of the sense axes at four positions, vertically up and down and horizontally east and west, for predetermined sample periods while reading and storing the outputs of the inertial sensing means;

(d) positioning the positive Z axis vertically up for a sample period and vertically down for a sample period while reading and storing the outputs of the inertial sensing means;

(e) computing current calibration data for selected inertial instruments from the sampled data and comparing the computed calibration data to predetermined norms to permit a preliminary decision to abandon the survey run with the probe;

(f) holding the probe essentially stationary for a predetermined period while continuing to read and store data, making survey calculations to detect any drift error in the system during the sample period and comparing the calculated drift error to an established norm to permit a preliminary decision to abandon the survey run with the probe;

(g) positioning the probe with the longitudinal axis in the vertical position at a known point in the top of the wellbore;

(h) rotating the cluster assembly to at least two sample positions in predetermined relationship one to the other while reading and storing the outputs from the inertial sensing means;

(i) completing computations of current calibrations for selected inertial sensing means and the position of true north and horizontal;

(j) initiating a survey mode wherein the probe traverses the wellbore while the outputs from the inertial sensing means are continuously read and stored and certain computations made for the duration of a survey trip while (i) substantially preventing rotation of the inertial cluster assembly while the probe is moving longitudinally of the wellbore;

(ii) periodically substantially stopping movement of the inertial cluster within the wellbore while continuing to read and store data for a selected time interval;

computing the path of the probe relative to a three dimensional coordinate system using the inertial measurements produced by the inertial sensing means as calibrated from corrections made.

50. The method of surveying a relatively deep borehole to determine its location using:

a probe comprising a tubular pressure vessel; an elongated, rigid support member within the vessel; and inertial sensing means for sensing acceleration of the inertial assembly along three substantially orthogonally disposed sense axes, one of which is aligned with the longitudinal axes of the probe, and for sensing rates of rotation about the same three orthogonally disposed axes, the inertial sensing means being rigidly mounted at spaced points on the support member to form a cluster assembly, the steps comprising:

(a) positioning the longitudinal axis of the probe generally horizontal and in a generally north-south direction;

(b) initiating operation of the inertial sensing means;

(c) rotating the cluster assembly while monitoring outputs of the inertial sensing means to position one of the sense axes at four positions, vertically up and down and horizontally east and west, for predetermined sample periods while reading and storing the outputs of the inertial sensing means;

(d) positioning the positive Z axis vertically up for a sample period and vertically down for a sample period while reading and storing the outputs of the inertial sensing means;

(e) computing current calibration data for selected inertial instruments from the sampled data and comparing the computed calibration data to predetermined norms to permit a preliminary decision to abandon the survey run with the probe.

51. In a method of surveying a relatively deep borehole to determine its location using a probe comprising a tubular pressure vessel having an inertial cluster assembly including an elongated, rigid support member with inertial sensing means rigidly mounted thereon for sensing acceleration of the inertial assembly along three substantially orthogonally disposed sense axes, X, Y and Z with the Z axis aligned generally with the longitudinal axes of the probe, and for sensing rates of rotation about the same three orthogonally disposed axes, the steps comprising:

(a) initiating operation of the inertial sensing means;

(b) positioning the Z axis generally horizontal and in a generally north-south direction and rotating the cluster assembly while monitoring outputs of the inertial sensing means to position the positive X axis at four sample positions, vertically up and down and horizontally east and west, for predetermined sample periods while reading and storing the outputs of the inertial sensing means;

(c) rotating the probe from one sample position where the positive Z axis is in one vertical position to another sample position where the positive Z axis is in the opposite vertical direction with the X axis disposed horizontally while the probe is rotated;

(d) rotating the probe from one sample position where the positive Z axis is in one vertical position to another sample position where the positive Z axis is in the opposite vertical direction with the Y axis disposed horizontally while the probe is rotated;

(e) computing the current calibration data for the inertial instruments including the restraint factors, mass unbalance factors and scale factors of at least selected gyros and the bias factors and scale factors of at least selected accelerometers;

(f) initiating a survey mode wherein the probe traverses the wellbore while the outputs from the inertial sensing means are continuously read and stored and certain computations made for the duration of a survey trip; and (g) computing the path of the probe relative to a three dimensional coordinate system using the inertial measurements produced by the inertial sensing means using the current calibrations.

* * * * *